US006429830B2

(12) United States Patent
Noro et al.

(10) Patent No.: US 6,429,830 B2
(45) Date of Patent: Aug. 6, 2002

(54) HELICAL ANTENNA, ANTENNA UNIT, COMPOSITE ANTENNA

(75) Inventors: Junichi Noro; Hirokazu Awa, both of Akita; Masaaki Miyata, Atsugi, all of (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/859,246

(22) Filed: May 17, 2001

(30) Foreign Application Priority Data

| | | |
|---|---|---|
| May 30, 2000 | (JP) | 2000-159361 |
| May 30, 2000 | (JP) | 2000-159520 |
| May 30, 2000 | (JP) | 2000-159984 |
| May 31, 2000 | (JP) | 2000-161847 |
| May 18, 2000 | (JP) | 2000-146698 |
| May 29, 2000 | (JP) | 2000-158058 |
| May 29, 2000 | (JP) | 2000-158415 |
| Jun. 2, 2000 | (JP) | 2000-165445 |
| Jun. 14, 2000 | (JP) | 2000-178200 |
| Jun. 14, 2000 | (JP) | 2000-178358 |
| Jun. 15, 2000 | (JP) | 2000-179256 |
| Jun. 20, 2000 | (JP) | 2000-184754 |
| Sep. 25, 2000 | (JP) | 2000-289820 |

(51) Int. Cl.[7] ..... H01Q 1/36
(52) U.S. Cl. ..... 343/895; 455/276.1
(58) Field of Search ..... 343/895, 896, 343/853, 860, 778, 700 MS, 893, 745, 749, 900; 455/276.1, 19, 194.2, 293, 311, 269, 280, 283; H01Q 1/36

(56) References Cited

U.S. PATENT DOCUMENTS

| | | | | |
|---|---|---|---|---|
| 5,014,346 A | * | 5/1991 | Phillips et al. | 455/89 |
| 5,265,272 A | * | 11/1993 | Kurcbart | 455/344 |
| 5,438,697 A | * | 8/1995 | Fowler et al. | 455/347 |
| 5,488,737 A | * | 1/1996 | Harbin et al. | 455/33.1 |
| 6,115,593 A | * | 9/2000 | Alinikula et al. | 455/324 |
| 6,236,366 B1 | * | 5/2001 | Yamamoto et al. | 343/700 MS |
| 6,256,480 B1 | * | 7/2001 | Stengel, Jr. | 455/78 |
| 6,339,408 B1 | * | 1/2002 | Edvardsson et al. | 343/895 |

* cited by examiner

*Primary Examiner*—Don Wong
*Assistant Examiner*—Trinh Vo Dinh
(74) *Attorney, Agent, or Firm*—Frishauf, Holtz, Goodman & Chick, P.C.

(57) ABSTRACT

In a helical antenna comprising a hollow cylindrical member having an inner peripheral surface and an outer peripheral surface and an antenna pattern film wound around the outer peripheral surface of the hollow cylindrical member, the helical antenna further comprises a center rod coaxial with a center axis of the hollow cylindrical member and at least three ribs disposed between the center rod and the inner peripheral surface of the hollow cylindrical member. The ribs symmetrically extends in a radial manner at equal angular intervals. The hollow cylindrical member, the center rod, and the ribs preferably may be integrally molded out of plastic. The antenna pattern film may comprise a flexible insulator film and a conductive pattern formed on the flexible insulator film. The conductive pattern has at least one antenna lead member which is wound around the outer peripheral surface of the hollow cylindrical member in a helix fashion.

7 Claims, 40 Drawing Sheets

HELICAL ANTENNA, ANTENNA UNIT, COMPOSITE ANTENNA

BACKGROUND OF THE INVENTION:

This invention relates to a digital radio receiver for receiving an electric wave from an artificial satellite (which may be called a "satellite wave") or an electric wave on the ground (which may be called a "ground wave") to listen in a digital radio broadcasting and, in particular, to an antenna for use in the digital radio receiver.

In recent years, a digital radio receiver, which receives the satellite wave or the ground wave to listen in the digital radio broadcasting, has been developed and is put to practical use in the United States of America. The digital radio receiver is mounted on a mobile station such as an automobile and can receive an electric wave having a frequency of about 2.3 gigahelts (GHz) to listen in a radio broadcasting. That is, the digital radio receiver is a radio receiver which can listen in a mobile broadcasting. In addition, the ground wave is an electric wave in which a signal where the satellite wave is received in an earth station is frequently shifted a little.

In order to receive such an electric wave having the frequency of about 2.3 GHz, it is necessary to set up an antenna outside the automobile. Although such antennas have been proposed those having various structures, the antennas of stick-type are generally used rather than those of planer-type (plane-type). In addition, in the manner which is well known in the art, an electromagnetic wave radiated in a free space is a transverse wave having electric and magnetic fields which vibrate at right angles to each other in a plane perpendicular to the direction of motion and the electric field and the magnetic field have variable strength in the plane. A polarized wave is an electromagnetic radiation in which the direction of the electric field vector is not random. The satellite wave is a circular polarization while the ground wave is a linear polarization. Accordingly, exclusive antennas are required to receive both of the satellite wave and the ground wave.

Now, the description will be mainly made as regards the antennas for receiving the satellite wave. A helical or helix antenna is known in the art as one of the antennas of the stick-type. The helical antenna has structure where at least one antenna lead member is wound around an outer peripheral surface of a hollow or solid cylindrical (which is collectively called "cylindrical") member in a helix fashion (spiral fashion), namely, is an antenna having the form of a helix. The cylindrical member may be merely called a "bobbin" or a "dielectric core" in the art. In addition, the antenna lead member may be merely called a "lead." The helical antenna can effectively receive the above-mentioned circular polarization. The cylindrical member or the bobbin is made of an insulation material such as plastics. In addition, the antenna lead members are equal, for example, in number to four. On the other hand, it is remarkably difficult to really wind the plurality of antenna lead members around the outer peripheral surface of the cylindrical member or the bobbin in the helix fashion. Accordingly, alternatively, another helical antenna is proposed in which an antenna pattern film where a plurality of conductive patterns are printed or formed on an insulation sheet or a flexible film is wound around the outer peripheral surface of the cylindrical member or the bobbin.

In general, the hollow cylindrical member is used rather than the solid cylindrical member. This is because the solid cylindrical member has a heavy weight and requires a large amount of material on manufacturing. However, a conventional helical antenna comprising the hollow cylindrical member is advantageous in that it has a weak structure in strength.

In addition, such as a helical antenna has a resonance frequency which is determined due to a height (length), a diameter, a relative dielectric constant (relative permittivity), and so on of the cylindrical member. Accordingly, in order to receive the satellite wave (circular polarization) having the frequency of about 2.3 GHz using the helical antenna, it is necessary to make a resonance point (or the resonance frequency of the helical antenna) equal to a desired resonance frequency of 2.3 GHz. However, inasmuch as variations in size are not avoided on a process of manufacturing the helical antenna, it is necessary to adjust the resonance frequency of the helical antenna to match the desired resonance frequency.

In prior art, a conventional adjustment method is a cutting method comprising the step of cutting a tip portion of the helical antenna to adjust the length of the helical antenna. However, the cutting method is disadvantageous in that it takes a lot of time in the manner which will later be described in detail.

In addition, a conventional helical antenna is manufactured by winding the antenna film pattern around the outer peripheral surface of the bobbin and by fixing the antenna film pattern on the bobbin by means of an adhesive tape, an adhesive agent, or the like. With this structure, the conventional helical antenna is advantageous in that the antenna film pattern may be peeled off the bobbin due to a long service and it is difficult to stably fix the antenna film pattern on the outer peripheral surface of the bobbin. In addition, when the helical antenna is mounted on the automobile, vibrations and shocks are given to the helical antenna. Under the circumstances, sufficient antivibration and antishockness are not obtained in the above-mentioned conventional helical antenna in which the antenna pattern film is fixed on the outer peripheral surface of the bobbin by means of the adhesive tape, the adhesive agent, or the like.

Attention will be directed to a four-phase feel helical antenna which has four antenna lead members wound around the outer peripheral surface of the bobbin. After the satellite wave is received by the four antenna lead members as four received waves, the four received waves are phase shifted and combined by a phase shifter so as to match phases of the four received waves to obtain a combined wave, and then the combined wave is amplified by a low-noise amplifier to obtain an amplified wave which is delivered to a receiver body. A combination of the four-phase feed helical antenna, the phase shifter, and the low-noise amplifier is called an antenna unit.

In addition, the helical antenna may have only one antenna lead member. In this event, the phase shifter is removed from the antenna unit. In other words, the antenna unit consists of the helical antenna and the low-noise amplifier.

A conventional antenna unit is provided with a bottom case which is Adisposed at a lower end of the helical antenna and in which the low-noise amplifier is received. Inasmuch as the bottom case is required in the conventional antenna unit, the bottom case hinders miniaturization of the antenna unit and restricts design of the antenna unit. In the conventional antenna unit, the phase shifter and the low-noise amplifier are constructed as separated parts and provided with connectors for connecting therebetween.

With this structure, assembling of the antenna unit is complicated and it is difficult to precisely evaluate performances at an output of the phase shifter and an input of the low-noise amplifier after assembling of the antenna unit.

In addition, a conventional antenna unit is provided with a ground plate having a plane shape on which the helical antenna is perpendicularly set up in the manner which will later be described in conjunction with FIGS. 39 and 40. Inasmuch as the ground plate has the plane shape, the conventional antenna unit is disadvantageous in that it is difficult to decrease ground noises and to improve an antenna sensitivity.

In order to receive both of the satellite wave and the ground wave, a special antenna unit comprising a helical antenna and a rod antenna is known in the art in the manner which will later be described in conjunction with FIG. 44. Such a special antenna unit is called a composite antenna unit. In the composite antenna unit, the helical antenna is for receiving the satellite wave or the circular polarization while the rod antenna is for receiving the ground wave or the linear polarization. Accordingly, the helical antenna may be called a circular polarization receiving antenna while the rod antenna may be called a linear polarization receiving antenna. In a conventional composite antenna, the circular polarization receiving antenna and the linear polarization receiving antenna are independently manufactured as independent parts. As a result, the conventional composite antenna is disadvantageous in that a lot of parts are required and a manufacturing cost is expensive.

SUMMARY OF THE INVENTION:

It is therefore an object of the present invention to provide a helical antenna which is capable of strengthening in structure without weighting.

It is another object of the present invention to provide a helical antenna which is capable of easily adjusting a resonance frequency of the helical antenna.

It is still another of the present invention to provide a helical antenna which is capable of stably fixing an antenna pattern film on an outer peripheral surface of a bobbin.

It is yet another of the present invention to provide a helical antenna which is capable of accurately positioning an antenna pattern film on an outer peripheral surface of a bobbin.

It is a further object of the present invention to provide an antenna unit which is capable of easily miniaturizing the antenna unit.

It is a still further object of the present invention to provide an antenna unit which is capable of easily assembling the antenna unit.

It is a yet further object of the present invention to provide an antenna unit which is capable of precisely evaluating performances of the antenna unit.

It is an object of the present invention to provide an antenna unit which is capable of decreasing ground noises.

It is another object of the present invention to provide an antenna unit which is capable of improving an antenna sensitivity of the antenna unit.

It is still another object of the present invention to provide a composite antenna which is capable of reducing the number of parts.

It is yet another object of the present invention to provide a composite antenna which is capable of decreasing a manufacturing cost.

It is a further object of the present invention to provide a composite antenna which is capable of miniaturizing the composite antenna.

Other objects of this invention will become clear as the description proceeds.

According to a first aspect of this invention, a helical antenna comprises a hollow cylindrical member made of insulator. The hollow cylindrical member has a center axis extending in a longitudinal direction, an inner peripheral surface, and an outer peripheral surface. An antenna pattern film is wound around the outer peripheral surface of the cylindrical member. A center rod is coaxial with the center axis. Disposed between the center rod and the inner peripheral surface of the hollow cylindrical member, at least three ribs symmetrically extend in a radial manner at equal angular intervals. Instead of the antenna pattern film, at least one antenna lead member may be wound around the outer peripheral surface of the cylindrical member in a helix fashion.

According to a second aspect of this invention, a helical antenna comprises a hollow cylindrical member made of insulator. The hollow cylindrical member has a center axis extending in a longitudinal direction, an inner peripheral wall, and an outer peripheral wall. The hollow cylindrical member has an upper end portion. The hollow cylindrical member has a female threaded screw hole where the upper end portion of the cylindrical member is threaded in the inner peripheral wall of the hollow cylindrical member. At least one antenna lead member is wound around the outer peripheral wall of the hollow cylindrical member in a helix fashion. A male screw member is threaded in the female threaded screw hole. The male screw member has a relative permittivity which is not less than that of the hollow cylindrical member.

According to a third aspect of this invention, a method is of adjusting a resonance frequency of the helical antenna according to the second aspect of this invention into a desired resonance frequency. The method comprises the steps of preparing the hollow cylindrical member having a length in which the helical antenna enables to receive a frequency lower than the desired resonance frequency, and of threading the male screw member in the female threaded screw hole so as to adjust the resonance frequency of the helical antenna into the desired resonance frequency.

According to a fourth aspect of this invention, a helical antenna comprises a cylindrical dielectric core made of insulator. The cylindrical dielectric core has a center axis extending a longitudinal direction and an outer peripheral surface. An antenna lead member made of conductor is wound around the outer peripheral surface of the cylindrical dielectric core in a helix fashion except for a tip portion of the cylindrical dielectric core. A resonance frequency adjustment portion made of additional conductor is formed on the outer peripheral surface of the cylindrical dielectric core at the tip portion of the cylindrical dielectric core adjacent to the antenna lead member.

According to a fifth aspect of this invention, a helical antenna comprises a cylindrical dielectric core made of insulator. The cylindrical dielectric core has a center axis extending a longitudinal direction and an outer peripheral surface. The helical antenna further comprises first through N-th antenna lead members each made of conductor where N represents a predetermined positive integer which is not less than two. Each of the first through the N-th antenna lead members is wound around the outer peripheral surface of the cylindrical dielectric core in a helix fashion except for a tip portion of the cylindrical dielectric core. First through N-th resonance frequency adjustment portions, each of which is made of additional conductor, are formed on the outer peripheral surface of the cylindrical dielectric core at the tip portion of the cylindrical dielectric core adjacent to the first through said N-th antenna lead members, respectively.

According to a sixth aspect of this invention, a method is of adjusting a resonance frequency of a helical antenna comprising a cylindrical dielectric core made of insulator, an antenna lead member made of conductor, and a resonance frequency adjustment portion made of additional conductor. The cylindrical dielectric core has a center axis extending a longitudinal direction and an outer peripheral surface. The antenna lead member is wound around the outer peripheral surface of the cylindrical dielectric core in a helix fashion except for a tip portion of the dielectric core. The resonance frequency adjustment portion is formed on the outer peripheral surface of the cylindrical dielectric core at the tip portion of the cylindrical dielectric core adjacent to the antenna lead member. The resonance frequency adjustment portion comprises the additional conductor which is apart from a tip of the antenna lead member with a primary gap and which consists of a train of conductor segments with subsidiary gaps between adjacent conductor segments. The method comprises the step of electrically connecting the antenna lead member with the additional conductor at the primary gap and of electrically connecting between the adjacent conductor segments at the subsidiary gaps in the order of being apart from the tip of the antenna lead member to vary a length of an antenna lead, thereby adjusting the resonance frequency of the helical antenna.

According to a seventh aspect of this invention, a helical antenna comprises a cylindrical dielectric core made of insulator. The cylindrical dielectric core has a center axis extending in a longitudinal direction and a core outer peripheral surface. At least one antenna lead member made of conductor is wound around the core outer peripheral surface of the cylindrical dielectric core in a helix fashion. A hollow dielectric member covers an tip end portion of the cylindrical dielectric core with the antenna lead member sandwiched between the hollow dielectric member and the cylindrical dielectric core. The hollow dielectric member is movable along the longitudinal direction.

According to an eighth aspect of this invention, a helical antenna comprises a cylindrical dielectric core made of insulator. The cylindrical dielectric core has a center axis extending in a longitudinal direction and a core outer peripheral surface. At least one antenna lead member made of conductor is wound around the core outer peripheral surface of the cylindrical dielectric core in a helix fashion. A hollow cylindrical outer cover covers an assembly of the cylindrical dielectric core and the at least one antenna lead member. The hollow cylindrical outer cover has a cover outer peripheral wall on which a cover male threaded portion is threaded at a tip end portion thereof. A hollow dielectric member has a member inner wall on which a member female threaded portion is threaded. The hollow dielectric member is threaded on the hollow cylindrical outer cover so as to engage the member female threaded portion with the cover male threaded portion.

According to a ninth aspect of this invention, a method is of adjusting a resonance frequency of a helical antenna comprising a cylindrical dielectric core made of insulator, at least one antenna lead member made of conductor, and a hollow dielectric member covering an tip end portion of the cylindrical dielectric core with the antenna lead member sandwiched between the hollow dielectric member and the cylindrical dielectric core. The cylindrical dielectric core has a center axis extending in a longitudinal direction and a core outer peripheral surface. The antenna lead member is wound around the core outer peripheral surface of the cylindrical dielectric core in a helix fashion. The hollow dielectric member is movable along the longitudinal direction. The method comprises the step of moving the hollow dielectric member along the longitudinal direction so as to change a range where the at least one antenna lead member is covered by the hollow dielectric member, thereby adjusting the resonance frequency of the helical antenna.

According to a tenth aspect of this invention, a helical antenna comprises a cylindrical dielectric core made of insulator. The cylindrical dielectric core has a center axis extending in a longitudinal direction and an outer peripheral surface. An antenna pattern film is wound around the outer peripheral surface of the cylindrical dielectric core. The antenna pattern film comprises a flexible insulator film and a conductive pattern printed on the flexible insulator film. The conductive pattern has at least one antenna lead member so as to wind the at least one antenna lead member on the outer peripheral surface of the cylindrical dielectric core in a helix fashion. The at least one antenna lead member is made of conductor. The flexible insulator film is detachably pasted on the outer peripheral surface of the cylindrical dielectric core. The flexible insulator film has a plurality of circumferential perforated circular lines extending along a circumferential direction at a tip portion of the cylindrical dielectric core except for the conductive pattern at equal intervals in the longitudinal direction so as to form belts between adjacent circumferential perforated circular lines.

According to an eleventh aspect of this invention, a method is of adjusting a resonance frequency of a helical antenna according to the tenth aspect of this invention so as to match a desired resonance frequency. The method comprises the steps of preparing the cylindrical dielectric core having a length so that the helical antenna enables to receive a frequency lower than the desired resonance frequency, and of stripping the belts of the flexible insulator film in the order of being apart from a tip end of the cylindrical dielectric core to decrease a length of the conductive pattern, thereby matching the resonance frequency of the helical antenna with the desired resonance frequency.

According to a twelfth aspect of this invention, a helical antenna comprises a solid cylindrical dielectric core made of insulator. The solid cylindrical dielectric core has a center axis extending in a longitudinal direction and an outer peripheral surface. The solid cylindrical dielectric core has a dielectric constant higher than that of air. The solid cylindrical dielectric core has a tip end which is exposed so as to enable to dig up the solid cylindrical dielectric core along the longitudinal direction. At least one antenna lead member is wound around the outer peripheral surface of the solid cylindrical dielectric core in a helix fashion.

According to a thirteenth aspect of this invention, a method is of adjusting a resonance frequency of a helical antenna according to the twelfth aspect of this invention so as to match a desired resonance frequency. The method comprises the steps of preparing the helical antenna having a resonance frequency which is lower than the desired resonance frequency, and of digging up a center portion of the solid cylindrical dielectric core at the tip end to decrease an effective length of the solid cylindrical dielectric core, thereby matching the resonance frequency of the helical antenna with said desired resonance frequency.

According to a fourteenth aspect of this invention, a helical antenna comprises a cylindrical dielectric core made of insulator. The cylindrical dielectric core has a center axis extending in a longitudinal direction and an outer peripheral surface. The solid cylindrical dielectric core has a plurality of through holes for penetrating the outer peripheral surface in a radial direction at predetermined spaces along the longitudinal direction. An antenna pattern film is wound around the outer peripheral surface of the cylindrical dielectric core. A plurality of plastic rivet pins pass through the respective though holes to fix the antenna pattern film on the outer peripheral surface of the cylindrical dielectric core.

According to a fifteenth aspect of this invention, a helical antenna comprises a hollow cylindrical dielectric core made of insulator. The hollow cylindrical dielectric core has a center axis extending in a longitudinal direction, an outer peripheral surface, and an inner peripheral surface. The hollow cylindrical dielectric core has a slit which communicates between the outer peripheral surface and the inner peripheral surface and which extending along the longitudinal direction. An antenna pattern film is wound around the outer peripheral surface of the cylindrical dielectric core. The antenna pattern film has one side edge which is inserted in the hollow cylindrical dielectric core through the slit, thereby hooking the antenna pattern film on the hollow cylindrical dielectric core at the one side edge thereof.

According to a sixteenth aspect of this invention, a method is of fixing an antenna pattern film on a hollow cylindrical dielectric core made of insulator. The hollow cylindrical dielectric core has a center axis extending in a longitudinal direction, an outer peripheral surface, and an inner peripheral surface. The method comprises the steps of forming a slit in said hollow cylindrical dielectric core so as to communicate between the outer peripheral surface and the inner peripheral surface and to extend along the longitudinal direction, of inserting one side edge of the antenna pattern film in the slit of the hollow cylindrical dielectric core to hook the antenna pattern film on the hollow cylindrical dielectric core at the one side edge thereof, of winding the antenna pattern film around the outer peripheral surface of the cylindrical dielectric core, and of adhering another side edge of the antenna pattern film to a surface of the antenna pattern film to fix the antenna pattern film on the outer peripheral surface of the hollow cylindrical dielectric core.

According to a seventeenth aspect of this invention, a helical antenna comprises a hollow cylindrical dielectric core made of insulator. The hollow cylindrical dielectric core has a center axis extending in a longitudinal direction, an outer peripheral surface, and an inner peripheral surface. The hollow cylindrical dielectric core has a slit which communicates between the outer peripheral surface and the inner peripheral surface and which extending along the longitudinal direction. The hollow cylindrical dielectric core has a plurality of hooks at the inner peripheral surface with equal intervals in the longitudinal direction near the slit. An antenna pattern film is wound around the outer peripheral surface of the hollow cylindrical dielectric core. The antenna pattern film having a plurality of eyes near one side edge thereof along the longitudinal direction with equal intervals, thereby said antenna pattern film is hooked on the hooks of the hollow cylindrical dielectric core at the one side edge thereof with the hooks engaged with the corresponding eyes.

According to an eighteenth aspect of this invention, a method is of fixing an antenna pattern film on a hollow cylindrical dielectric core made of insulator. The hollow cylindrical dielectric core has a center axis extending in a longitudinal direction, an outer peripheral surface, and an inner peripheral surface. The method comprises the steps of forming a slit in the hollow cylindrical dielectric core so as to communicate between the outer peripheral surface and the inner peripheral surface and to extend along the longitudinal direction, of fitting a plurality of hooks to the hollow cylindrical dielectric core at the inner peripheral surface with equal intervals in the longitudinal direction near the slit, of forming a plurality of eyes in the antenna pattern film near one side edge of the antenna pattern film along the longitudinal direction with equal intervals, of inserting the one side edge of the antenna pattern film in the slit of the hollow cylindrical dielectric core, of hooking the one side edge of the antenna pattern film on the hooks with the hooks engaged with the corresponding eyes, of winding the antenna pattern film around the outer peripheral surface of the hollow cylindrical dielectric core, and of adhering another side edge of the antenna pattern film to a surface of said antenna pattern film to fix the antenna pattern film on the outer peripheral surface of the hollow cylindrical dielectric core.

According to a nineteenth aspect of this invention, an antenna unit comprises a helical antenna comprising a hollow cylindrical member made of insulator and an antenna lead member made of conductor. The hollow cylindrical member has a center axis extending in a longitudinal direction, an outer peripheral surface, and an inner peripheral surface. The antenna lead member is wound around the outer peripheral surface of the hollow cylindrical member in a helix fashion. A main circuit board is mounted inside said hollow cylindrical member near one end of the hollow cylindrical member in the longitudinal direction. A low-noise amplifier is mounted on the main circuit board. The low-noise amplifier has an amplifier input terminal connected to an end of said antenna lead member.

According to a twentieth aspect of this invention, an antenna unit comprises a helical antenna comprising a hollow cylindrical member made of insulator and an antenna lead member made of conductor. The hollow cylindrical member has a center axis extending in a longitudinal direction, an outer peripheral surface, and an inner peripheral surface. The antenna lead member is wound around the outer peripheral surface of the hollow cylindrical member in a helix fashion. A main circuit board is mounted inside the hollow cylindrical member near one end of the hollow cylindrical member in the longitudinal direction. The main circuit board has a principal surface which extends in parallel with the longitudinal direction. A low-noise amplifier is mounted on the principal surface of the main circuit board. The low-noise amplifier has an amplifier input terminal connected to an end of the antenna lead member.

According to a twenty-first aspect of this invention, an antenna unit comprises a helical antenna comprising a hollow cylindrical member made of insulator and a plurality of antenna lead members made of conductor. The hollow cylindrical member has a center axis extending in a longitudinal direction, an outer peripheral surface, and an inner peripheral surface. The antenna lead members are wound around the outer peripheral surface of the hollow cylindrical member in a helix fashion. A main circuit board is mounted inside the hollow cylindrical member near one end of said hollow cylindrical member in the longitudinal direction. The main circuit board has a principal surface which extends in parallel with the longitudinal direction. A phase shifter is supported on the hollow cylindrical member. The phase shifter has a plurality of shifter input terminals connected to ends of the antenna lead members and a shifter output terminal. A low-noise amplifier is mounted on the principal surface of the main circuit board. The low-noise amplifier has an amplifier input terminal connected to the shifter output terminal.

According to a twenty-second aspect of this invention, an antenna unit comprises a helical antenna comprising a hollow cylindrical member made of insulator and a plurality of antenna lead members made of conductor. The hollow cylindrical member has a center axis extending in a longitudinal direction, an outer peripheral surface, and an inner peripheral surface. The antenna lead members are wound around the outer peripheral surface of the hollow cylindrical member in a helix fashion. A main circuit board is mounted inside the hollow cylindrical member near one end of the hollow cylindrical member in the longitudinal direction. The main circuit board has a principal surface which extends in parallel with the longitudinal direction. A phase shifter is mounted on the principal surface of the main circuit board. The phase shifter has a plurality of shifter input terminals connected to ends of the antenna lead members and a shifter output terminal. A low-noise amplifier is mounted on the principal surface of the main circuit board. The low-noise amplifier has an amplifier input terminal connected to the shifter output terminal.

According to a twenty-third aspect of this invention, an antenna unit comprises a helical antenna comprising a hollow cylindrical member made of insulator and a plurality of antenna lead members made of conductor. The hollow cylindrical member having a center axis extending in a longitudinal direction, an outer peripheral surface, and an inner peripheral surface. The antenna lead members are wound around the outer peripheral surface of the hollow cylindrical member in a helix fashion. A main circuit board is mounted inside the hollow cylindrical member near one end of said hollow cylindrical member in the longitudinal direction. The main circuit board has a main principal surface which extends in parallel with the longitudinal direction. A subsidiary circuit board is mounted within said hollow cylindrical member. The subsidiary circuit board has a subsidiary principal surface which extends in parallel with of the main principal surface of the main circuit board. A phase shifter is mounted on the subsidiary principal surface of the subsidiary circuit board. The phase shifter has a plurality of shifter input terminals connected to ends of the antenna lead members and a shifter output terminal. A low-noise amplifier is mounted on the main principal surface of the main circuit board. The low-noise amplifier has an amplifier input terminal connected to the shifter output terminal via a connection pin.

According to a twenty-fourth aspect of this invention, an antenna unit comprises a helical antenna comprising a hollow cylindrical member made of insulator and an antenna lead member made of conductor. The hollow cylindrical member has a center axis extending in a longitudinal direction, an outer peripheral surface, and an inner peripheral surface. The antenna lead member are wound around the outer peripheral surface of the cylindrical member in a helix fashion. A main circuit board is mounted inside the hollow cylindrical member near one end of the hollow cylindrical member in the longitudinal direction. The main circuit board has a principal surface which extends so as to intersect the longitudinal direction. A low-noise amplifier is mounted on the principal surface of the main circuit board. The low-noise amplifier has an amplifier input terminal connected to an end of said antenna lead member.

According to a twenty-fifth aspect of this invention, an antenna unit comprises a helical antenna comprising a hollow cylindrical member made of insulator and a plurality of antenna lead members made of conductor. The hollow cylindrical member has a center axis extending in a longitudinal direction, an outer peripheral surface, and an inner peripheral surface. The antenna lead members are wound around the outer peripheral surface of the cylindrical member in a helix fashion. A main circuit board is mounted inside the hollow cylindrical member near one end of the hollow cylindrical member in the longitudinal direction. The main circuit board has a principal surface which extends so as to intersect the longitudinal direction. A phase shifter is supported on the hollow cylindrical member. The phase shifter comprises a plurality of shifter input terminals connected to ends of the antenna lead members and a shifter output terminal. A low-noise amplifier is mounted on the principal surface of the main circuit board. The low-noise amplifier has an amplifier input terminal connected to the shifter output terminal.

According to a twenty-sixth aspect of this invention, an antenna unit comprises a helical antenna comprising a hollow cylindrical member made of insulator and a plurality of antenna lead members made of conductor. The hollow cylindrical member has a center axis extending in a longitudinal direction, an outer peripheral surface, and an inner peripheral surface. The antenna lead members are wound around the outer peripheral surface of the cylindrical member in a helix fashion. A main circuit board is mounted inside the hollow cylindrical member near one end of the hollow cylindrical member in the longitudinal direction. The main circuit board has a main principal surface which extends so as to intersect the longitudinal direction. A subsidiary circuit board is mounted within the hollow cylindrical member. The subsidiary circuit board has a subsidiary principal surface which extends in parallel with the main principal surface of the main circuit board. A phase shifter is mounted on the subsidiary principal surface of the subsidiary circuit board. The phase shifter has a plurality of shifter input terminals connected to ends of the antenna lead members and a shifter output terminal. A low-noise amplifier is mounted on the main principal surface of the main circuit board. The low-noise amplifier has an amplifier input terminal connected to the shifter output terminal via a connection pin.

According to a twenty-seventh aspect of this invention, an antenna unit comprises a helical antenna including a plurality of antenna lead members, a phase shifter having a plurality of shifter input terminals connected to ends of the antenna lead members of the helical antenna and a shifter output terminal, and a low-noise amplifier having an amplifier input terminal connected to the shifter output terminal. The antenna unit comprises a circuit board having a principal surface on which the phase shifter and the low-noise amplifier are mounted. The circuit board includes first and second conductive connection strips formed on the principal surface. The first and the second conductive connection strips have one ends connected to the shifter output terminal and the amplifier input terminal, respectively. The first and the second conductive connection strips have other ends which are opposed to each other with a predetermined space. A conducting member electrically connects between the other ends of the first and the second conductive connection strips.

According to a twenty-eighth aspect of this invention, a method is of manufacturing an antenna unit comprising a helical antenna including a plurality of antenna lead members, a phase shifter having a plurality of shifter input terminals connected to ends of the antenna lead members of the helical antenna and a shifter output terminal, and a low-noise amplifier having an amplifier input terminal connected to the shifter output terminal. The method comprises the steps of preparing a circuit board having a principal surface for mounting the phase shifter and the low-noise amplifier, of forming, on the principal surface of the circuit board, the phase shifter with the shifter output terminal and the low-noise amplifier with the amplifier input terminal, of forming, on the principal surface of the circuit board, first and second conductive connection strips having one ends connected to the shifter output terminal and the amplifier input terminal, respectively, the first and the second conductive connection strips having other ends which are opposed to each other with a predetermined space, and of electrically connecting between the other ends of the first and the second conductive connection strips using a conducting member.

According to a twenty-ninth aspect of this invention, an antenna unit comprises a cylindrical antenna having a center axis extending in a longitudinal direction. The cylindrical antenna having a tip portion and a rear portion. A bottom case supports the cylindrical antenna so as to raise the cylindrical antenna with the rear portion of the cylindrical antenna inserted within the bottom case. A ground plate is mounted on a base of the bottom case so as to intersect the longitudinal direction. The ground plate comprises a main plate part having a main area wider than a cross section of the cylindrical antenna and a subsidiary plate part projecting toward the cylindrical antenna at a peripheral edge of the main plate part.

According to a thirtieth aspect of this invention, a composite antenna comprises a cylindrical member made of insulator. The cylindrical member has a center axis extending in a longitudinal direction and an outer peripheral surface which is divided into first and second areas in the longitudinal direction. A first conductive pattern is wound around the first area in the outer peripheral surface of the cylindrical member. The first conductive pattern has at least one antenna lead member wound around the first area in the outer peripheral surface of the cylindrical member in a helix fashion. A second conductive pattern is wound around the second area in the outer peripheral surface of the cylindrical member.

According to a thirtieth-first aspect of this invention, a composite antenna comprises a circuit board having a principal surface. A first hollow cylindrical member stands on the principal surface of the circuit board. The first hollow cylindrical member is made of insulator. The first hollow cylindrical member has a first center axis extending in a longitudinal direction perpendicular to the principal surface of the circuit board. The first hollow cylindrical member has a first outer peripheral surface. A second hollow cylindrical member stands on the principal surface of the circuit board with apart from the first hollow cylindrical member with a space. The second hollow cylindrical member is made of insulator. The second hollow cylindrical member has a second center axis extending in the longitudinal direction. The second hollow cylindrical member has a second outer peripheral surface. An antenna pattern film comprises a flexible insulating film and a conductive pattern printed on the flexible insulating film. The flexible insulating film comprises a first film portion, a second film portion, and a connection film portion for connecting between the first and the second film portions. The first film portion is wound around the first outer peripheral surface of the first hollow cylindrical member. The second film portion is wound around the second outer peripheral surface of the second hollow cylindrical member. The conductive pattern comprises first and second conductive pattern portions which are printed on the first and the second film portions, respectively. The first conductive pattern portion has at least one antenna lead member wound around the first outer peripheral surface of the first hollow cylindrical member in a helix fashion.

According to a thirtieth-second aspect of this invention, a composite antenna comprises a circuit board having a principal surface. A hollow cylindrical member stands on the principal surface of the circuit board. The hollow cylindrical member is made of insulator. The hollow cylindrical member haa a center axis extending in a longitudinal direction perpendicular to the principal surface of the circuit board. The hollow cylindrical member has an outer peripheral surface. An antenna pattern film comprises a flexible insulating film and a conductive pattern printed on the flexible insulating film. The flexible insulating film comprises a first film portion, a second film portion, and a connection film portion for connecting between the first and the second film portions. The first film portion is wound around the outer peripheral surface of the hollow cylindrical member. The conductive pattern comprises first and second conductive pattern portions which are printed on the first and the second film portions, respectively. The first conductive pattern portion has at least one antenna lead member wound around the first outer peripheral surface of the first hollow cylindrical member in a helix fashion.

Figure 1A:
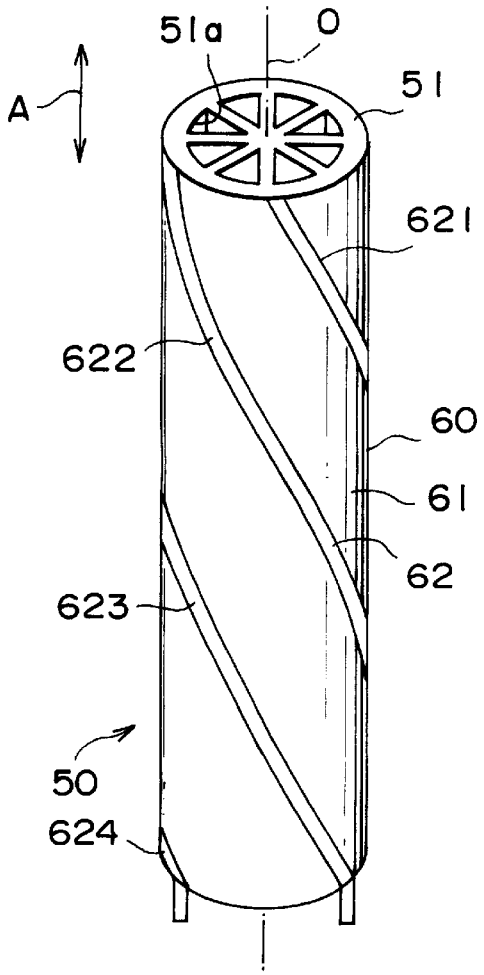
FIG. 1A is a perspective view showing a helical antenna according to a first embodiment of this invention.
Figure 1B:
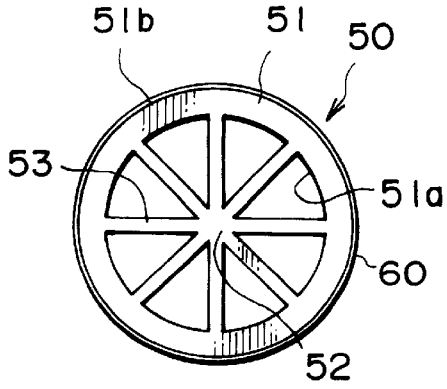
FIG. 1B is a plan view of the helical antenna illustrated in FIG. 1A.

DESCRIPTION OF THE PREFERRED EMBODIMENT:

Referring to FIGS. 1A and 1B, the description will proceed to a helical antenna 50 according to a first embodiment of this invention. FIG. 1A is a perspective view of the helical antenna 50. FIG. 1B is a plan view of the helical antenna 50.

The illustrated helical antenna 50 comprises a hollow cylindrical member 51 made of insulator. The hollow cylindrical member 51 may be called a bobbin or a cylindrical dielectric core. The hollow cylindrical member 51 has a center axis O extending in a longitudinal direction A.

Figure 2:
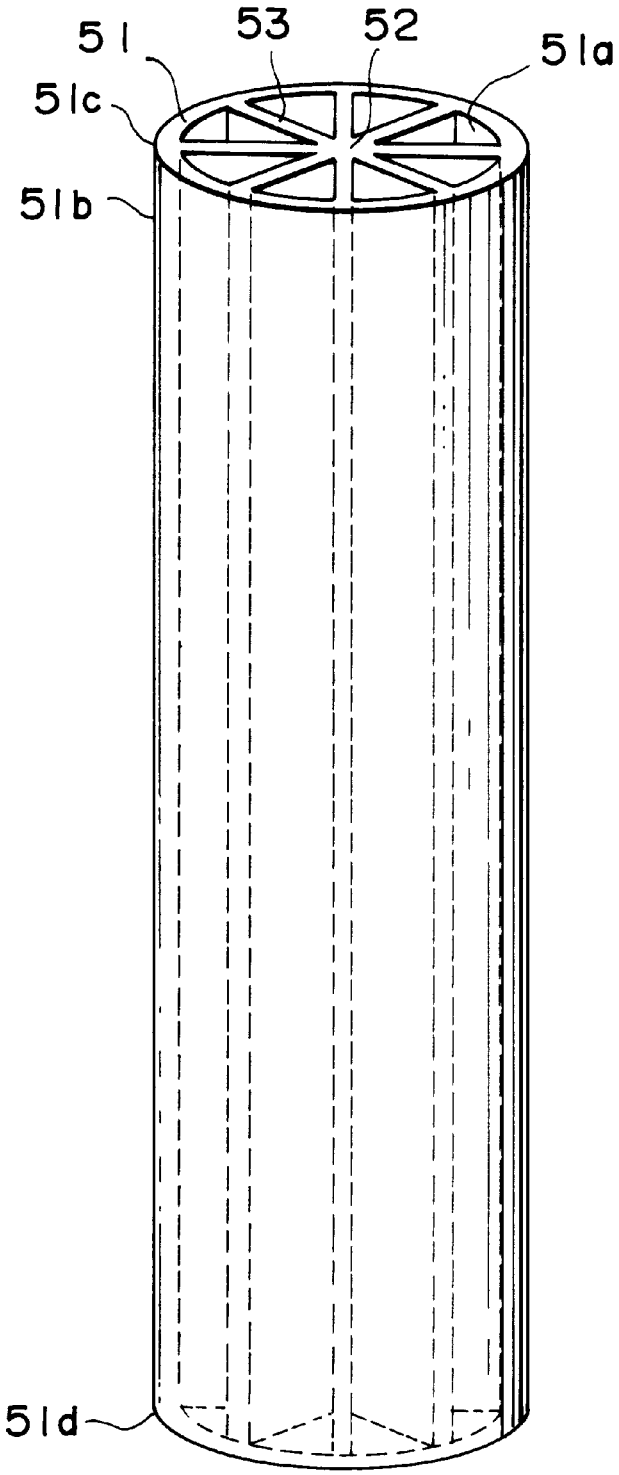
FIG. 2 is a perspective view showing a hollow cylindrical member for use in the helical antenna illustrated in FIGS. 1A and 1B.

As shown in FIG. 2, the hollow cylindrical member 51 has an inner peripheral surface or wall 51 a and an outer peripheral surface or wall 51*b*. The helical antenna 50 comprises a center rod 52 which is coaxial with the center axis O. The helical antenna 50 further comprises eight ribs 53 which are disposed between the center rod 52 and the inner peripheral surface 51*a* of the hollow cylindrical member 51. The eight ribs 53 symmetrically extend in a radial manner at equal angular intervals as shown in FIG. 1B.

The hollow cylindrical member 51, the center rod 52, the eight ribs 53 are integrally molded out of plastic.

As shown in FIG. 2, the hollow cylindrical member 51 has first and second ends 51*c* and 51*d* which are apart from each other in the longitudinal direction A. In the example being illustrated, the center rod 52 and the eight ribs 53 are formed between the first and the second ends 51*c* and 51*d* of the hollow cylindrical member 51 all over the hollow member so as to extend from the first end 51*c* to the second end 51*d*.

The helical antenna 50 further comprises an antenna pattern film 60 which is wound around the outer peripheral surface 51*b* of the hollow cylindrical member 51.

Figure 3:
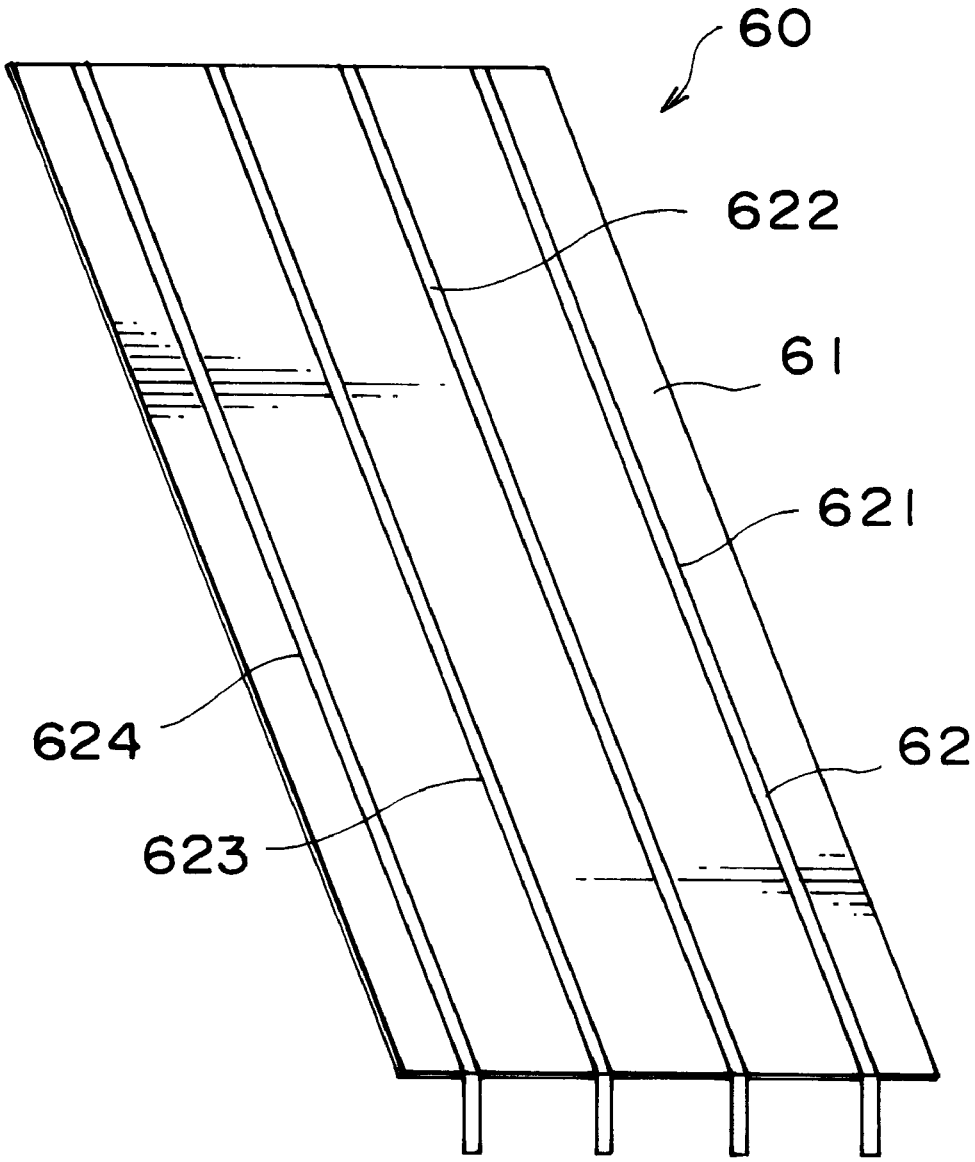
FIG. 3 is a plan view showing an antenna pattern film for use in the helical antenna illustrated in FIGS. 1A and 1B.

As shown in FIG. 3, the antenna pattern film 60 comprises a flexible insulator film 61 and a conductive pattern 62 formed or printed on the flexible insulator film 61. In the example being illustrated, the conductive pattern 62 has first through fourth antenna leads 621, 622, 623, and 624 which are around the outer peripheral surface 51*b* of the hollow cylindrical member 51 in a helix fashion. The antenna pattern film 60 has a configuration of a parallelogram of a rhomboid as shown in FIG. 3.

When maintaining of strength, a restriction of weight, a reduction of material cost, and facility of molding are taken into consideration, it is suitable that the hollow cylindrical member 51 has a thickness (a size between the inner peripheral surface 51*a* and the outer peripheral surface 51*b*) of 0.5 through 4 mm and an inner diameter of about 12 mm.

Inasmuch as the eight ribs 53 are symmetrically formed around the center rod 52 so as to extend in the radial manner at equal angular intervals, it is possible to improve strength of the hollow cylindrical member 51 and to easily carry out molding of an assembly of the hollow cylindrical member 51, the center rod 52, and the ribs 53.

Figure 4:
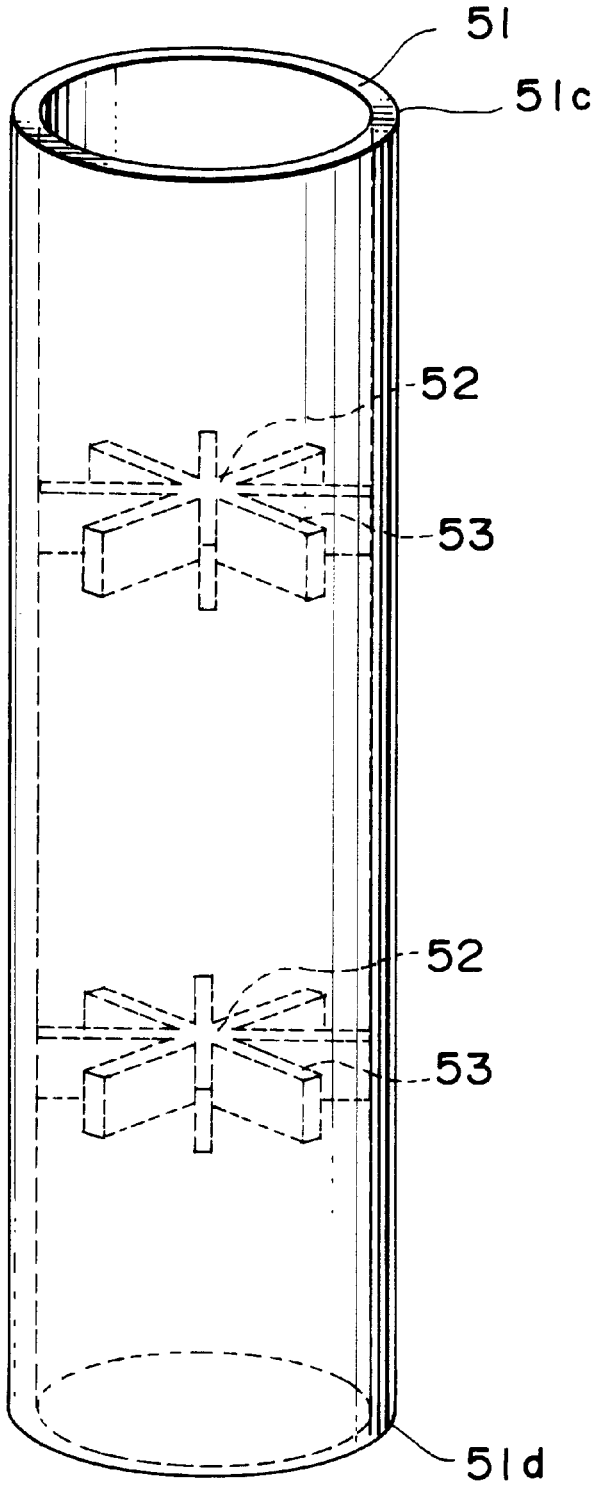
FIG. 4 is a perspective view showing another hollow cylindrical member for use in the helical antenna illustrated in FIGS. 1A and 1B.

Although the number of the ribs 53 is equal to eight in the above-mentioned embodiment, the number of the ribs may be suitably selected out of three or more in accordance with desired strength of the hollow cylindrical member 51. In addition, although the center rod 52 and the ribs 53 are firmed between the first and second ends 51*c* and 51*d* of the hollow cylindrical member 51 all over the hollow cylindrical member 51 so as to extend from the first end 51*c* to the second end 51*d*, the center rod 52 and the ribs 53 are partially formed between the first and the second ends 51*c* and 51*d* of the hollow cylindrical member 51 as shown in FIG. 4. Under the circumstances, the center rod 52 and the ribs 53 may be preferably formed in the neighborhood of at least one of the first and the second ends 51*c* and 51*d* of the hollow cylindrical member 51. In other words, the center rod 52 and the ribs 53 may be dividedly formed between the first and the second ends 51*c* and 51*d* of the hollow cylindrical member 51.

In the manner which is described above, such as a helical antenna has a resonance frequency which is determined due to a height (length), a diameter, a relative dielectric constant (relative permittivity), and so on of the cylindrical member.

Figure 5:
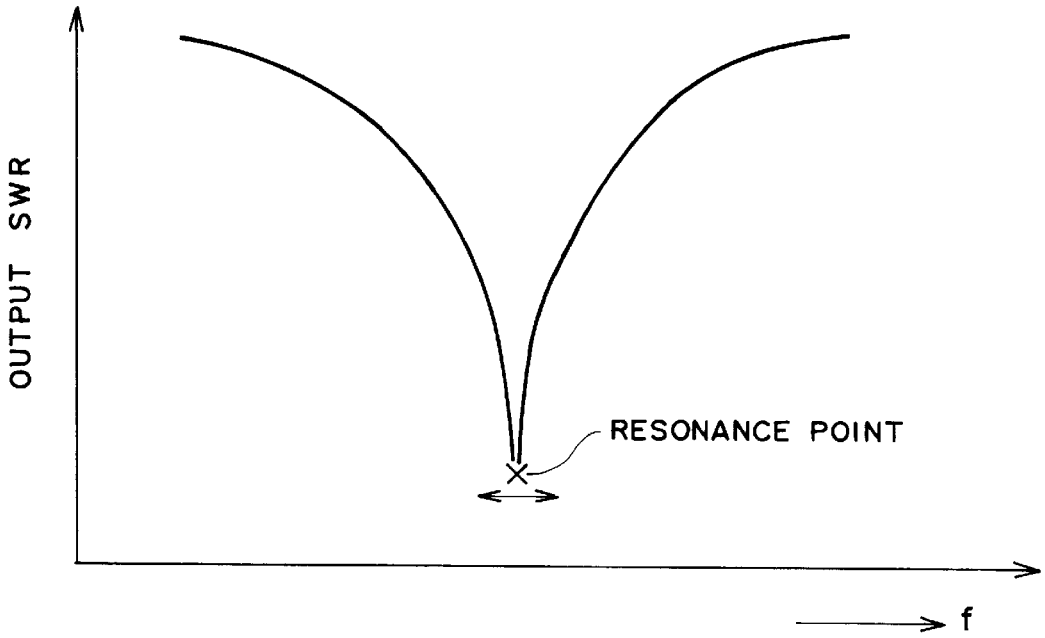
FIG. 5 is a view showing a frequency characteristic of a helical antenna.

FIG. 5 shows a frequency characteristic of the helical antenna. In FIG. 5, the abscissa and the ordinate represent a frequency f and an output standing wave ratio (SWR) or an output return loss, respectively. As apparent from FIG. 5, the helical antenna has a minimum value of the output SWR at a resonance point or a resonance frequency of the helical antenna. When a reception frequency slightly shifts from the resonance frequency of the helical antenna, the helical antenna has an extremely large output SWR. In other words, the resonance point of the helical antenna shifts in the manner as shown in an arrow of FIG. 5 caused by the above-mentioned variations of a size of the helical antenna. Accordingly, in order to receive a satellite wave (circular polarization) having a frequency of about 2.3 GHz using the helical antenna, it is necessary to make the resonance point (or the resonance frequency of the helical antenna) equal to a desired resonance frequency of 2.3 GHz. However, inasmuch as variations in size of the helical antenna are not avoided on a process of manufacturing the helical antenna, it is necessary to adjust the resonance frequency of the antenna to match the desired resonance frequency.

In prior art, a conventional adjustment method is a cutting method comprising the step of cutting a tip portion of the helical antenna to adjust the length of the antenna. More specifically, in a stage of manufacturing the helical antenna (a manufacturing process), the helical antenna is made so as to have a slightly longer length which enable to a frequency lower than the desired resonance frequency. Subsequently, in a state of adjustment (an adjusting process), the tip portion of the helical antenna is cut to adjust the length of the helical antenna so that the resonance point the helical antenna matches with the desired resonance frequency.

However, the above-mentioned conventional adjustment method or the cutting method is disadvantageous in that it takes a lot of time. That is, the cutting method cannot be restored to the former state once cutting is made. Accordingly, the adjustment of the length of the antenna must be carefully carried out and then it takes a lot of time, as mentioned in the preamble of the instant specification.

Figure 6:
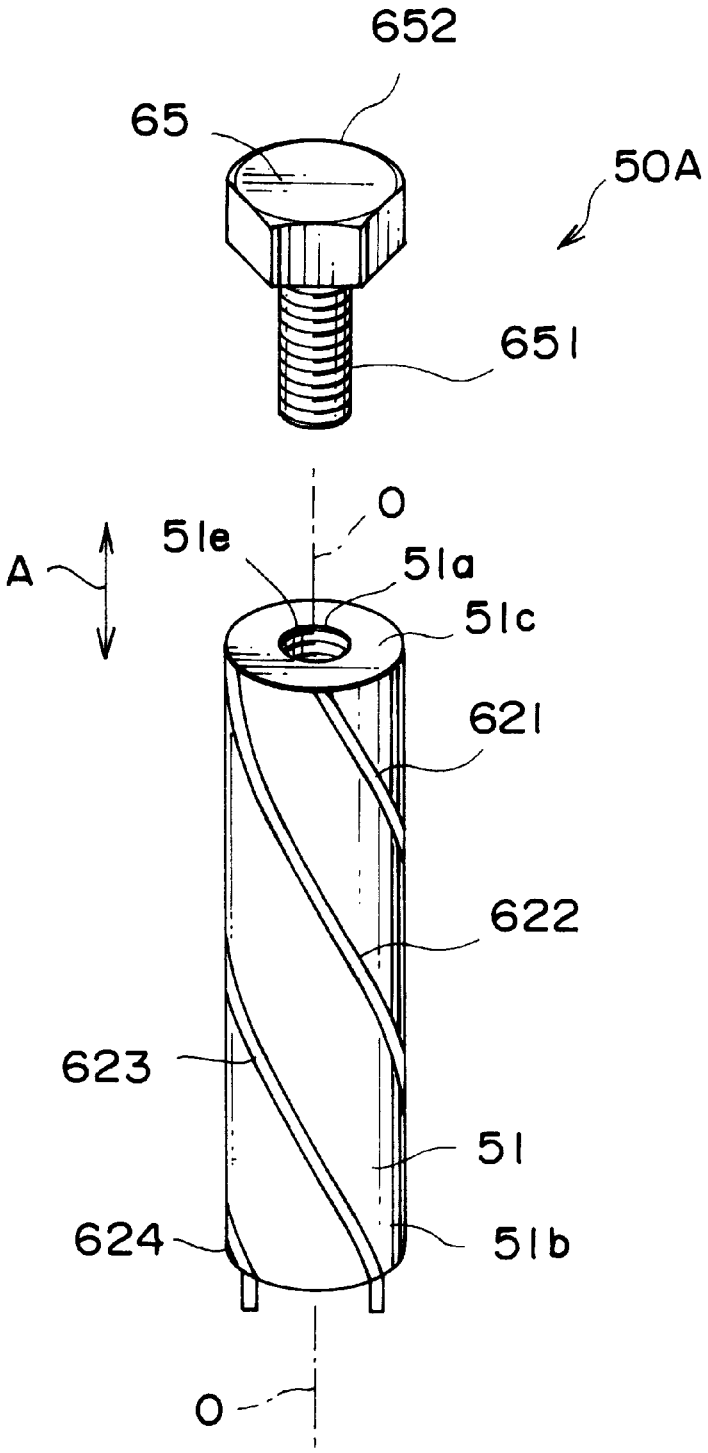
FIG. 6 is a perspective view showing a helical antenna according to a second embodiment of this invention.

Referring to FIG. 6, the description will proceed to a helical antenna 50A according to a second embodiment of this invention. The illustrated helical antenna 50A comprises the hollow cylindrical member 51 made of insulator. The hollow cylindrical member 51 has a relative dielectric constant or a relative permittivity $\in$ r of a range between two and four. The hollow cylindrical member 51 has the center axis O which extends in the longitudinal direction A, the inner peripheral wall 51*a*, and the outer peripheral wall 51*b*. The hollow cylindrical member 51 has the upper end portion 51*c*. The hollow cylindrical member 51 is made of material such as plastic.

The helical antenna 50A further comprises the first through the fourth leads 621 to 624 which are wound around the outer peripheral wall 51*b* of the hollow cylindrical member 51 in the helix fashion as shown in FIG. 6. In the example being illustrated in FIG. 6, inasmuch as the first through the fourth leads 621 to 624 are wound around the outer peripheral wall 51*b* of the hollow cylindrical member 51, the above-mentioned antenna pattern film 60 illustrated in FIG. 3 may be wound around the outer peripheral wall 51*b* of the hollow cylindrical member 51.

The hollow cylindrical member 51 has a female threaded screw hole 51*e* where the upper end portion 51*c* of the hollow cylindrical member 51 is threaded in the inner peripheral wall 51*a* of the hollow cylindrical member 51. The helical antenna 50A further comprises a male screw member 65 which is threaded in the female threaded screw hole 51*e* of the hollow cylindrical member 51. The male screw member 65 has a relative permittivity $\in$ r that is not less than that of the hollow cylindrical member 51. In the example being illustrated, the male screw member 65 consists of a ceramic bolt having the relative permittivity of a range between ten and one hundred. The ceramic bolt 65 comprises a threaded part 651 threaded in the female threaded screw hole 51*e* and a head part 652 at a tip thereof.

Figure 7:
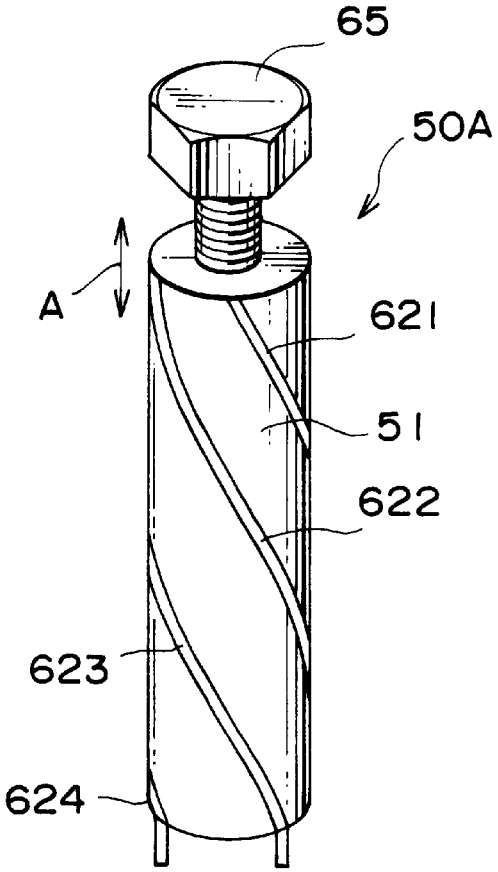
FIG. 7 is a perspective view for use in describing a method of adjusting a resonance frequency of the helical antenna illustrated in FIG. 6.

Turning to FIG. 7, description will be made as regards a method of the resonance frequency of the helical antenna 50A into the desired resonance frequency.

At first, the helical antenna 50A is prepared which comprises the hollow cylindrical member 51 having a length in which the helical antenna 50A enables to receive a frequency lower than the desired resonance frequency. That is, the hollow cylindrical member 51 has the length which is longer than that of a desired hollow cylindrical member. Subsequently, the male screw member (ceramic bolt) 65 is threaded in the female threaded screw hole 51*e* of the hollow cylindrical member 51 so as to adjust the resonance frequency of the helical antenna 50A into the desired resonance frequency. It is possible to easily adjust an insertion distance or amount of the ceramic bolt 65 for the female threaded screw hole 51*e* along the longitudinal direction A as shown in FIG. 7.

Inasmuch as the relative permittivity $\in$ r of the ceramic bolt 65 is higher than the relative permittivity $\in$ r of the hollow cylindrical member 51, it is possible to equivalently shorten the length of the hollow cylindrical member 51 due to a wavelength shortening effect when the ceramic bolt 65 is inserted in the female threaded screw hole 51*e* of the hollow cylindrical member 51. That is, it is possible to equivalently adjust the length of the hollow cylindrical member 51 in accordance with the insertion amount of the ceramic bolt 65 in the hollow cylindrical member 51. More specifically, when the above-mentioned insertion amount is much, the length of the hollow cylindrical member 51 is equivalently shorten. When the above-mentioned insertion amount is little, the length of the hollow cylindrical member 51 is equivalently lengthened. As a result, it is possible to easily adjust the resonance frequency of the helical antenna 50A into the desired resonance frequency.

Figure 8:
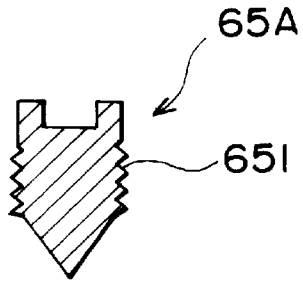
FIG. 8 is a cross sectional view of a male screw for use in lieu of a ceramic bolt illustrated in FIG. 6.
Figure 9:
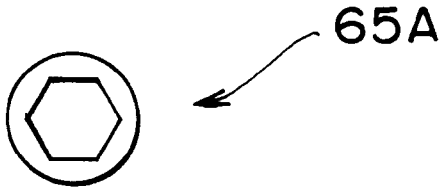
FIG. 9 is a plan view showing an example of a shape of a head part of the male screw illustrated in FIG. 8.
Figure 10:
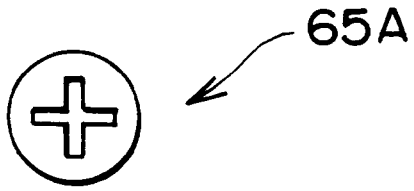
FIG. 10 is a plan view showing another example of a shape of a head part of the male screw illustrated in FIG. 8.

Although the ceramic bolt 65 is used as the male screw member in the second embodiment of this invention, a male screw 65A as illustrated in FIG. 8 may be used as the male screw member. In addition, a head part of the male screw 65A may have not only a hexagonal concavity as shown in FIG. 9 but also a cross-shape ditch as shown in FIG. 10. Furthermore, material of the male screw member is not restricted to ceramic and may ones having the relative permittivity $\in$ r which is substantially equal to that of the hollow cylindrical member 51 or more. In addition, the number of the leads wound around the outer peripheral surface 51*b* of the hollow cylindrical member 51 is not restricted to four and may be at least one.

Figure 11:
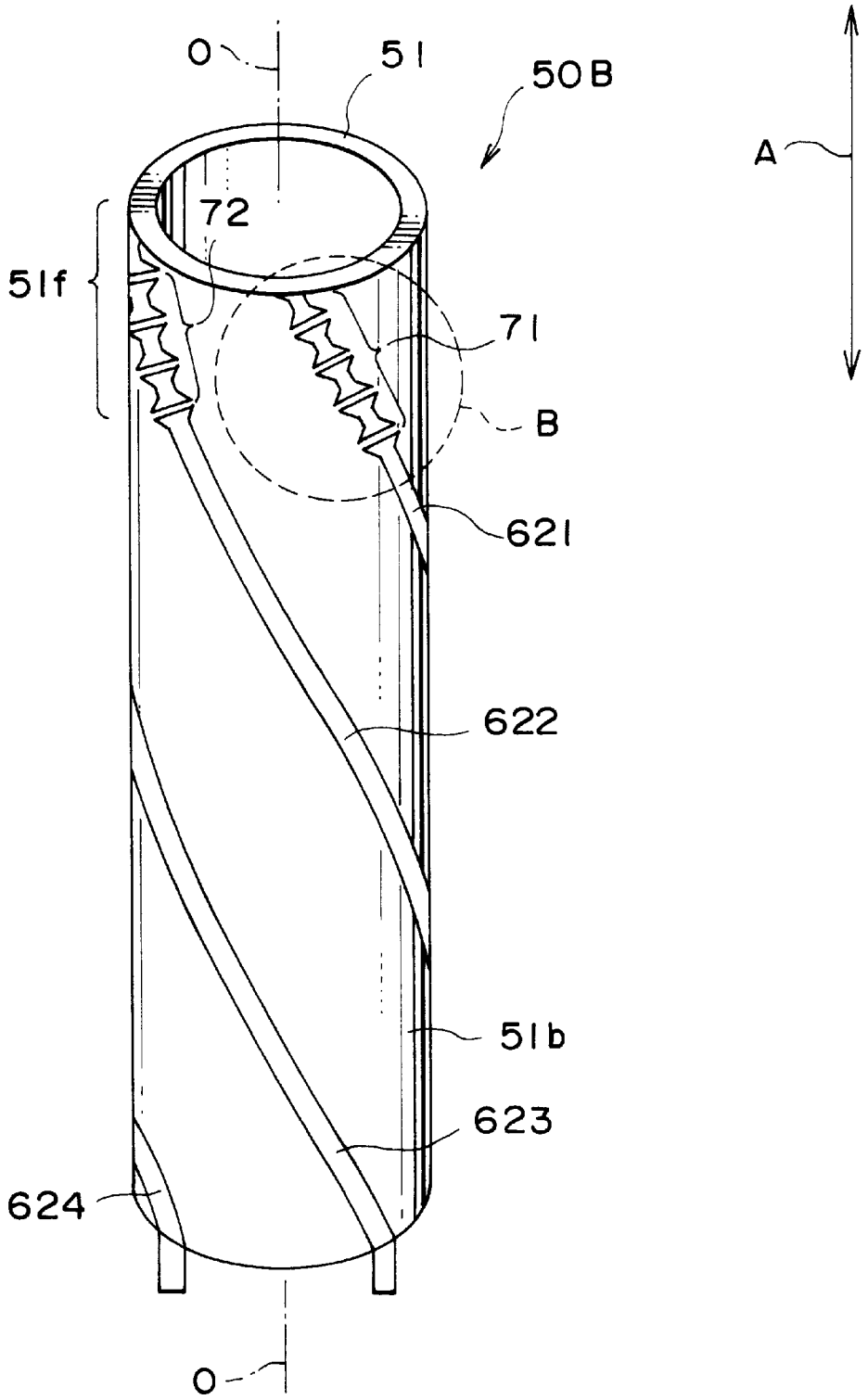
FIG. 11 is a perspective view showing a helical antenna according to a third embodiment of this invention.

Referring to FIG. 11, the description will proceed to a helical antenna 50B according a third embodiment of this invention. The illustrated antenna 50B comprises a hollow cylindrical dielectric core 51 made of insulator (dielectric). The hollow cylindrical dielectric core 51 has the center axis O extending in the longitudinal direction A and the outer peripheral surface 51*b*. In the example being illustrated, the hollow cylindrical dielectric core 51 is made of substantially plastic having a hollow cylindrical shape.

The helical antenna 50B further comprises the first through the fourth antenna lead members 621, 622, 623, and 624 each of which is made of conductor. The first through the fourth antenna lead members 621 to 624 are wound around the outer peripheral surface 51*b* of the hollow cylindrical dielectric core 51 except for a tip portion 50*f* of the hollow cylindrical dielectric core 51. The first through the fourth antenna lead members 621 to 623 substantially have the same size, the same shape, and the same lead length. In other words, the first through the fourth antenna lead members 621 to 624 are designed so as to have similar electric characteristic one another. However, the first through the fourth lead members 621 to 624 may have variations on manufacturing in the manner which is described above.

Figure 12:
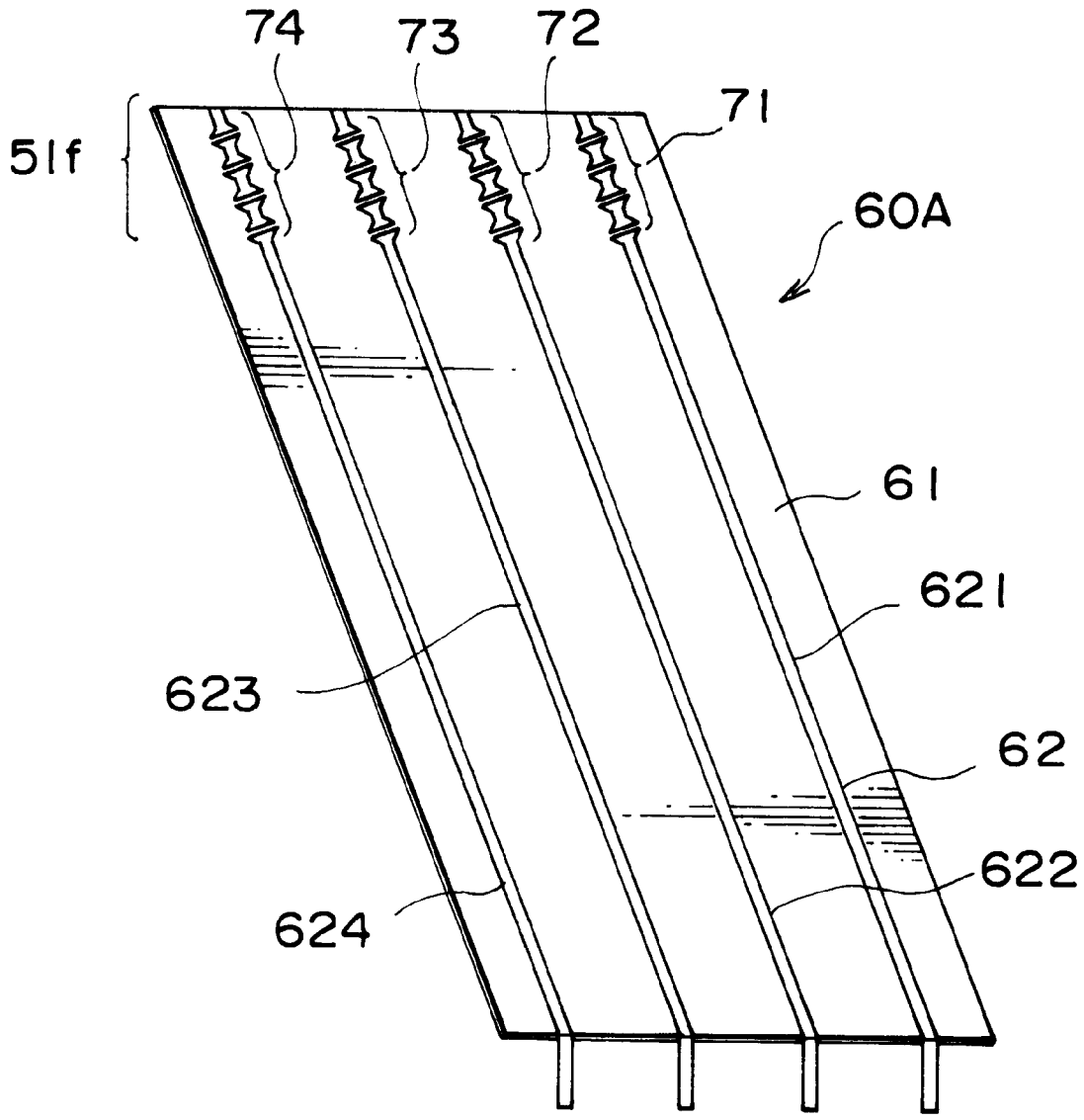
FIG. 12 is a plan view showing an antenna pattern film for use in the helical antenna illustrated in FIG. 11.

The helical antenna 50B further comprises first through fourth resonance frequency adjustment portions 71, 72, 73, and 74 each of which is made of additional conductor as illustrated in FIG. 12. The first through the fourth resonance frequency adjustment portions 71 to 74 are formed on the outer peripheral surface 51*b* of the hollow cylindrical dielectric core 51 at the tip portion 51*f* of the hollow cylindrical dielectric core 51 adjacent to the first through the fourth antenna lead members 621 to 624, respectively. The first through the fourth resonance frequency adjustment portions 71 to 74 substantially have similar sizes and similar shapes one another. That is, although the first through the fourth resonance frequency adjustment portions 71 to 74 also may have variations on manufacturing, the first through the fourth resonance frequency adjustment portions 71 to 74 are basically designed so as to have similar electric characteristics one another.

The first through the fourth antenna lead members 621 to 624 are arranged on the outer peripheral surface 51*b* of the hollow cylindrical dielectric core 51*a* at equal angular intervals while the first through the fourth resonance frequency adjustment portions 71 to 74 are also arranged on the outer peripheral surface 51*b* of the hollow cylindrical dielectric core 51 at equal angular intervals. Accordingly, if the hollow cylindrical dielectric core 51 is cut in a plane perpendicular to the longitudinal direction A, the first through the fourth antenna lead members 621 to 624 (or the first through the fourth resonance frequency adjustment portions 71 to 74 depending on a sectional plane) appear at equal angular intervals of 90 degrees. In order to simplifying the description, the description will be made about a combination of the first antenna lead member 621 and the first resonance frequency adjustment portion 71 with reference to FIG. 13.

Figure 13:
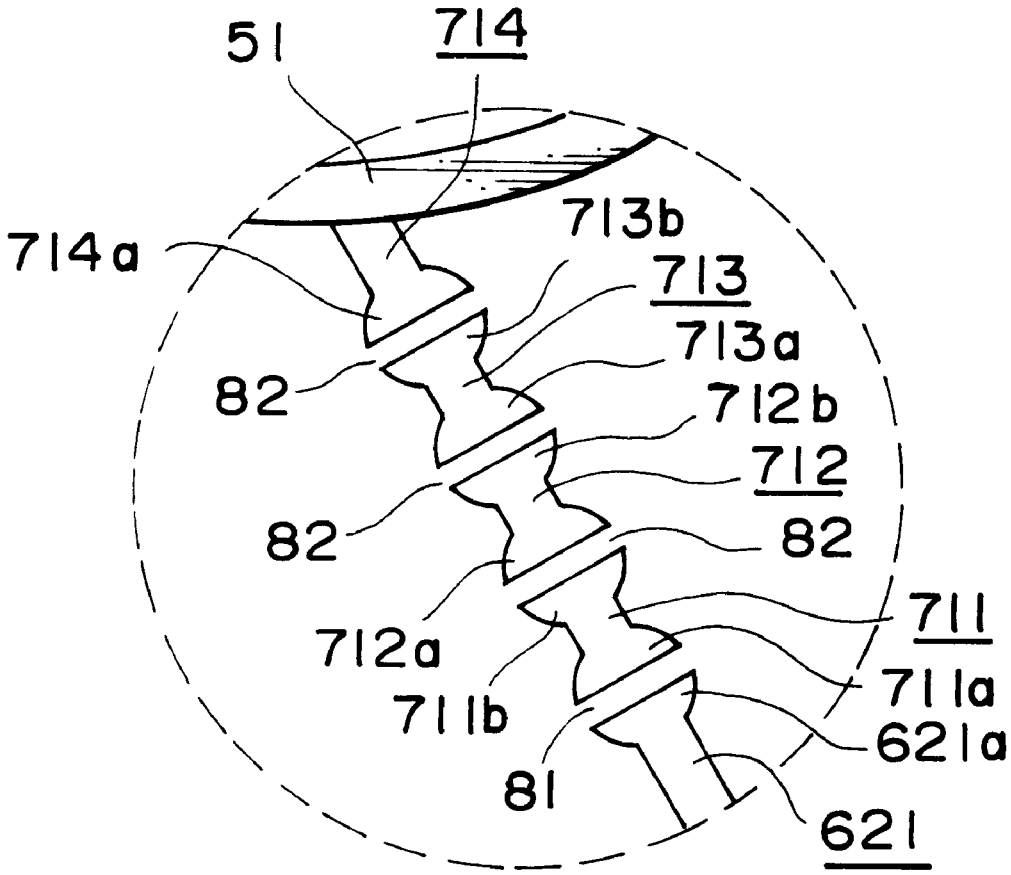
FIG. 13 is an enlarged view of a part of the helical antenna illustrated in FIG. 11.

As shown in FIG. 13, the first resonance frequency adjustment portion 71 comprises the additional conductor which is apart from a tip 621*a* of the first antenna lead member 621 with a primary gap 81. The first resonance frequency adjustment portion 71 consists of a train of conductor segments 711, 712, 713, and 714 with subsidiary gaps 82 between adjacent conductor segments. In the example being illustrated, the subsidiary gaps 82 are equal in number to three.

As apparent from FIG. 13, the train of conductor segments 711 to 714 is formed at a position where the first antenna lead member 621 extends in its longitudinal direction.

In the example being illustrated, the subsidiary gaps 82 appear at equal intervals. In other words, the conductor segments 711, 712, and 713 constituting the first resonance frequency adjustment portion 71 substantially have similar shapes one another as shown in FIG. 13.

In the example being illustrated, the conductor constituting each of the first through the fourth antenna lead members 621 to 624 and the additional conductor constituting the first through the fourth resonance frequency adjustment portions 71 to 74 is made of similar material. The first through the fourth antenna lead members 621 to 624 and the first through the fourth resonance frequency adjustment portions 71 to 74 are pattern printed on the outer peripheral surface 51*b* of the hollow cylindrical dielectric core 51.

Alternatively, as shown in FIG. 12, the helical antenna 50B may comprise an antenna pattern film 60A wound around the outer peripheral surface 51*b* of the hollow cylindrical dielectric core 51. The antenna pattern film 60A comprises the flexible insulator film 61 and a conductive pattern formed or printed on the flexible insulator film 61. The conductive pattern has the first through the fourth antenna lead members 621 to 624 and the first through the fourth resonance frequency adjustment portions 71 to 74.

In the helical antenna 50B comprising the above-mentioned structure, it is possible to lengthen a length of an antenna lead by electrically connecting the first antenna lead member 621 with the first resonance frequency adjustment portion 71 at the primary gap 81 and by electrically connecting between the adjacent conductor segments at the subsidiary gaps 82 in the order of being apart from the tip 621*a* of the first antenna lead member 621 by means of any conductor. In the example being illustrated, inasmuch as there are one primary gap 81 and three subsidiary gaps 82, it is possible to adjust the length of the antenna lead at four steps by using shorting means at the gaps 81, 82 by the conductor.

In the example being illustrated, solder is used as simplified shorting means. In order to facilitate to short at the gaps 81, 82 by means of the solder, a device or an idea in configuration is made at the tip 621*a* of the first antenna lead member 621 and at opposite ends of the conductor segments 711 to 714 opposed via the gaps 81, 82. More specifically, opposite ends (621*a*, 711*a*) of the first antenna lead member 621 and of the first resonance frequency adjustment portion 71 via the primary gap 81 have enlarged portions each of which is wider than other portions of the first antenna lead member 621 and of the first resonance frequency adjustment portion 71. In addition, opposite ends (711*b*, 712*a*), (712*b*, 713*a*), and (713*b*, 714*a*) of the conductor segments 711 to 714 via the subsidiary gaps 82 have enlarged portions each of which is wider than other portions of the conductor segments 711 to 714. Each pair (621*a*, 711*a*), (711*b*, 712*a*), (712*b*, 713*a*), and (713*b*, 714*a*) of adjacent opposite ends via the gap 81 or 82 forms a land suitable to mount the solder thereon. In the example being illustrated, each land with the gap substantially has configuration of a circle.

Although the solder is used as the shorting means for shorting at the primary gap 81 and at the subsidiary gaps 82 in the third embodiment of this invention, conductive patch may be used as the shorting means. In addition, the enlarged portions in each of the first through the fourth antenna lead members 621 to 624 and of the first through the fourth resonance frequency adjustment portions 71 to 74 may have different configurations other than those illustrated in FIG. 13.

In addition, the dielectric core 51 may have a solid cylindrical configuration in lieu of the hollow cylindrical configuration.

Figure 14A:
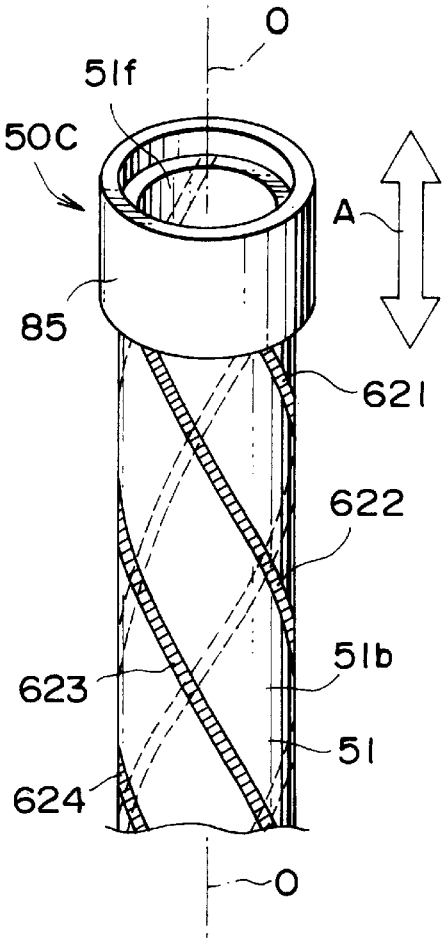
FIGS. 14A and 14B collectively show a part of a helical antenna according to a fourth embodiment of this invention.
Figure 14B:
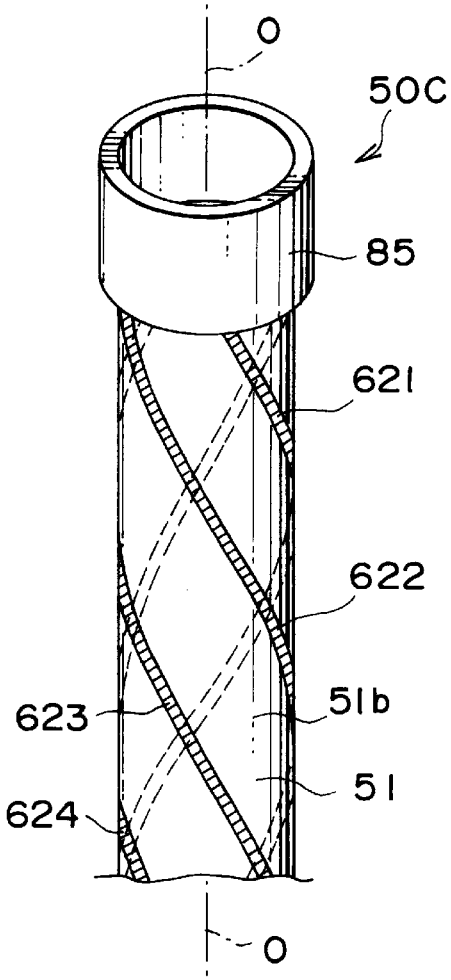

Referring to FIGS. 14A and 14B, the description will proceed to a helical antenna 50C according to a fourth embodiment of this invention. The illustrated helical antenna 50C comprises a hollow cylindrical dielectric core 51 made of insulator. The hollow cylindrical dielectric core 51 has a center axis O extending in a longitudinal direction A and a core outer peripheral surface 51*b*. The helical antenna 50C further comprises first through fourth lead members 621, 622, 623, and 624 each of which is made of conductor. The first through the fourth lead members 621 to 624 are wound around the core outer peripheral surface 51*b* of the hollow cylindrical dielectric core 51 in a helix fashion.

Although the first through the fourth lead members 621 to 624 are directly formed on the core outer peripheral surface 51*b* of the hollow cylindrical dielectric core 51 in the example being illustrated, the antenna pattern film 60 as illustrated in FIG. 3 may be wound around the core outer peripheral surface 51*b* of the hollow cylindrical dielectric core 51. As shown in FIG. 3, the antenna pattern film 60 comprises the flexible insulator film 61 and the conductive pattern 62 formed or printed on the flexible insulator film 61. The conductive pattern 62 has the first through the fourth lead members 621 to 624.

In addition, the helical antenna 50C further comprises a hollow dielectric member 85 which covers an tip end portion 51*f* of the hollow cylindrical dielectric core 51 with the first through the fourth lead members 621 to 624 sandwiched between the hollow dielectric member 85 and the hollow cylindrical dielectric core 51. The hollow dielectric member 85 is movable along the longitudinal direction A. In the example being illustrated, the hollow dielectric member 85 is a ceramic ring.

As apparent from FIGS. 14A and 14B, the ceramic ring 85 is movably mounted on the core outer peripheral surface 51*b* of the hollow cylindrical dielectric core 51*a* long the longitudinal direction A. More specifically, the ceramic ring 85 is mounted on the core outer peripheral surface 51*b* of the hollow cylindrical dielectric core 51 by means of press fitting so that frictional force occurs between the hollow cylindrical dielectric core 51 and the ceramic ring 85 in a level where the ceramic ring 85 does not move so long as any force does not act.

In order to adjust a resonance frequency of the helical antenna 50C, a position of the ceramic ring 85 is moved or shifted along the longitudinal direction A. More specifically, in order to heighten the resonance frequency of the helical antenna 50C, the position of the ceramic ring 85 is lowered as illustrated in FIG. 14A so as to increase a penetrating amount where the hollow cylindrical dielectric core 51 and the first through the fourth lead members 621 to 624 are penetrated into the ceramic ring 85. On the other hand, in order to lower the resonance frequency of the helical antenna 50C, the position of the ceramic ring 85 is lifted up as illustrated in FIG. 14B so as to decrease the above-mentioned penetrating amount. In other words, a range or a length where the first through the fourth lead members 621 to 624 are covered with the ceramic ring 85 is enlarged or lengthened to heighten the resonance frequency of the helical antenna 50C. The range or the length where the first through the fourth lead members 621 to 624 are covered with the ceramic ring 85 to lower the resonance frequency of the helical antenna 50C. In addition, this uses a wavelength shortening effect by means of the ceramic ring 85.

Adjustment of the resonance frequency of the helical antenna 50C is carried out as follows. The position of the ceramic ring 85 moves up and down along the longitudinal direction A to adjust the resonance frequency of the helical antenna 50C with the resonance frequency of the helical antenna 50C measured. When the resonance frequency of the helical antenna 50C matches with a desired resonance frequency, the ceramic ring 85 and the hollow cylindrical dielectric core 51 are fixed with each other by, for example, adhering by means of adhesive agent or heat sealing so that the ceramic ring 85 cannot move more.

Figure 15A:
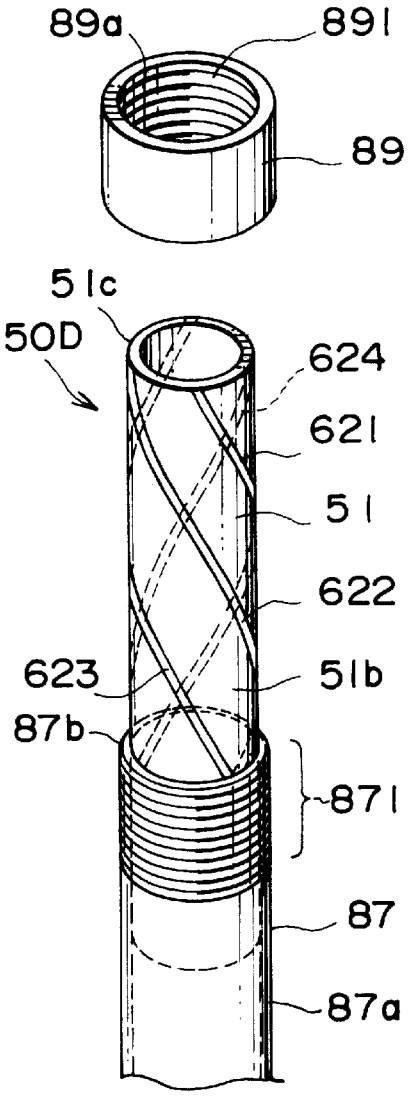
FIGS. 15A and 15B collectively show a part of a helical antenna according to a fifth embodiment of this invention.
Figure 15B:
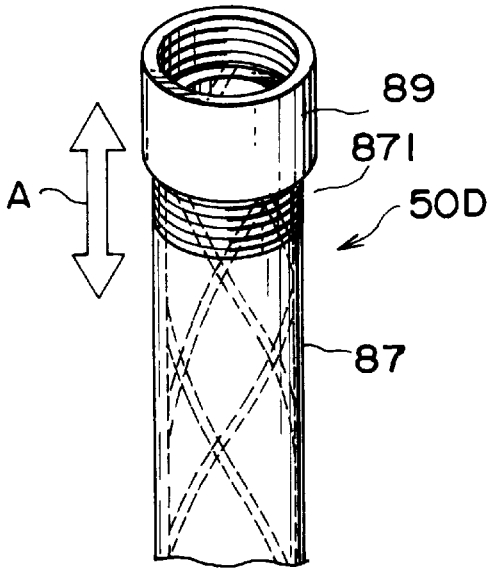

Referring to FIGS. 15A and 15B, the description will proceed to a helical antenna 50D according to a fifth embodiment of this invention. The illustrated helical antenna 50D comprises the hollow cylindrical dielectric core 51 and the first through the fourth lead members 621 to 624 in the similar manner in structure to the helical antenna 50C illustrated in FIGS. 14A and 14B. A combination of the hollow cylindrical dielectric core 51 and the first through the fourth lead members 621 to 624 is called an antenna assembly.

The helical antenna 50D further comprises a hollow cylindrical outer cover 87 and a hollow dielectric member 89. The hollow cylindrical outer cover 87 covers the antenna assembly. The hollow cylindrical outer cover 87 has a cover outer peripheral wall 87*a* on which a cover male threaded portion 871 is threaded at a tip end portion of the cover outer peripheral wall 87*a*. The hollow dielectric member 89 has a member inner wall 87*a* on which a member female threaded portion 891 is threaded. The hollow dielectric member 89 is threaded on the hollow cylindrical outer cover 87 so as to engage the member female threaded portion 891 with the cover male threaded portion 871.

The antenna assembly has a configuration so that an top end 51*c* of the antenna assembly matches with a tip 87*b* of the hollow cylindrical outer cover 87 when the antenna assembly is received in the hollow cylindrical outer cover 87. Accordingly, as shown in FIG. 15B, when the hollow dielectric member 89 is fitted or mounted on the tip end 87*b* of the hollow cylindrical outer cover 87 in a state where the antenna assembly is received in the hollow cylindrical outer cover, the hollow dielectric member 89 covers ends of the first through the fourth lead members 621 to 624.

In the helical antenna 50D, it is possible to adjust a resonance frequency of the helical antenna 50D by threading or screwing the hollow dielectric member 89 around the hollow cylindrical outer cover so as to move the hollow dielectric member 89 up and down in the longitudinal direction A. Inasmuch as a penetrating or covering amount of the hollow dielectric member 89 is adjusted by rotating the hollow dielectric member 89, it is possible to easily and correctly match the resonance frequency of the helical antenna 50D with the desired resonance frequency in comparison with the helical antenna 50C illustrated in FIGS. 14A and 14B. Although the hollow dielectric member 89 and the hollow cylindrical outer cover 89 is not fixed with each other by means of adhesive agent or the like, the resonance frequency of the helical antenna 50D hardly changes by moving of the hollow dielectric member 89 up and down.

Although the description has been made as regards a case of a four-phase feeding helical antenna in the fourth and the fifth embodiments, the number of the antenna lead member may be equal to one or more. In addition, although the description has been made as regard a case of using the ceramic ring as the hollow dielectric member in the fourth and the fifth embodiments, other dielectric members except for the ceramic ring may be used. Furthermore, the dielectric core may have a configuration of a solid cylinder in place of the hollow cylinder.

Figure 16A:
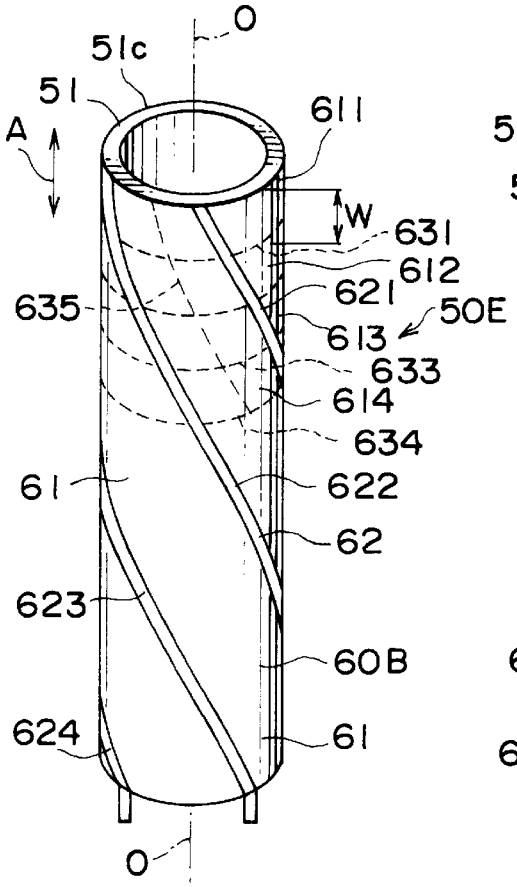
FIGS. 16A and 16B collectively show a helical antenna according to a sixth embodiment of this invention.
Figure 16B:
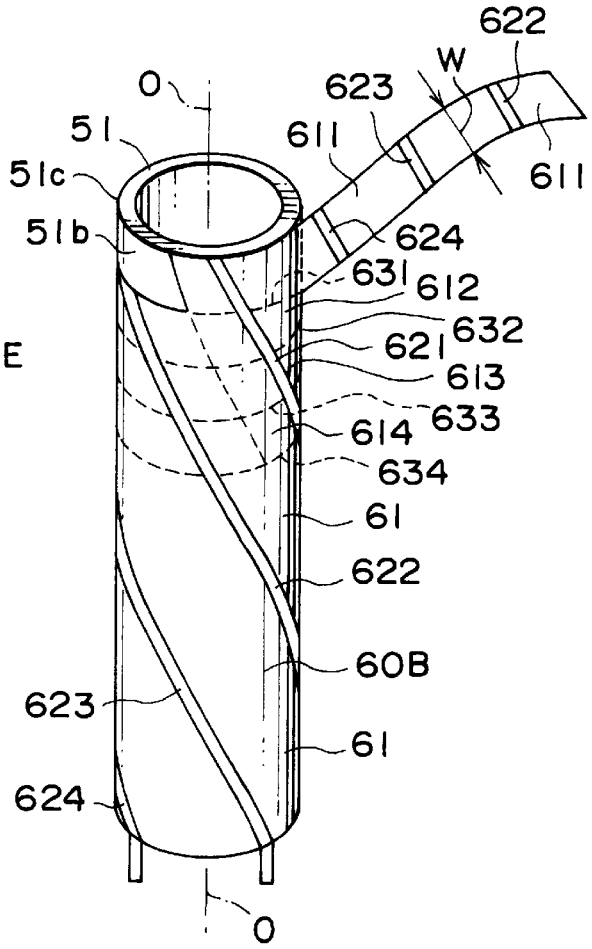

Referring to FIGS. 16A and 16B, the description will proceed to a helical antenna 50E according to a sixth embodiment of this invention. The illustrated helical antenna 50F comprises a hollow cylindrical dielectric core 51 made of insulator and an antenna pattern film 60B.

The hollow cylindrical dielectric core 51 has a center axis O extending in a longitudinal direction A and a core outer peripheral surface 51*b*. The antenna pattern film 60B is wound around the core outer peripheral surface 51*b* of the hollow cylindrical dielectric core 51. The antenna pattern film 60B is adhered on the core outer peripheral surface 51*b* of the hollow cylindrical dielectric core 51 by means of known adhesive agent at adhesive strength which is detachably pasted in manually.

Figure 17:
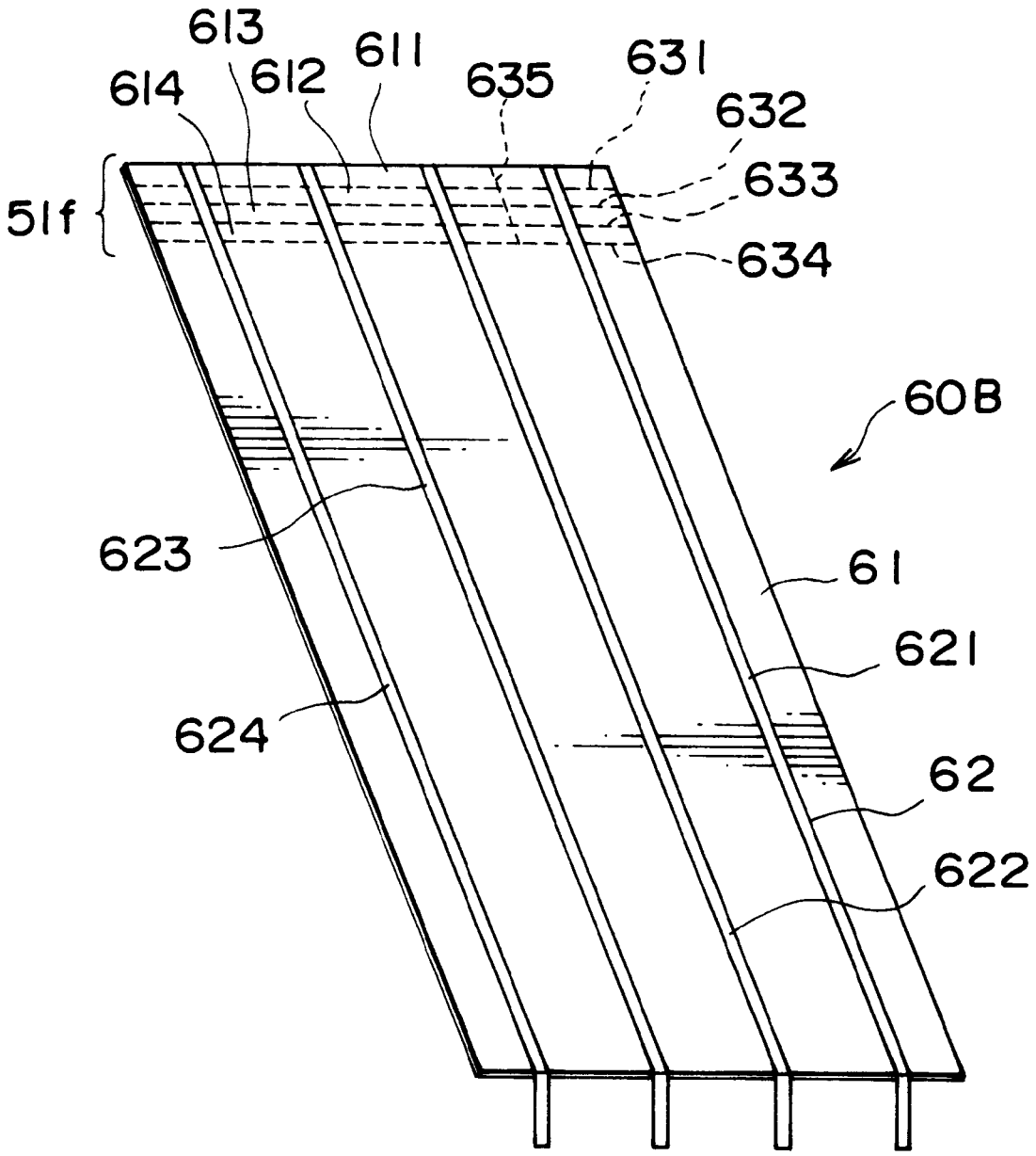
FIG. 17 is a plan view showing an antenna pattern film for use in the helical antenna illustrated in FIGS. 16A and 16B.

Referring to FIG. 17 in addition to FIGS. 16A and 16B, the antenna pattern film 60B comprises a flexible insulator film or sheet 61 and a conductive pattern 62 printed or formed on the flexible insulator film 61. The conductive pattern 61 comprises first through fourth antenna lead members 621, 622, 623, and 624 so as to wind the first through the fourth antenna lead members 621 to 624 around the core outer peripheral surface 51*b* of the hollow cylindrical dielectric core 51 in a helix fashion. Each of the first through the fourth antenna lead members 621 to 624 is made of ink of copper or silver. That is, each of the first through the fourth antenna lead members 621 to 624 is made of conductor.

In the manner which is described above, the flexible insulator film 61 is detachably pasted on the core outer peripheral surface 51*b* of the hollow cylindrical dielectric core 51. In the example being illustrated, the flexible insulator film 61 has first through fourth circumferential perforated circular lines 631, 632, 633, and 634 extending along a circumferential direction at a tip portion 51*f* of the hollow cylindrical dielectric core 51 except for the conductive pattern 62 at equal intervals in the longitudinal direction A so as to form first through fourth belts 611, 612, 613, and 614 between adjacent circumferential perforated circular lines. For description reasons, a belt width W of each of the first through the fourth belts 611 to 614 is illustrated in FIGS. 16A and 16B in an enlarged state than an actual state.

The flexible insulator film 61 further has an additional perforated line 635 extending along a direction parallel to each of the first through the fourth antenna lead members 621 to 624 so as to intersect the first through the fourth circumferential perforated circular lines 631 to 634. The additional perforated line 635 is for defining a stripping start end or a stripping stop end of the first through the fourth belts 611 to 614 which are stripped in the manner which will later be described. In order to easily strip the stripping start end, only an area along the additional perforated line 635 preferably may have weaker adhesive strength to the core outer peripheral surface 51*b* of the hollow cylindrical dielectric core 51 in comparison with that of other area of the flexible insulator film 61 or preferably may not be applied with the adhesive agent.

Referring to FIGS. 16A and 16B, the description will proceed to a method of adjusting a resonance frequency of the helical antenna 50E. At first, the helical antenna 50E is prepared which comprises the hollow cylindrical dielectric core 51 having a length so as to enable to receive a wave of a frequency lower than the desired resonance frequency. Subsequently, the first through the fourth belts 611 to 614 of the flexible insulator film 61 are stripped in the order of being apart from a tip end 51*c* of the hollow cylindrical dielectric core 51 decrease a length of the conductive pattern 62. As a result, it is possible to make the resonance frequency of the helical antenna 50E substantially match with the desired resonance frequency.

Although the antenna pattern 62 has the first through the fourth antenna lead members 621 to 624 in the sixth embodiment, the antenna pattern may have at least one antenna lead member. In addition, the dielectric core may have a configuration of a solid cylinder instead of the hollow cylinder.

Figure 18:
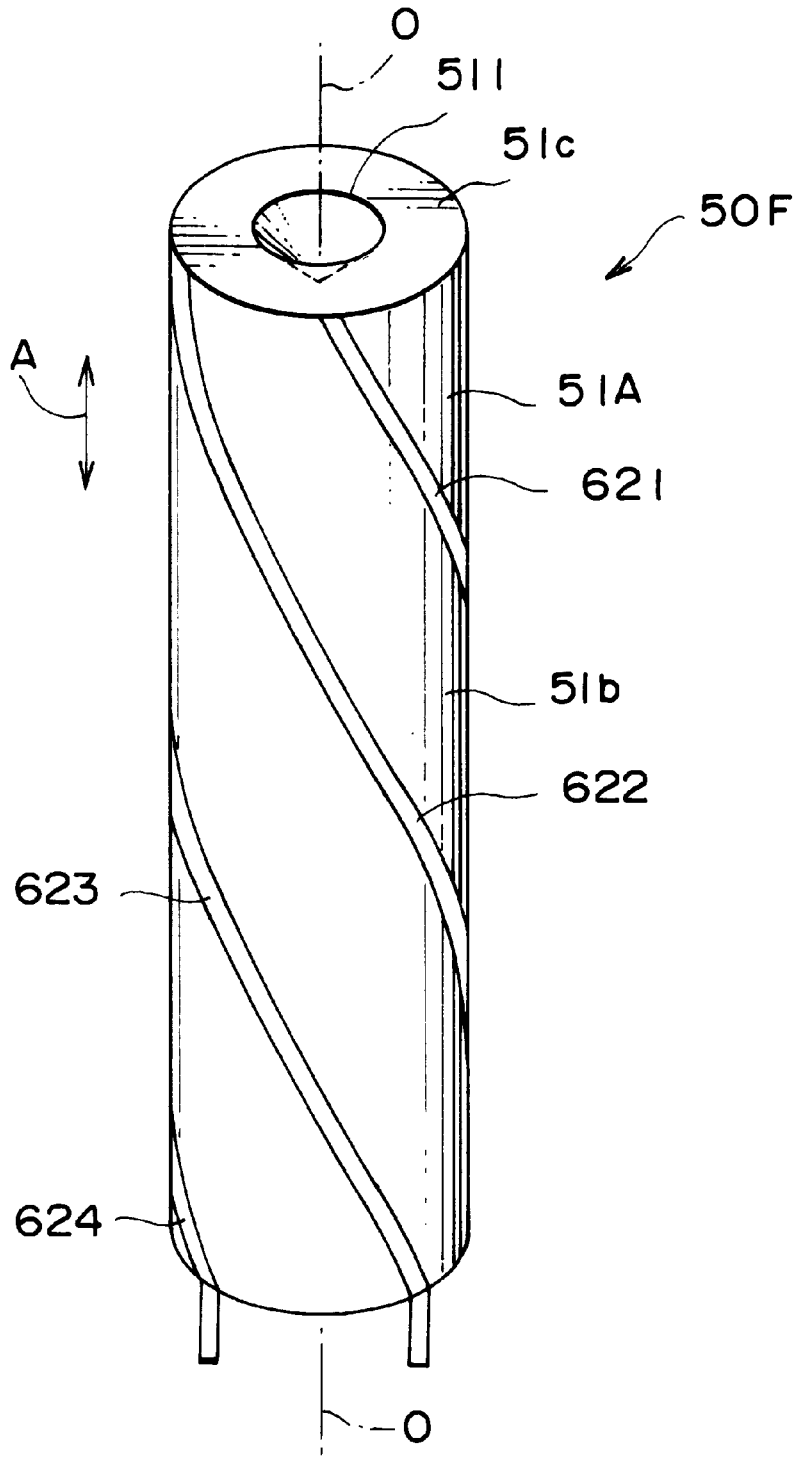
FIG. 18 is a perspective view showing a helical antenna according to a seventh embodiment of this invention.

Referring to FIG. 18, the description will proceed to a helical antenna 50F according to a seventh embodiment of this invention. The illustrated helical antenna 50F comprises a solid cylindrical dielectric core 51A made of insulator. The solid cylindrical dielectric core 51A has a center axis O extending in a longitudinal direction A and a core outer peripheral surface 51*b*. The solid cylindrical dielectric core 51A has a dielectric constant or a relative permittivity $\in$ r which is different from that of air having a relative permittivity $\in$ r of one. In the example being illustrated, the relative permittivity $\in$ r of the solid cylindrical dielectric core 51A is a range between two or four.

Alternatively, the relative permittivity $\in$ r of the solid cylindrical dielectric core 51A may be a range between ten and one hundred. To put it in the concrete, the solid cylindrical dielectric core 51 A is made of material such as plastic or ceramic. Preferably, the material of the solid cylindrical dielectric core 51A may be selected from those having characteristics (hardness, molten temperature, or the like) in accordance with types of digging means which will later be described.

In addition, the relative permittivity $\in$ r of the solid cylindrical dielectric core 51A may desirably be selected so as to have a range between ten and one hundred in a case of largely changing an effective length of the solid cylindrical dielectric core 51A by a little digging on a digging process which will be later described. On the other hand, the relative permittivity $\in$ r of the solid cylindrical dielectric core 51A may desirably be selected so as to have a range between two and four in a case of precisely changing the effective length of the solid cylindrical dielectric core 51A by digging on the digging process.

The solid cylindrical dielectric core 51A has a tip end 51*c* which is exposed so as to enable to dig up the solid cylindrical dielectric core 51A along the longitudinal direction A. In the example being illustrated, the solid cylindrical dielectric core 51A has a spot facing 511 in a center at the tip end 51*c* thereof that acts as positioning for digging up the solid cylindrical dielectric core 51A along the longitudinal direction A. When a digging tool such as a drill, a milling cutter, or the like is used as the digging means in the manner which will be described, the spot facing 511 serves as a guide concave portion for centering by physically applying a tip of the digging tool to it. On the other hand, when a beam machine such as a laser beam machine or the like is used as the digging means in the manner which will be described, the spot facing 511 is operable as a visual or image processing guiding portion for carrying out sighting work to make a beam center of the beam machine coincide with a center of the spot facing 511.

The helical antenna 50F further comprises first through fourth antenna lead members 621, 622, 623, and 624 which are wound around the core outer peripheral surface 51*b* of the solid cylindrical dielectric core 51A in a helix fashion. The number of antenna lead members is not restricted to four. Each of the first through the fourth antenna lead members 621 to 624 has the same extending length. Alternatively, the helical antenna 50F may comprises the antenna pattern film 60 as illustrated in FIG. 3.

Figure 19:
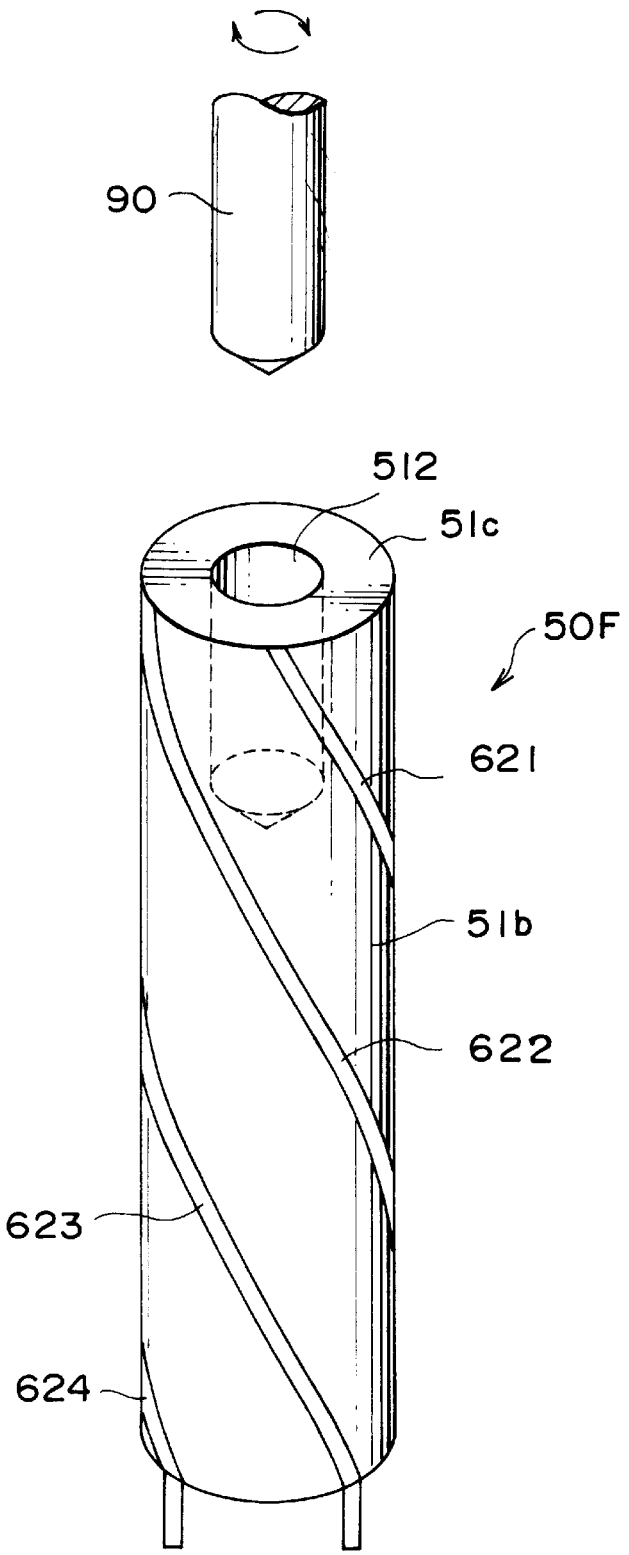
FIG. 19 is a perspective view for use in describing a method of adjusting a resonance frequency of the helical antenna illustrated in FIG. 18.

Referring to FIGS. 18 and 19, the description will proceed to a method of adjusting a resonance frequency of the helical antenna 50F. At first, the method comprises the steps of preparing the helical antenna 50F illustrated in FIG. 18 that has a resonance frequency which is higher than the desired resonance frequency, and of digging up a center portion the solid cylindrical dielectric core 51 A at the tip end 51*c* to increase the effective length of the solid cylindrical dielectric core 51A as shown in FIG. 19 so as to match the resonance frequency of the helical antenna 50F with the desired resonance frequency.

More specifically, the helical antenna 50F illustrated in FIG. 18 is prepared. The helical antenna 50F comprises the solid cylindrical dielectric core 51A made of dielectric having a dielectric constant higher than that of air. The helical antenna 50F further comprises the first through the fourth antenna lead members 621 to 624 wound around the core outer peripheral surface 51*b* of the solid cylindrical dielectric core 54A in the helix fashion. The solid cylindrical dielectric core 51A has the tip end 51*c* which is exposed so as to enable to dig up the solid cylindrical dielectric core 51A along the longitudinal direction A and which has the spot facing 511 in the center thereat. The helical antenna 50F has the resonance frequency which is higher than the desired resonance frequency.

Thereafter, while a result of the resonance frequency measured by a measuring unit (not shown) connected to the first through the fourth antenna lead members 621 to 624 is monitored, the drill (or the milling cutter) 90 is centered in the center portion of the tip end 51*c* of the solid cylindrical dielectric core 51A by using the spot facing 511 as shown in FIG. 19, and then the solid cylindrical dielectric core 51A is dug up by the drill 90 to increase the volume of a hollow portion 512. As a result, the resonance frequency of the helical antenna 50F is adjusted so as to match with the desired resonance frequency by decreasing an inner amount of the solid cylindrical dielectric core 51A. Under the circumstances, dug scraps may preferably be removed from the helical antenna 50F certainly by sucking the dug scraps or the like in order to correctly measure a monitored result in the measuring unit.

In addition, as the digging means, the beam machine such as the laser beam machine or the like may be used as substitute for the digging tool such as the drill 90 or the like. In this event, the sighting work to make the beam center of the beam machine coincide with the center of the spot facing 511 is carried out by the visual or image processing. In addition, "digging" using the beam machine may include an action for decreasing the volume caused by head melting and/or evaporating action.

The hollow portion 512 has a depth which is increased by the digging work. The hollow portion 512 has a diameter which depends on a diameter of the digging tool or the beam. It preferably may device a countermove so that the diameter of the hollow portion 512 is not extended on digging caused by friction of the dug scraps or heat conduction. For this purpose, the solid cylindrical dielectric core 51A may have double structure or may comprise a solid cylindrical central part enable to dig and a hollow cylindrical peripheral part over the solid cylindrical central part. The hollow cylindrical peripheral part is a part to be certainly left without digging. The hollow cylindrical peripheral part has an outer peripheral surface around which the first through the fourth antenna lead members 621 to 624 are wound in the helix fashion. The hollow cylindrical peripheral part has higher hardness than that of the solid cylindrical central part or has higher melting temperature than that of the solid cylindrical central part. With this structure, it is possible to prevent the hollow portion 512 from unnecessarily extending on digging.

Referring to FIGS. 20A, 20B, 20C, and 20D, the description will proceed to a helical antenna 50G according to an eighth embodiment of this invention.

Figures 20A, 20B, 20C, 20D:
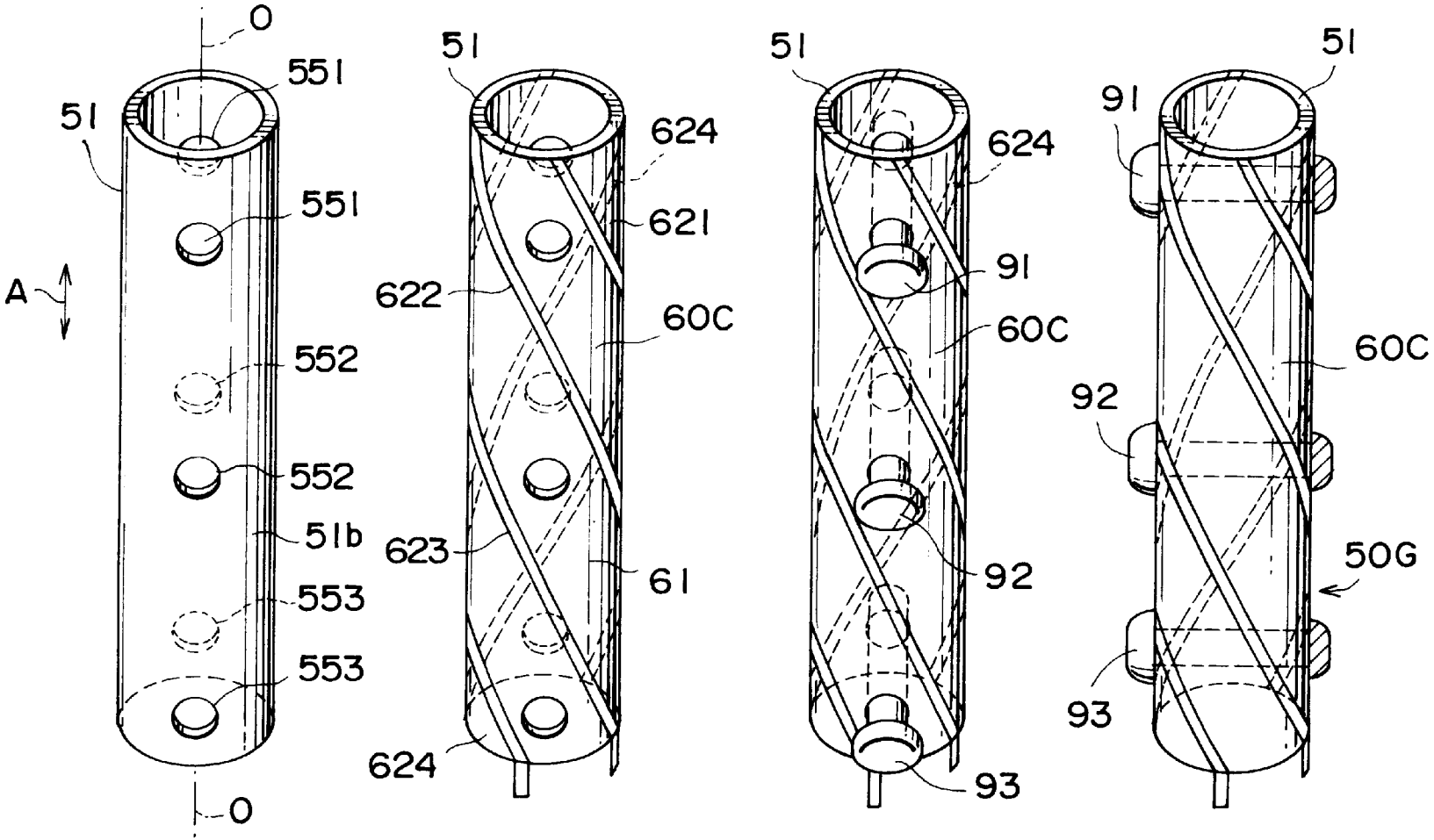
FIGS. 20A, 20B, 20C, and 20D collectively show a process for manufacturing a helical antenna according to an eighth embodiment of this invention.

As shown in FIG. 20A, the helical antenna 50G comprises a hollow cylindrical dielectric core (which will be called "bobbin") 51 made of insulator. The bobbin 51 has a center axis O extending in a longitudinal direction A and a core outer peripheral surface 51*b*. The bobbin 51 has first through third through holes 551, 552, and 553 for penetrating the core outer peripheral surface 51*b* in a radial direction at predetermined spaced along the longitudinal direction A.

As shown in FIG. 20B, the helical antenna 50G further comprises an antenna pattern film 60C which is wound around the core outer peripheral surface 51*b* of bobbin 51.

Figure 21:
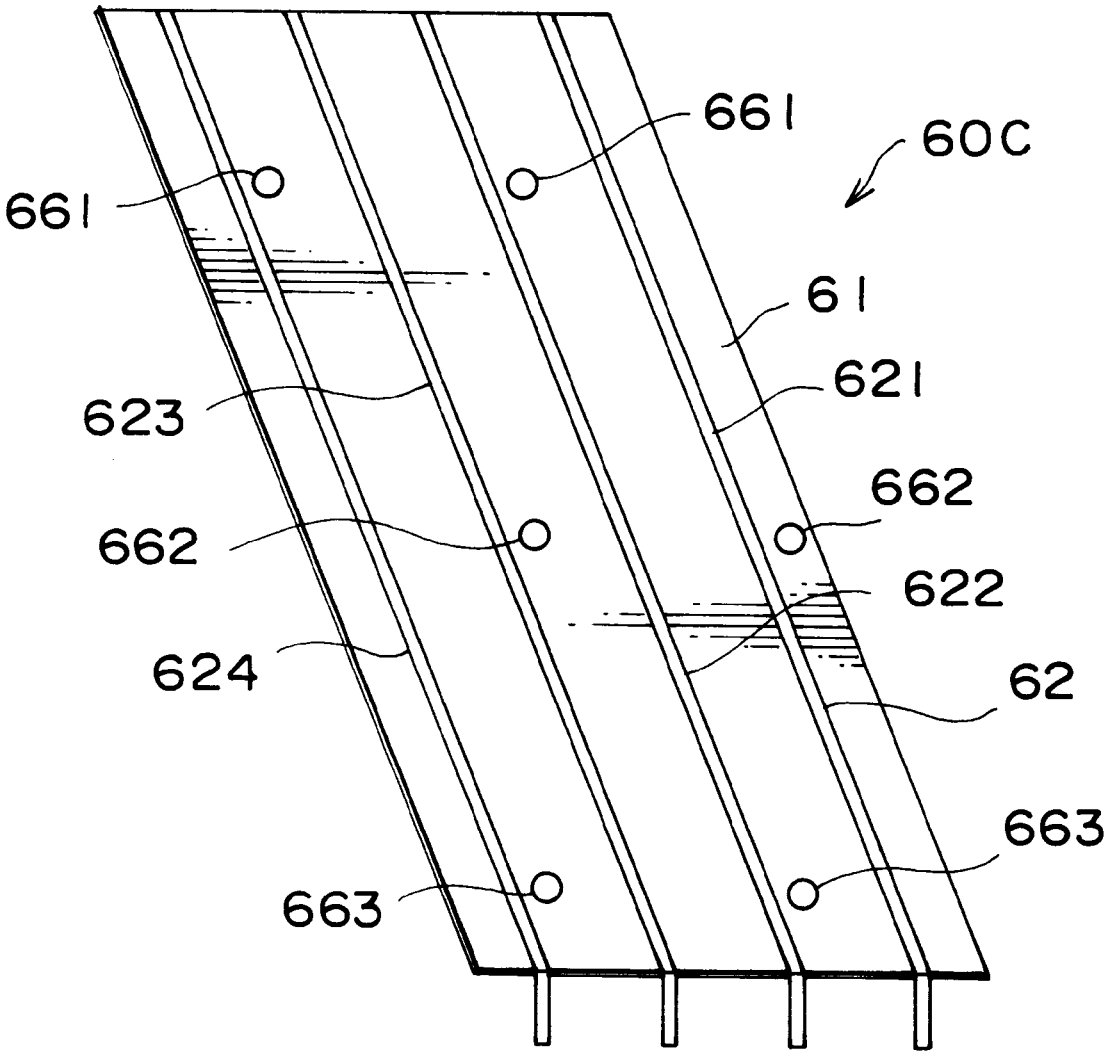
FIG. 21 is a plan view showing an antenna pattern film for use in the helical antenna illustrated in FIGS. 20A through 20D.

Referring to FIG. 21 in addition to FIG. 20B, the antenna pattern film 60C comprises a flexible insulator film or sheet 61 and a conductive pattern 62 formed on the flexible insulator film 61. The conductive pattern 62 has first through fourth antenna lead members 621, 622, 623, and 624 which are wound around the core outer peripheral surface 51*b* of the bobbin 51 in a helix fashion. The antenna pattern film 60C has first through third pairs of openings 661, 662, and 663 at positions corresponding to the first through the third through holes 551 to 553, respectively. When the antenna pattern film 60C is wound around the core outer peripheral surface 51*b* of the bobbin 51, the antenna pattern film 60C is wound around the core outer peripheral surface 51*b* of the bobbin 51 so as to match the first through the third through holes 551 to 553 with the first through the third pairs of openings 661 to 663, respectively. Accordingly, the first through the fourth antenna lead members 621 to 624 are formed on the core outer peripheral surface 51*b* of the bobbin 51 in the helix fashion. Inasmuch as the antenna pattern film 60C is wound around the core outer peripheral surface 51*b* of the bobbin 51 so as to match the first through the third through holes 551 to 553 with the first through the third pairs of openings 661 to 663, respectively, in the manner which is described above, it is possible to correctly wind the antenna pattern film 60C around the core outer peripheral surface 51*b* of the bobbin 51.

Turning to FIG. 20C, after the antenna pattern film 60C is wound around the core outer peripheral surface 51*b* of the bobbin 51 in the manner which is described above, first through third plastic rivet pins 91, 92, and 93 are passed the bobbin 51 through the first through the third through holes 551 to 553, respectively. More specifically, the first through the third rivet pins 91 to 93 comprise first through third head portions 91*a*, 92*a*, and 93*a* and first through third body portions 91*b*, 92*b*, and 93*b*, respectively. Each of the first through the third head portions 91*a* to 93*a* has a head diameter larger than a diameter of each though hole while each of the first through the body portions 91*b* to 93*b* has a body diameter which is slightly smaller than the diameter of each through hole. The first through the third body portions 91*b* to 93*b* of the first through the third plastic rivet pins 91 to 93 are inserted in the first through the third through holes 551 to 553, respectively, until the first through the third body portions 91*a* to 93*a* of the first through the third plastic rivet pins 91 to 93 touch to the core outer peripheral surface 51*b* of the bobbin 51 via the antenna pattern film 60C. When the first through the third body portions 91*b* to 93*b* are inserted in the first through the third through holes 551 to 553, respectively, in the manner which is described above, tip portions of the first through the third body portions 91*b* to 93*b* project from the first through the third through holes 551 to 553 at opposite side.

Turning to FIG. 20D, after the first through the third plastic rivet pins 91 to 93 are passed the bobbin 51 through the first through the third through holes 551 to 553, respectively, in the manner which is described above, the tip portions of the first through the third plastic rivet pins 91 to 93 (or the tip portions of the first through the third body portions 91*b* to 93*b*) are molten by heat. Accordingly, the tip portions of the first through the third body portions 91*b* to 93*b* have a diameter larger than the diameter of the first through the third through holes 551 to 553 and then the antenna pattern film 60C is tightly fixed on the core outer peripheral surface 51*b* of the bobbin 51.

Inasmuch as the antenna pattern film 60C is fixed on the core outer peripheral surface 51*b* of the bobbin 51 by means of the first through the third plastic rivet pins 91 to 93 in the manner which is described above, it is possible to stably fix the antenna pattern film 60C on the core outer peripheral surface 51*b* of the bobbin 51 and to provide the helical antenna 50G having sufficient vibration proof and sufficient shock resistance.

Although the bobbin 51 has three through holes in the eighth embodiment, the bobbin 51 may have at least two through holes. In addition, although the bobbin 51 has a configuration of hollow cylinder, the bobbin 51 may have a configuration of solid cylinder. Furthermore, although the antenna pattern film 60C has four antenna lead members, the antenna pattern 60C may have at least one antenna lead member.

Figure 22A:
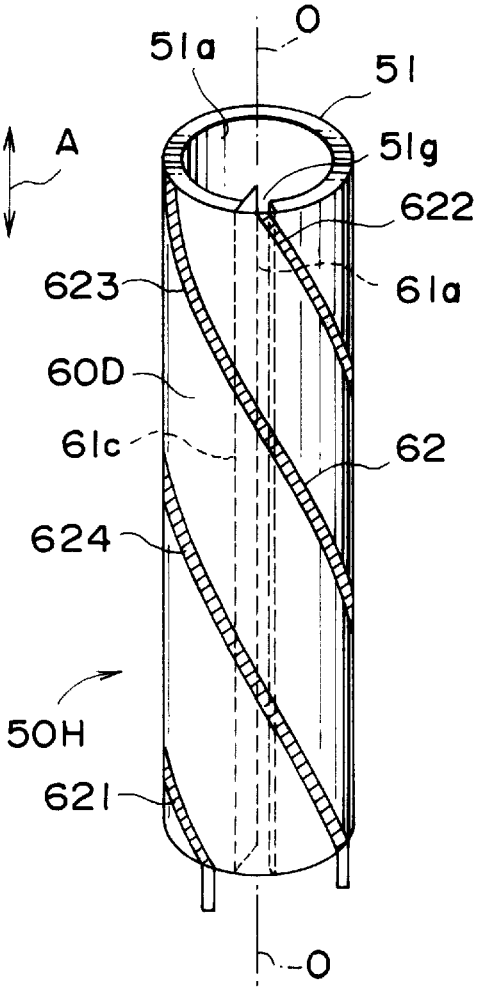
FIG. 22A is a perspective view showing a helical antenna according to a ninth embodiment of this invention.
Figure 22B:
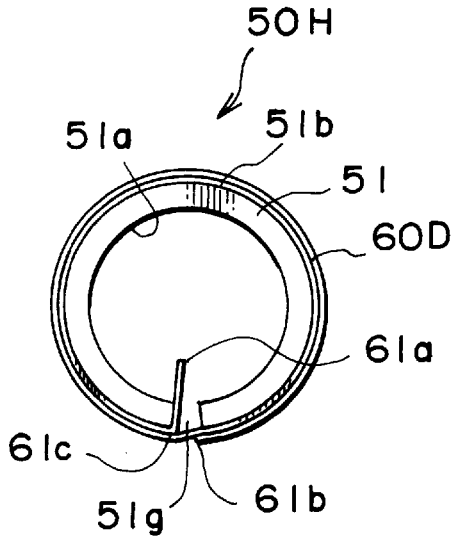
FIG. 22B is a plan view of the helical antenna illustrated in FIG. 22A.

Referring to FIGS. 22A and 22B, the description will proceed to a helical antenna 50H according to a ninth embodiment of this invention. The illustrated helical antenna 50H comprises a hollow cylindrical dielectric core 51 made of insulator. The hollow cylindrical dielectric core 51 has a center axis O extending a longitudinal direction A, a core inner peripheral surface 51*a*, and a core outer peripheral surface 51*b*. The hollow cylindrical dielectric core 51 has a slit 51*g*. The slid 51*g* communicates between the core inner peripheral surface 51*a* and the core outer peripheral surface 51*b* and extends along the longitudinal direction A.

The helical antenna 50H further comprises an antenna pattern film 60D which is wound around the core outer peripheral surface 51*b* of the hollow cylindrical dielectric core 51.

Figure 23:
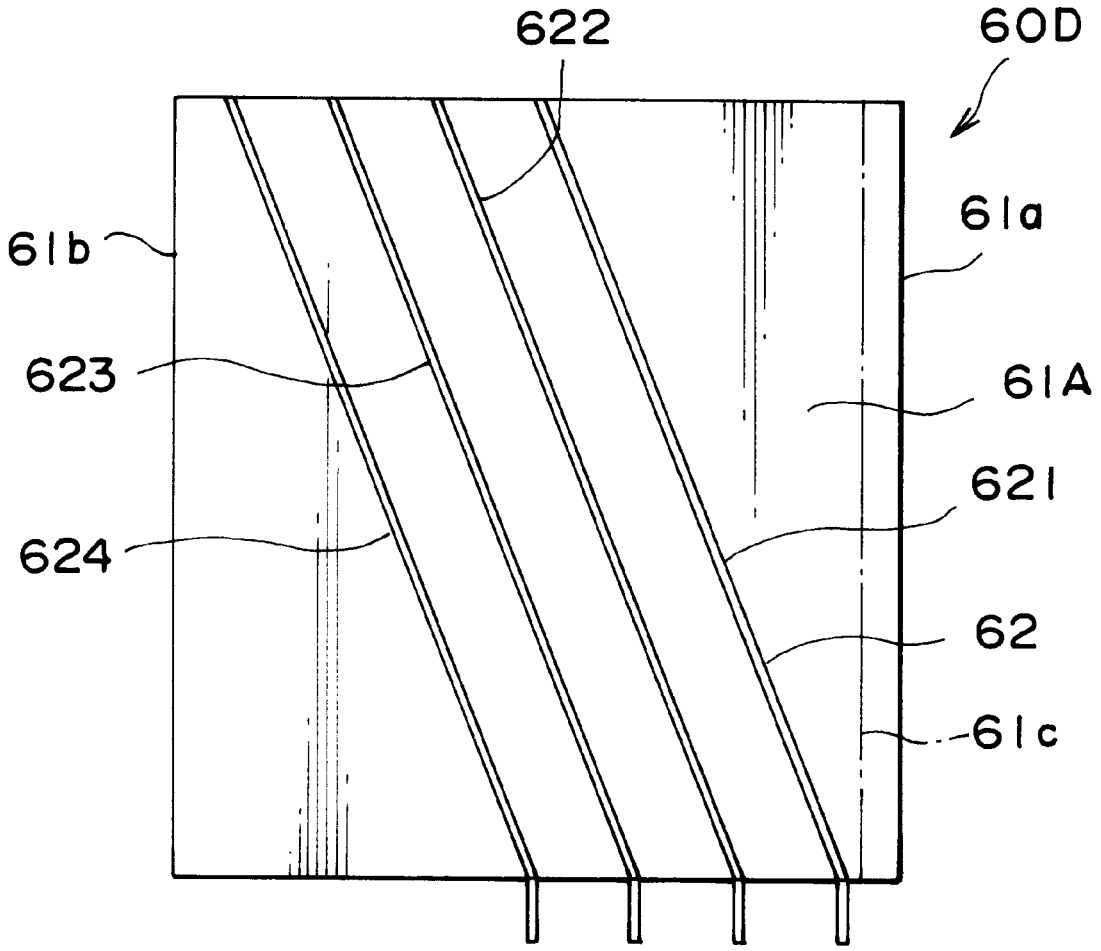
FIG. 23 is a plan view showing an antenna pattern film for use in the helical antenna illustrated in FIGS. 22A and 22B.

Referring to FIG. 23 in addition to FIGS. 22A and 22B, the antenna pattern film 60D comprises a flexible insulator film 61A having a rectangular configuration and a conductive pattern 62 formed on the flexible insulator film 61A. In the example being illustrated, the conductive pattern 62 has first through fourth antenna lead members 612, 622, 623, and 624 which are wound around the core outer peripheral surface 51*b* of the hollow cylindrical dielectric core 51 in a helix fashion. The flexible insulator film 61A has a right-hand side edge 61*a* and a left-hand side edge 61*b*. In the manner which will later be described, the flexible insulator film 61 A is bent along a bent line 61*c* which is depicted at a dot-dash-line neat to the right-hand side edge 61*a* and which extends in parallel with the right-hand side edge 61*a*.

As shown in FIG. 22B, the right-hand side edge 61*a* of the flexible insulator film 61A is inserted in the hollow cylindrical dielectric core 51 through the slit 51*g* and then the antenna pattern film 60D is perpendicularly bent along the bent line 61*c*. Accordingly, the antenna pattern film 60D is hooked on the hollow cylindrical dielectric core 51 at the right-hand side edge 61*a* with the bent line 61*c* engaged with one edge of the slit 51 gas shown FIG. 22B. As a result, it is possible to position the antenna pattern film 60A on the hollow cylindrical dielectric core 51. After the antenna pattern film 60D is wound around the core outer peripheral surface 51*b* of the hollow cylindrical dielectric core 51, the left-hand side edge 61*b* of the antenna pattern film 60D is adhered to a surface of the antenna pattern film 61A by means of an adhesive agent or an adhesive tape to fix the antenna pattern film 60D on the core outer peripheral surface 51*b* of the hollow cylindrical dielectric core 51.

With this structure, it is possible to stably fix the antenna pattern film 60D on the core outer peripheral surface 51*b* of the hollow cylindrical dielectric core 51 and to provide the helical antenna 50H having improved vibration proof and improved shock resistant.

Figure 24A:
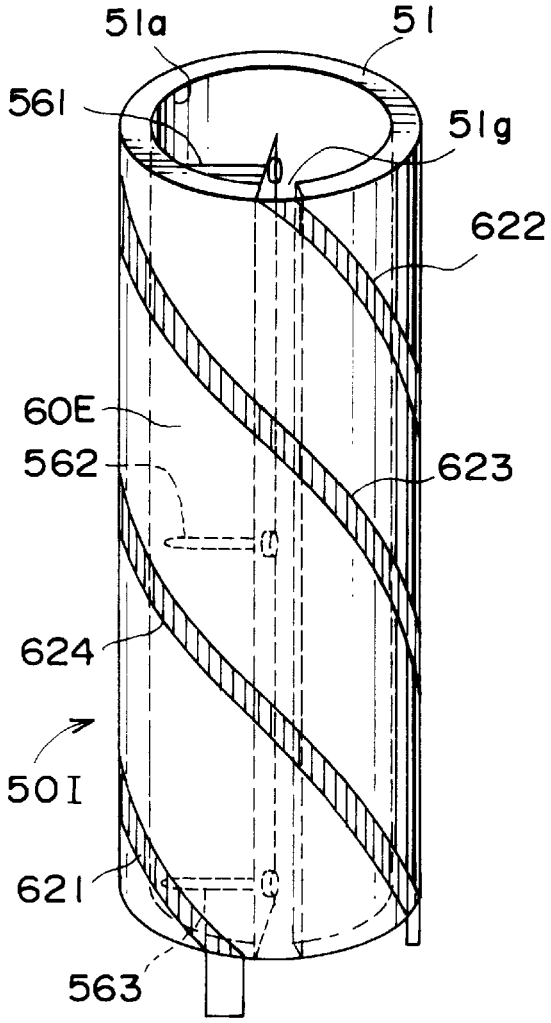
FIG. 24A is a perspective view showing a helical antenna according to a tenth embodiment of this invention.
Figure 24B:
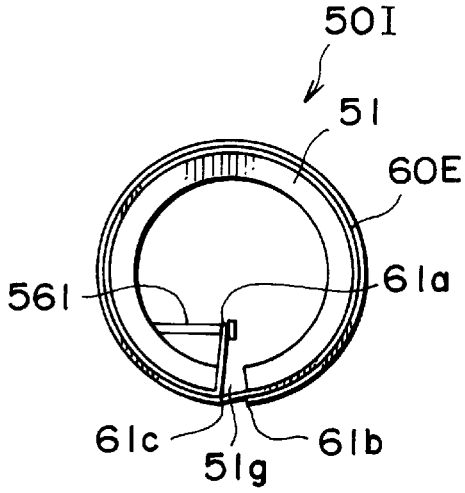
FIG. 24B is a plan view of the helical antenna illustrated in FIG. 24A.

Referring to FIGS. 24A and 24B, the description will proceed to a helical antenna 501 according to a tenth embodiment of this invention. The illustrated helical antenna 501 is similar in structure to the helical antenna 50H illustrated in FIG. 22A and 22B except that the hollow cylindrical dielectric core and the antenna pattern film are modified from those illustrated in FIGS. 22A and 22B in the manner which will later become clear. The antenna pattern film is therefore depicted at 60E.

As shown in FIG. 24A, the hollow cylindrical dielectric core 51 further comprises first through third hooks 561, 562, and 563 at the core inner peripheral surface with equal intervals in the longitudinal direction A near the slit 51*g*.

Figure 25:
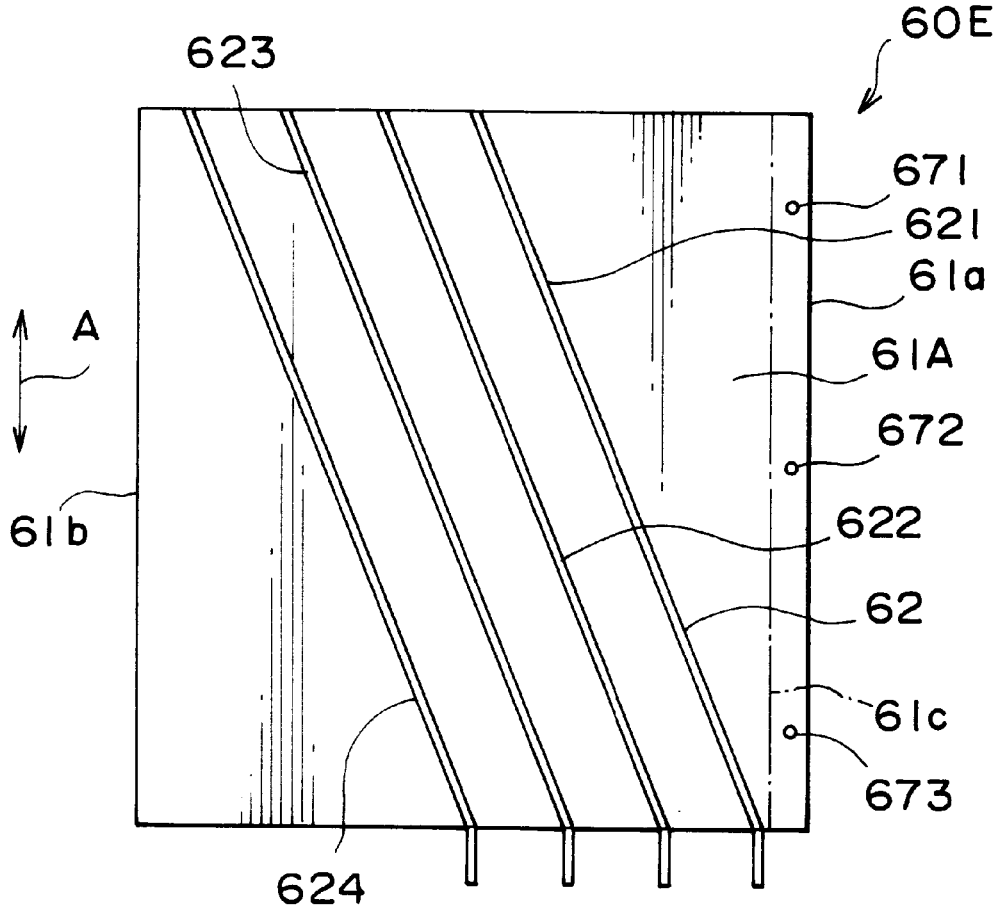
FIG. 25 is a plan view showing an antenna pattern film for use in the helical antenna illustrated in FIGS. 24A and 24B.

Turning to FIG. 25, the antenna pattern film 60E further has first through third eyes 671, 672, and 673 near the right-hand side edge 61*a* of the antenna pattern film 60E along the longitudinal direction A with equal intervals. In other words, the first through the third eyes 671 to 673 are left at positions which correspond to the first through the third hooks 561 to 563, respectively.

With this structure, the antenna pattern film 60E is hooked on the first through the third hooks 561 to 563 of the hollow cylindrical dielectric core 51 at the right-hand side edge 61*a* of the antenna pattern film 60E with the first through the third hooks 561 to 563 engaged with the first through the third eyes 671 to 673, respectively, as shown in FIG. 24A.

Referring to FIGS. 24A and 24B, description will be made as regards a method of fixing the antenna pattern film 60E on the hollow cylindrical dielectric core 51. At first, the right-hand side edge 61*a* of the antenna pattern film 60E is inserted in the slit 51*g* of the hollow cylindrical dielectric core 51. Subsequently, the right-hand side edge 61*a* of the antenna pattern film 50E is hooked on the first through the third hooks 561 to 563 with the first through the third hooks 561 to 563 engaged with the first through the third eyes 671 to 673, respectively. Thereafter, the antenna pattern film 60E is wound around the core outer peripheral surface 51*b* of the hollow cylindrical dielectric core 51. Finally, the left-hand side edge 61*b* of the antenna pattern film 60E is adhered to a surface of the antenna pattern film 60E by means of an adhesive agent or an adhesive tape to fix the antenna pattern film 60E on the core outer peripheral surface 51*b* of the hollow cylindrical dielectric core 51.

Inasmuch as the antenna pattern film 60E is hooked on the first through the third hooks 561 to 563 of the hollow cylindrical dielectric core 51 at the right-hand side edge 61*a* of the antenna pattern film 60E with the first through the third hooks 561 to 563 engaged with the first through the third eyes 671 to 673, respectively, it is possible to stably fix the antenna pattern film 60E on the core outer peripheral surface 51*b* of the hollow cylindrical dielectric core 51 and to provide the helical antenna 501 having improved vibration proof and improved shock resistant.

Although the hollow cylindrical dielectric core 51 comprises three hooks and the antenna pattern film 60E has three eyes in the tenth embodiments of this invention, the hollow cylindrical dielectric core 51 may comprise at least two hooks and the antenna pattern film 60E may have at least two eyes.

Figure 26A:
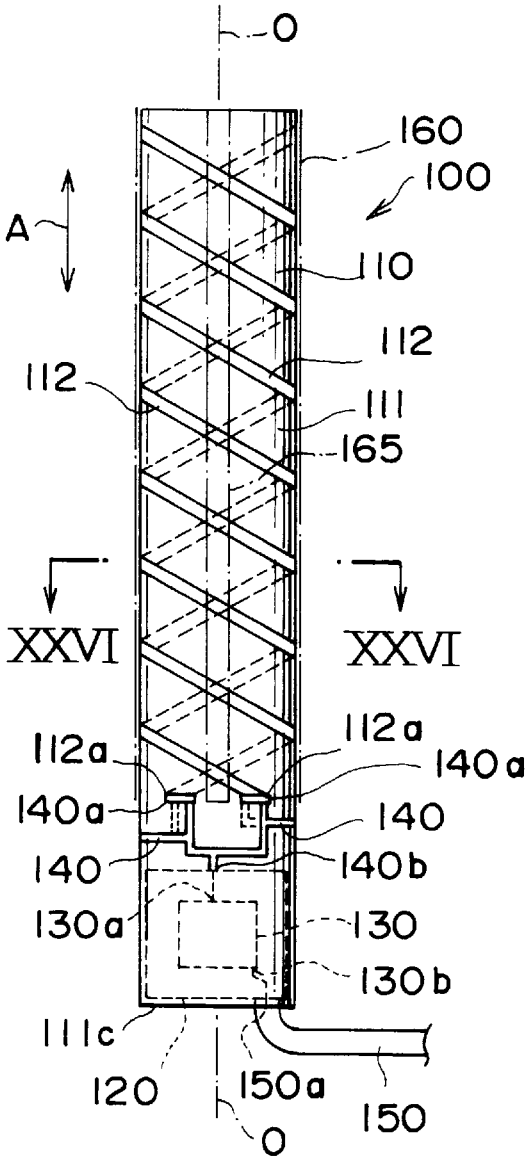
FIG. 26A is a schematic front view showing an antenna unit according to a first embodiment of this invention.
Figure 26B:
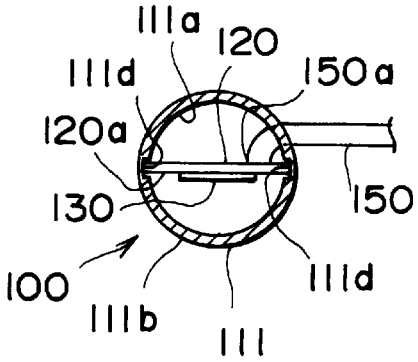
FIG. 26B is a section taken on line XXVI—XXVI in FIG. 26A.

Referring to FIGS. 26A and 26B, the description will proceed to an antenna unit 100 according to a first embodiment of this invention. The illustrated antenna unit 100 comprises a helical antenna 110. The helical antenna 110 comprises a hollow cylindrical member 111 made of insulator and a plurality of antenna lead members 112 each of which is made of conductor. In the example being illustrated, the hollow cylindrical member 111 is made of plastic and has an outer diameter of about 20 mm and a length of about 120 mm. The hollow cylindrical member 111 has a center axis O extending in a longitudinal direction A. The hollow cylindrical member 111 further has an inner peripheral surface 111*a* and an outer peripheral surface 111*b*. The leads 112 are wound around the outer peripheral surface 111*b* of the hollow cylindrical member 111 in a helix fashion as shown in FIG. 26A. Each antenna lead member 112 has a lower end 112*a* terminated at a position which is apart from a lower end 111*c* of the hollow cylindrical member 111 with a space. Instead of the antenna lead members 112, an antenna pattern film as illustrated in FIG. 3 may be wound around the outer peripheral surface 111*b* of the hollow cylindrical member 110. Although the antenna lead members 112 are equal in number to two in the example being illustrated, the antenna lead members 112 may be equal in number to four.

The antenna unit 100 further comprises a main circuit board 120 mounted inside the hollow cylindrical member 111 near the lower end 111*c* of the hollow cylindrical member 111 in the longitudinal direction A. In the example being illustrated, the main circuit board 120 has a main principal surface 120*a* which extends in parallel with the longitudinal direction A. More specifically, the hollow cylindrical member 111 has a pair of main grooves 111*d* at the inner peripheral surface la of the lower end 111*c* side. The pair of main grooves 111*d* are opposed to each other in a radial direction and extend in the longitudinal direction A. The main circuit board 120 is inserted in the pair of main grooves 111*d* from the lower end 111*c* of the hollow cylindrical member 111. That is, the main circuit board 120 has structure where the main circuit board 120 is longitudinally inserted in the hollow cylindrical member 111 along the longitudinal direction A.

The antenna unit 100 further comprises a low-noise amplifier (LNA) 130 mounted on the principal surface 120*a* of the main circuit board 120. The low-noise amplifier 130 is well known in the art. The antenna unit 100 comprises a phase shifter 140 supported on the hollow cylindrical member 111. More specifically, the phase shifter 140 is formed on the outer peripheral surface 111*b* of the hollow cylindrical member 111. The phase shifter 140 has a plurality of shifter input terminals 140*a* connected to the lower ends 112*a* of the antenna lead members 112 and a shifter output terminal 140*b* connected to an amplifier input terminal 130*a* of the low-noise amplifier 130. The low-noise amplifier 130 has an amplifier output terminal 130*b* connected to an end 150*a* of an output cable 150.

The above-mentioned satellite wave or the circular polarization is received by the antenna lead members 112 as a plurality of received waves, the received waves are phase shifted and combined by the phase shifter 140 so as to match phases of the received waves to obtain a combined wave, and then the combined wave is amplified by the low-noise amplifier 130 to obtain an amplified wave which is delivered to a receiver body (not shown) through the output cable 150.

Inasmuch as the low-noise amplifier 130 is mounted inside the hollow cylindrical member 111, it is possible to easily miniaturize the antenna unit 100 having a large freedom in design.

Figure 27:
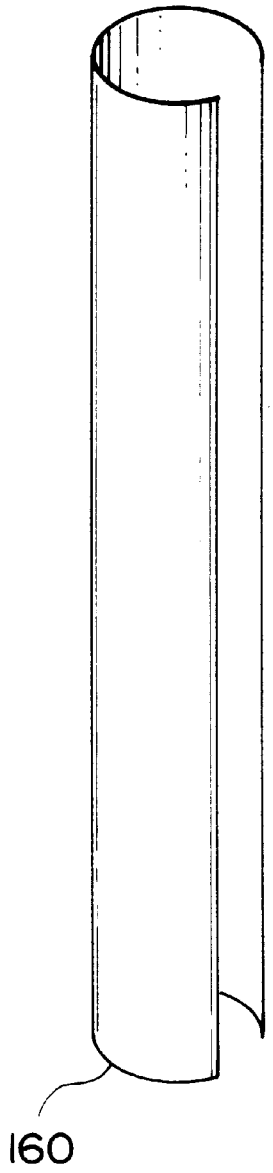
FIG. 27 is a perspective view of a dielectric seat for use in the antenna unit illustrated in FIG. 26A.

The antenna unit 100 further may comprises a dielectric seat 160, which is illustrated in FIG. 27, for covering the helical antenna 110 that is depicted at a dot-dash-line in FIG. 26A. In other words, the dielectric seat 160 is wrapped around the outer peripheral surface 111*b* of the hollow cylindrical surface 111. The dielectric seat 160 preferably may be a film seat having a high dielectric constant. With this structure, it is possible to thin and shorten the antenna unit 100 caused by the above-mentioned wavelength shortening effect.

Figure 28:
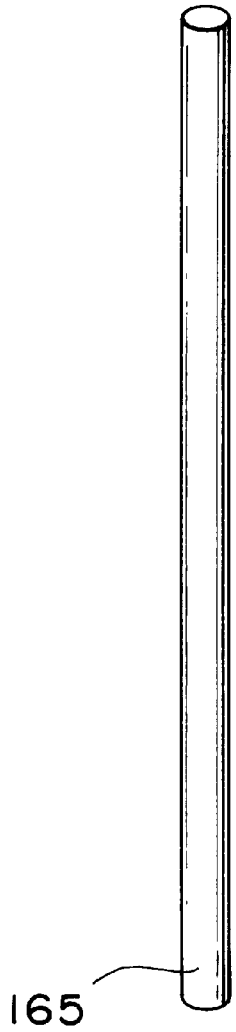
FIG. 28 is a perspective view of a dielectric rod for use in the antenna unit illustrated in FIG. 26A.

The antenna unit 100 further may comprise a dielectric rod 165, which is illustrated in FIG. 28, inserted in the hollow cylindrical member 111 of the antenna unit 100 that is depicted at a dot-dash-line in FIG. 26A. It is suitably that the dielectric rod 165 preferably may be made of ceramic. In addition, the dielectric rod 175 may be thick as much as possible. With this structure, it is possible to thin and shorten the antenna unit 100 caused by the above-mentioned wavelength shortening effect.

Although the antenna unit 100 comprises the helical antenna 110 comprising a plurality of antenna lead members 112, the helical antenna 110 may comprise only one antenna lead member. In this event, the phase shifter 140 is not required. In other words, an end of the antenna lead member is directly connected to the amplifier input terminal 130*a* of the low-noise amplifier 130.

Figure 29A:
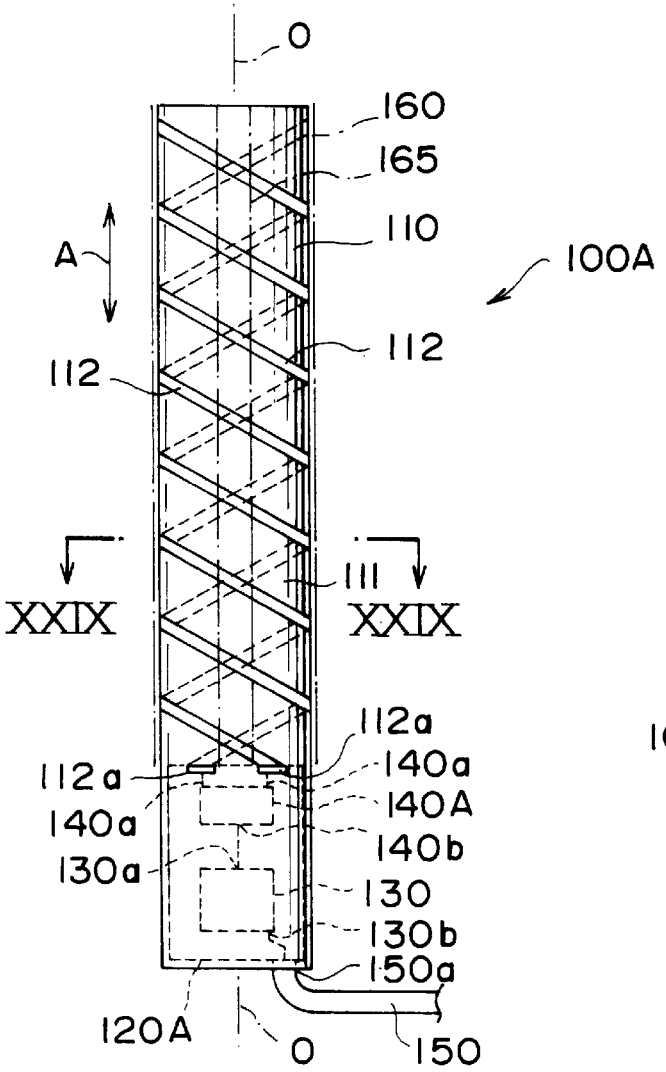
FIG. 29A is a schematic front view showing an antenna unit according to a second embodiment of this invention.
Figure 29B:
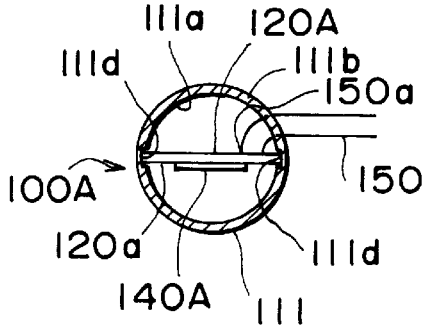
FIG. 29B is a section taken on line XXIX—XXIX in FIG. 29A.

Referring to FIGS. 29A and 29B, the description will proceed to an antenna unit 100A according to a second embodiment of this invention. The illustrated antenna unit 100A is similar structure to the antenna unit 100 illustrated in FIGS. 26A and 26B except that the main circuit board and the phase shifter are modified from those illustrated in FIGS. 26A and 26B in the manner which will later become clear. The main circuit board and the phase shifter are therefore depicted at 120A and 140A, respectively.

As shown in FIG. 29A, the main circuit board 120A is enlarged upwards in comparison with the main circuit board 120 illustrated in FIG. 26A. In addition, the phase shifter 140A is mounted on a main principal surface 120*a* of the main circuit board 120A. The phase shifter 140A has a plurality of shifter input terminals 140*a* connected to lower ends 112*a* of the antenna lead members 112 and a shifter output terminal 140*b* connected to the amplifier input terminal 130*a* of the low-noise amplifier 130.

With this structure, inasmuch as the low-noise amplifier 130 and the phase shifter 140A are mounted on the main principal surface 120*a* of the main circuit board 120A, it is possible for the antenna unit 100A to decrease a cost by decreasing the number of parts and by simplifying structure.

Figure 30A:
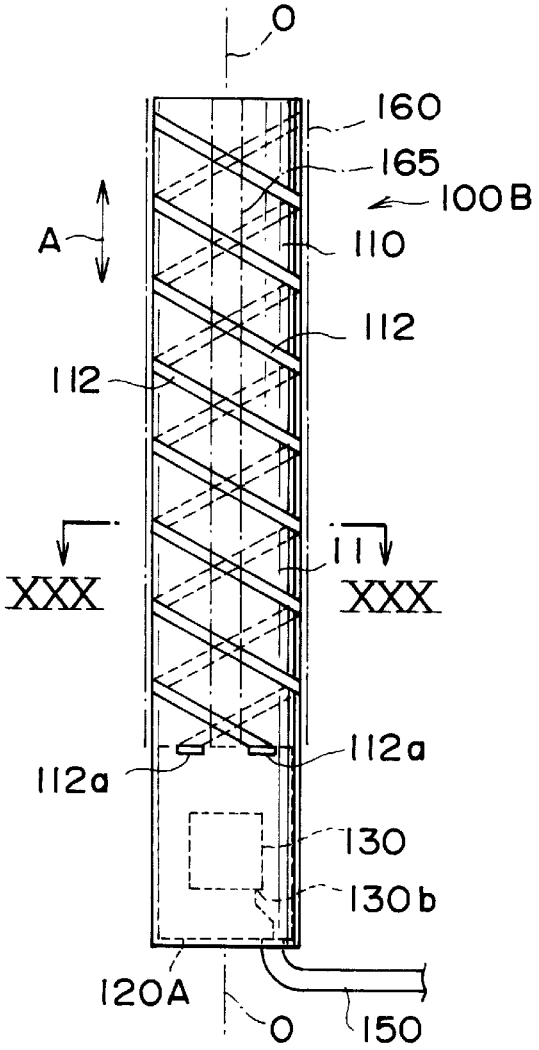
FIG. 30A is a schematic front view showing an antenna unit according to a third embodiment of this invention.
Figure 30B:
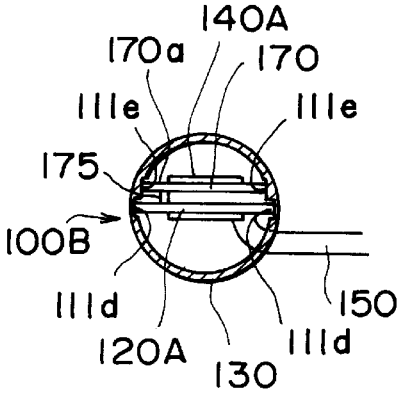
FIG. 30B is a section taken on line XXX—XXX in FIG. 30A.

Referring to FIGS. 30A and 30B, the description will proceed to an antenna unit 100B according to a third embodiment of this invention. The illustrated antenna unit 100B is similar structure to the antenna unit 100A illustrated in FIGS. 29A and 29B except that the antenna unit 100B further comprises a subsidiary circuit board 170.

The subsidiary circuit board 170 is mounted within the hollow cylindrical member 111 in parallel with the main circuit board 120A. That is, the subsidiary circuit board 170 has a subsidiary principal surface 170*a* which extends in parallel with the main principal surface 120*a* of the main circuit board 120A. More specifically, the hollow cylindrical member 111 has a pair of subsidiary grooves 111*e* at the inner peripheral surface 111*a* of the lower end 111*c* side. The pair of subsidiary grooves 111*e* are opposed to each other apart from the pair of main grooves 111*d* with a space and extend along the longitudinal direction A. The subsidiary circuit board 170 is inserted in the pair of subsidiary grooves 111*e* from the lower end 111*c* of the hollow cylindrical member 111. The phase shifter 140A is mounted on the subsidiary principal surface 170*a* of the subsidiary circuit board 170. The phase shifter 140A has the shifter input terminals connected to the lower ends 112*a* of the antenna lead members 112 and has the shifter output terminal connected to the amplifier input terminal of the low-noise amplifier 130 through a connection pin 175.

With this structure, inasmuch as the main circuit board 120A for mounting the low-noise amplifier 130 thereon and the subsidiary circuit board 170 for mounting the phase shifter 140A thereon are arranged in parallel with each other, it is possible for the antenna unit 100B to relatively shorten in size in the longitudinal direction A.

Figure 31:
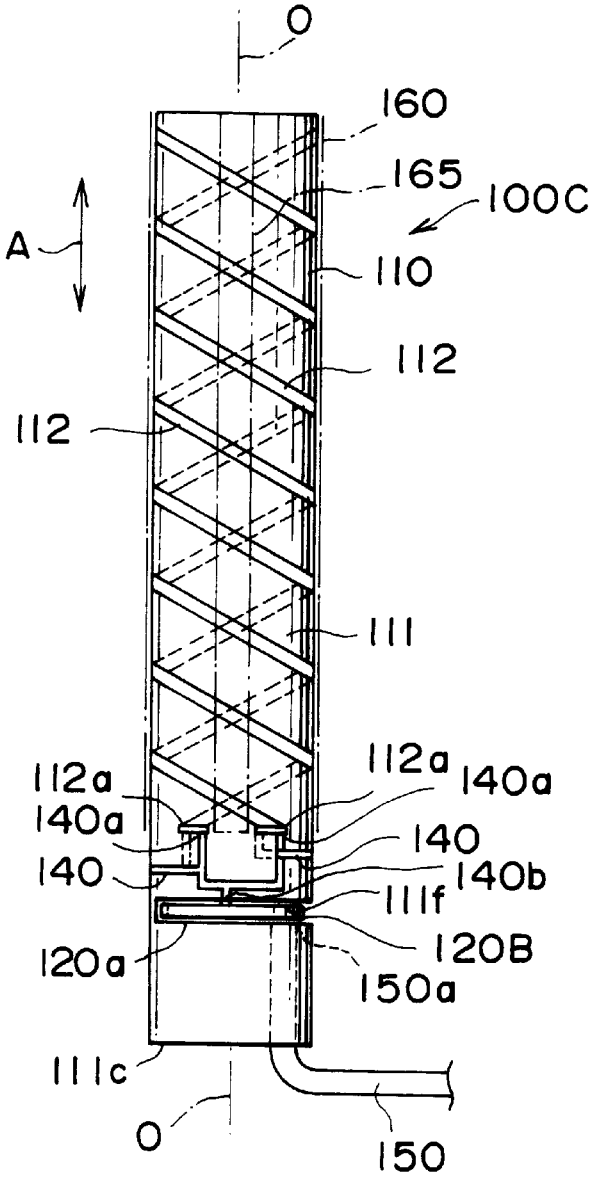
FIG. 31 is a schematic front view showing an antenna unit according to a fourth embodiment of this invention.
Figure 32:
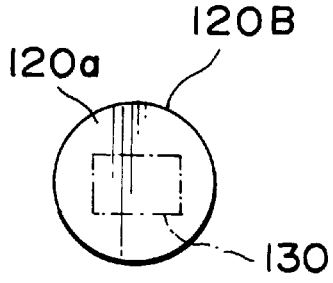
FIG. 32 is a plan view showing a main circuit board for use in the antenna unit illustrated in FIG. 31.

Referring to FIGS. 31 and 32, the description will proceed to an antenna unit 100C according to a fourth embodiment of this invention. The illustrated antenna unit 100C is similar structure to the antenna unit 100 illustrated in FIGS. 26A and 26B except that the main circuit board is modified from that illustrated in FIGS. 26A and 26B in the manner which will later become clear. The main circuit board is therefore depicted at 120B.

The main circuit board 120B has a main principal surface 120*a* which extends so as to intersect the longitudinal direction A. In other words, the main principal surface 120*af* of the main circuit board 120B extends in a radial direction perpendicular to the longitudinal direction A. The main circuit board 120B has a disk shape as shown in FIG. 32. The main circuit board 120B has a diameter which is less than the outer diameter of the hollow cylindrical member 111 and which is more than an inner diameter of the hollow cylindrical member 111. The low-noise amplifier 130 is mounted on the main principal surface 120*a* of the main circuit board 120B as shown in FIG. 32. The hollow cylindrical member 111 further has a main notched slit 111*f* through which the main circuit board 120B is inserted in the hollow cylindrical member 111 as illustrated in FIG. 31.

With this structure, inasmuch as the main circuit board 120B is assembled in the hollow cylindrical member 111 so as to intersect the longitudinal direction A, it is possible for the antenna unit 100C to shorten in size in the longitudinal direction A.

Figure 33:
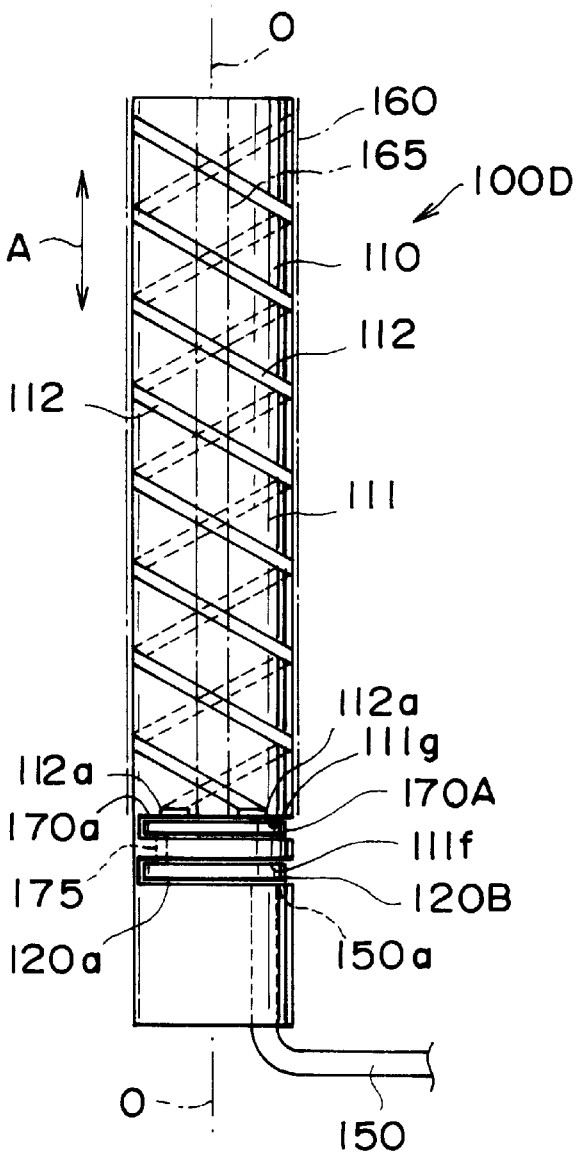
FIG. 33 is a schematic front view showing an antenna unit according to a fifth embodiment of this invention.
Figure 34:
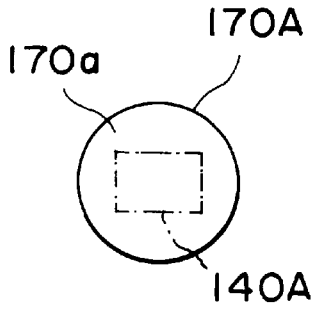
FIG. 34 is a plan view showing a subsidiary circuit board for use in the antenna unit illustrated in FIG. 33.

Referring to FIGS. 33 and 34, the description will proceed to an antenna unit 100D according to a fifth embodiment of this invention. The illustrated antenna unit 100D is similar structure to the antenna unit 100B illustrated in FIGS. 30A and 30B except that the main circuit board and the subsidiary circuit board are modified from those illustrated in FIGS. 30A and 30B in the manner which will later become clear. The main circuit board and the subsidiary circuit board are therefore depicted at 120B and 170A, respectively.

Inasmuch as the main circuit board 120B is similar in structure to that illustrated in FIGS. 31 and 32, description regarding the main circuit board 120B is omitted.

The subsidiary circuit board 170A is mounted within the hollow cylindrical member 111 in parallel with the main circuit board 120B as shown in FIG. 33. More specifically, in like manner as the main circuit board 120B, the subsidiary circuit board 170A has a subsidiary principal surface 170*a* which extends so as to intersect the longitudinal direction A. In other words, the subsidiary principal surface 170*a* of the subsidiary circuit board 170A extends in a radial direction perpendicular to the longitudinal direction A. The subsidiary circuit board 170A has a disk shape as shown in FIG. 34. The subsidiary circuit board 170A has a diameter which is less than the outer diameter of the hollow cylindrical member 111 and which is more than an inner diameter of the hollow cylindrical member 111. The phase shifter 140A is mounted on the subsidiary principal surface 170*a* of the subsidiary circuit board 170A as shown in FIG. 34. The hollow cylindrical member 111 further has a subsidiary notched slit 111*g* through which the subsidiary circuit board 170A is inserted in the hollow cylindrical member 111 as illustrated in FIG. 33. The phase shifter 140A has the shifter output terminal connected to the amplifier input terminal of the low-noise amplifier 130 (FIG. 30B) through the connection pin 175.

With this structure, inasmuch as the main circuit board 120B and the subsidiary circuit board 170A are assembled in the hollow cylindrical member 111 so as to intersect the longitudinal direction A, it is possible for the antenna unit 100D to shorten in size in the longitudinal direction A.

Figure 35:
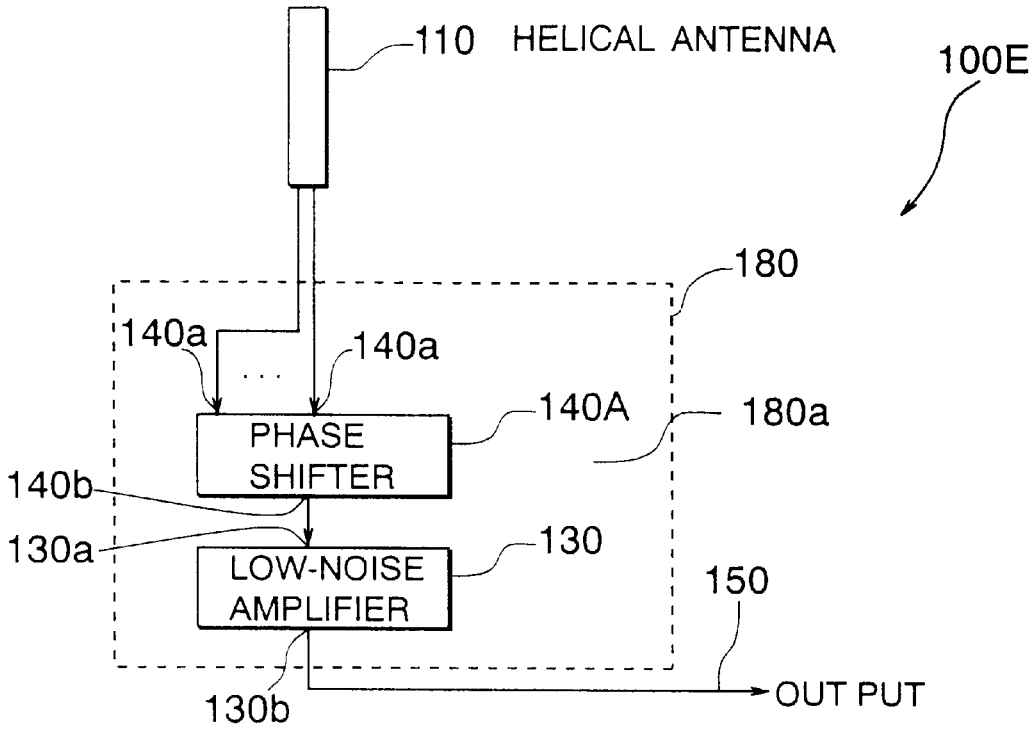
FIG. 35 is a block diagram showing an antenna unit according to a sixth embodiment of this invention.
Figure 36:
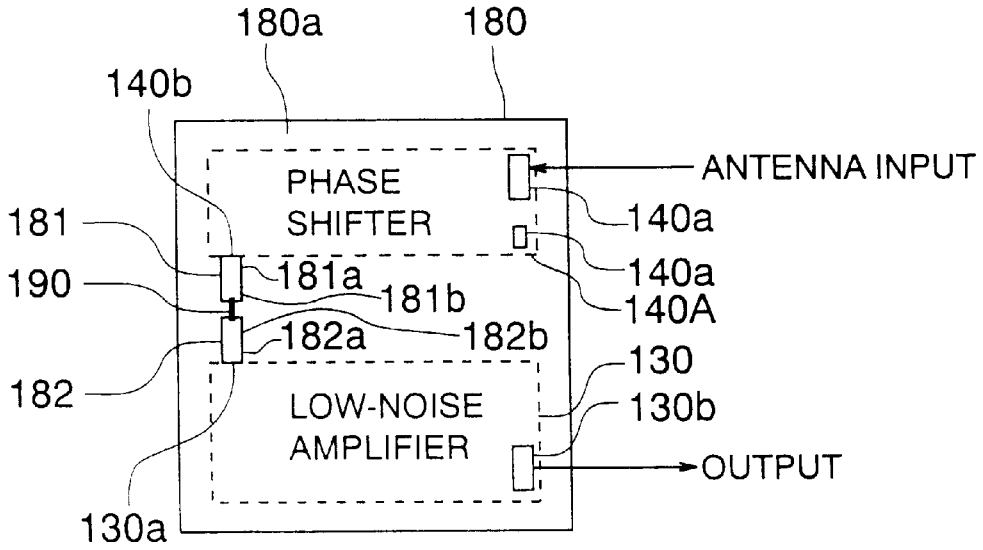
FIG. 36 is a plan view showing a circuit board for use in the antenna unit illustrated in FIG. 35.

Referring to FIGS. 35 and 36, the description will proceed to an antenna unit 100E according to a sixth embodiment of this invention. The illustrated antenna unit 100E comprises a helical antenna 110, a phase shifter 140A, and a low-noise amplifier 130.

Although illustration is not made in FIG. 35, the helical antenna 110 includes a plurality of leads wound around a hollow cylindrical member in helix fashion like in FIG. 26A. The phase shifter 140A has a plurality of shifter input terminals 140*a* connected to the corresponding leads of the helical antenna 110 and a shifter output terminal 140*b*. The low-noise amplifier 130 has an amplifier input terminal 130 connected to the shifter output terminal 140*b* and an amplifier output terminal 130*b* connected to an end of an output cable 150.

The antenna unit 100E comprises a circuit board 180 having a principal surface 180*a* on which the phase shifter 140A and the low-noise amplifier 130 are mounted. The circuit board 180 includes first and second conductive connection strips 181 and 182 which are formed on the principal surface 180*a*. The first conductive connection strip 181 has one end 181*a* connected to the shifter output terminal 140*b* while the second conductive connection strip 182 has one end 182*a* connected to amplifier input terminal 130*a*. The first and the second conductive connection strips 181 and 182 have other ends 181*b* and 182*b* which are opposed to each other with a predetermined space. The antenna unit 100E further comprises a conducting member 190 for electrically connecting between the other ends 181*b* and 182*b* of the first and the second conductive connection strips 181 and 182. In the example being illustrated, the conducting member 190 is solder.

Figure 37:
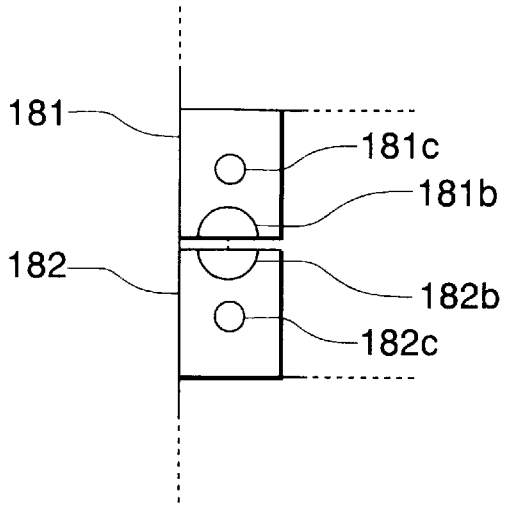
FIG. 37 is an enlarged plan view of a part of the circuit board illustrated in FIG. 36.

Turning to FIG. 37, the description will proceed to the first and the second conductive connection strips 181 and 182. The other ends 181*b* and 182*b* of the first and the second conductive connection strips 181 and 182 are formed as short lands as shown in FIG. 37. The first and the second conductive connection strips 181 and 182 further have first and second through holes 181*c* and 182*c* at a center thereof, respectively. In the manner which will become clear as the description proceeds, the first and the second through holes 181*c* and 182*c* serves as first and second contact parts for test probe.

Before the first and the second conductive connection strips 181 and 182 is electrically connected to each other by means of the solder 190, the phase shifter 140A and the low-noise amplifier 130 are electrically separated with each other independently. Accordingly, it is possible to independently measure circuit characteristics of the phase shifter 140A and the low-noise amplifier 130. Inasmuch as the first and the second short lands 181*b* and 182*b* are close to each other with the predetermined space, it is possible to electrically connect between the phase shifter 140A and the low-noise amplifier 130 by using a little amount of the solder 190. In addition, certain connection is secured by preliminary solder. In addition, inasmuch as it is possible on measuring of the circuit characteristics to certainly catch a tip of the test probe at the first through the second through holes 181*c* and 182*c*, it is possible to obtain high precision evaluations caused by correct measurement. In addition, the first and the second contact parts 181*c* and 182*c* may be those which can certainly catch the tip of the test probe. Furthermore, the contact parts and/or the short lands may be removed.

Figure 38:
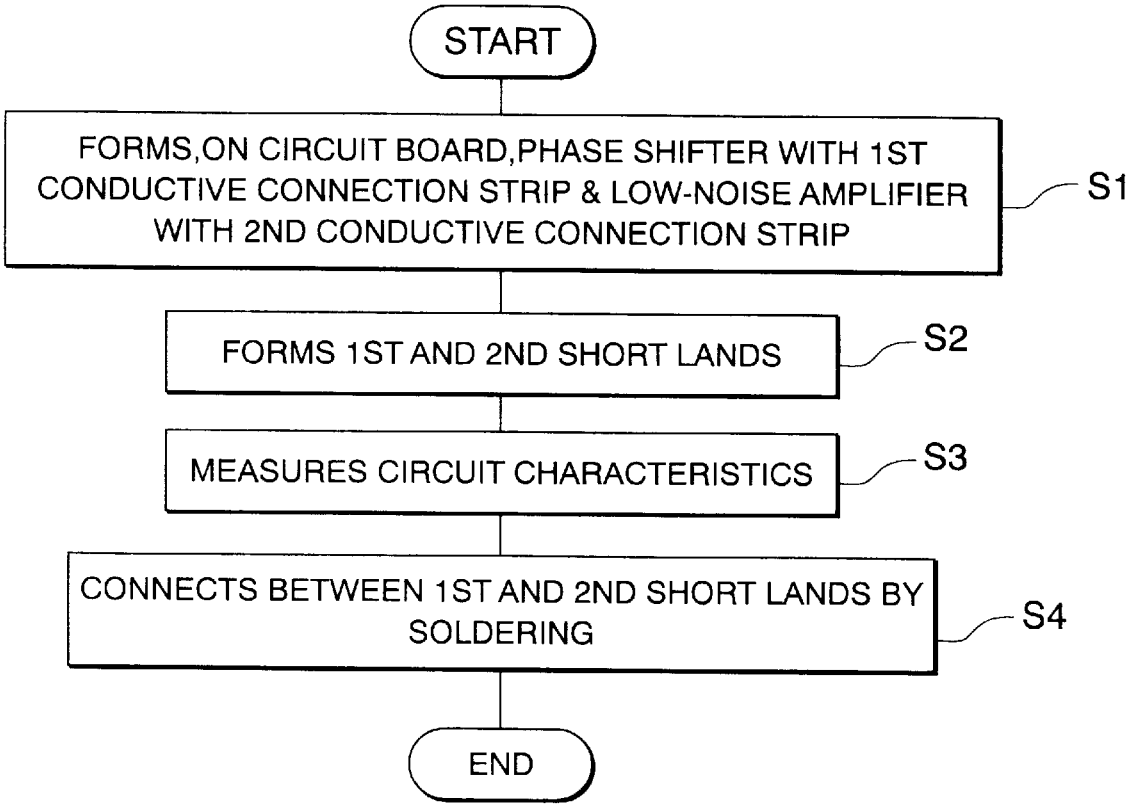
FIG. 38 is a flow chart for use in describing a method of manufacturing the antenna unit illustrated in FIG. 35.

Referring to FIG. 38 in addition to FIGS. 35 through 37, the description will be made as regards a method of manufacturing the antenna unit 100E illustrated in FIG. 35.

At a step Si, the circuit board 180 having the principal surface 180*a* is prepared. Subsequently, the phase shifter 140A having the shifter input terminals 140*a* and the shifter output terminal 140*b* is formed on the principal surface 180*a* of the circuit board 180A and then the low-noise amplifier 130 having the amplifier input terminal 130*a* and the amplifier output terminal 130*b* is formed on the principal surface 180*a* of the circuit board 180A. Subsequently, the first and the second conductive connection strips 181 and 182 are formed on the principal surface 180*a* of the circuit board 180A. Under the circumstances, the first and the second through holes 181*c* and 182*c* are formed in the first and the second conductive connection strips 181 and 182, respectively. In this event, the one end 181*a* of the first conductive connection strip 181 is connected to the shifter output terminal 140*b* while the one end 182*a* of the second conductive connection strip 182 is connected to the amplifier input terminal 130*a* as shown in FIG. 36. The other ends 181*b* and 182*b* of the first and the second conductive connection strips 181 and 182 are opposed to each other with the predetermined space.

The step S1 is followed by a step S2 at which the first and the second short lands 181*b* and 182*b* are formed on the first and the second conductive connection strips 181 and 182 at the other ends thereof by preliminarily soldering. The step S2 proceeds to a step S3 at which the circuit characteristics of the phase shifter 140A and the low-noise amplifier 130 are measured by placing the tip of the probe on the first and the second through holes 181*c* and 182*c*. The step S3 is succeeded by a step S4 at which the first and the second short lands 181*b* and 182*b* are electrically connected with each other by means of solder.

Figure 39:
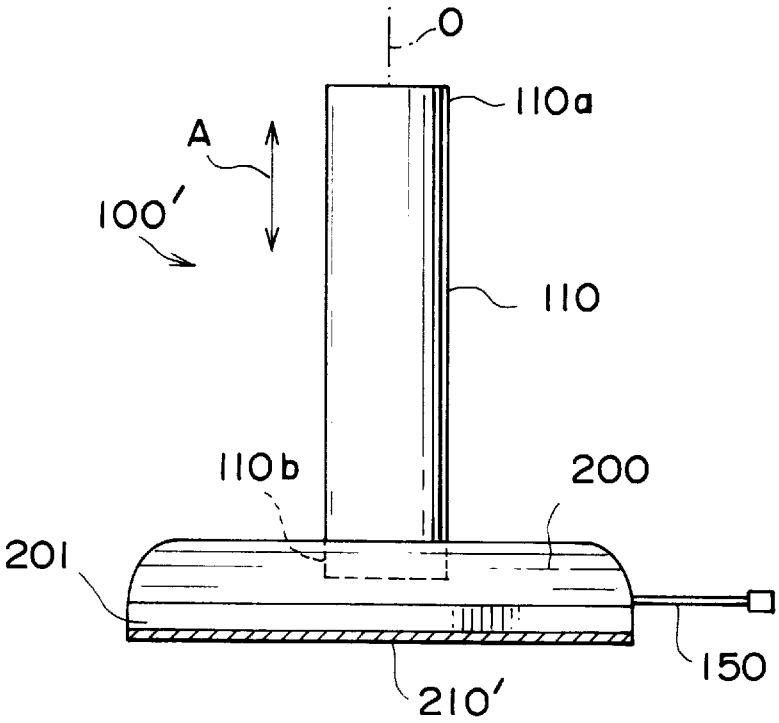
FIG. 39 PRIOR ART
FIG. 39 is a front view showing a conventional antenna unit.

Referring to FIG. 39, a conventional antenna unit 100' will be described in order to facilitate an understanding of the present invention. The illustrated antenna unit 100' comprises a cylindrical antenna 110 for receiving the above-mentioned satellite wave. The cylindrical antenna 110 may be the above-mentioned helical antenna. The cylindrical antenna 110 has a center axis O extending in a longitudinal direction A. The cylindrical antenna 110 has a tip portion 110*a* and a rear portion 110*b*.

The antenna unit 100' further comprises a case 200 for supporting the cylindrical antenna 110 so as to raise the cylindrical antenna with the rear portion 110*b* of the rear portion of the cylindrical antenna 110 inserted within the case 200. The case 200 comprises a base 201 for positioning the case 200 on a place such as a roof of an automobile. Accordingly, the base 201 is called a positioning part. Although illustration is omitted from FIG. 39, the case 200 contains the above-mentioned phase shifter and the above-mentioned low-noise amplifier. The case 200 is connected to an output cable 150 in the manner which is described above.

Figure 40:
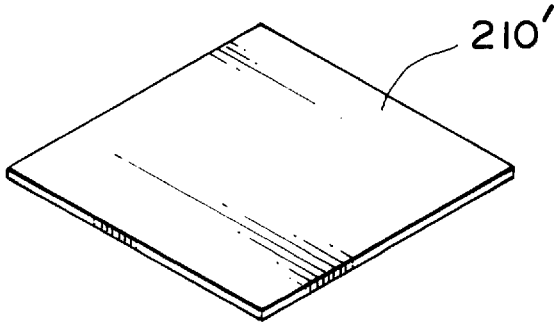
FIG. 40 PRIOR ART
FIG. 40 is a perspective view of a ground plate for use in the antenna unit illustrated in FIG. 39.

The antenna unit 100' further comprises a ground plate 210' mounted on the base 201 of the case 200 so as to intersect the longitudinal direction A. In the example being illustrated, the ground plate 210' has a plate shape, as shown in FIG. 40, which extends in a radial direction perpendicular to the longitudinal direction A. The ground plate 210' has an area which is wider than a cross section of the cylindrical antenna 110.

In the manner known in the art, a directional antenna has a front-to-back ratio which is a ratio of the effectiveness toward the front and toward the rear. The antenna unit 100' is a type of directional antennas. In the antenna unit 100', the tip portion 10*a* is the front while the rear portion 10*b* is the rear. It is desirable that the antenna unit 100' has a large front-to-back ratio. In other words, the cylindrical antenna 110 has an improved reception sensitivity when the front-to-back ratio is large.

In the antenna unit 100', a reception sensitivity of the cylindrical antenna 110 is improved by grounding an electric wave arrived from the rear by means of the ground plate 210' having the plate shape. However, the antenna unit 100' may receive electric waves arrived from periphery of the ground plate 210'. This is because the ground plate 210' has the plate shape. Accordingly, the conventional antenna unit 100' has a small front-to-back ratio and then it is difficult to decrease ground noises and to improve an antenna sensitivity, as mentioned in the preamble of the instant specification.

Figure 41:
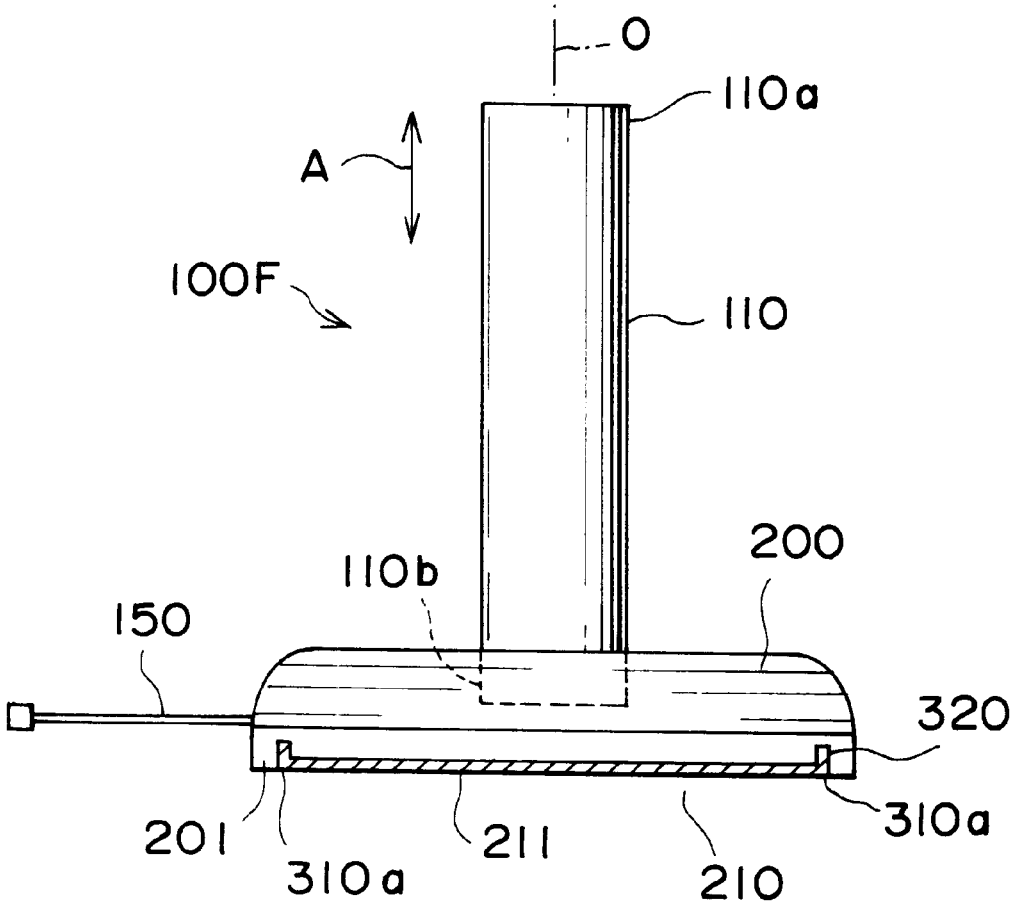
FIG. 41 is a front view showing an antenna unit according to a seventh embodiment of this invention.

Referring to FIG. 41, the description will proceed to an antenna unit 100F according to a seventh embodiment of this invention. The illustrated antenna unit 100F is similar in structure to the conventional antenna unit 100' illustrated in FIG. 39 except that the ground plate is modified from that illustrated in FIG. 40 in the manner which will later become clear. The ground plate is therefore depicted at 210.

Figure 42A:
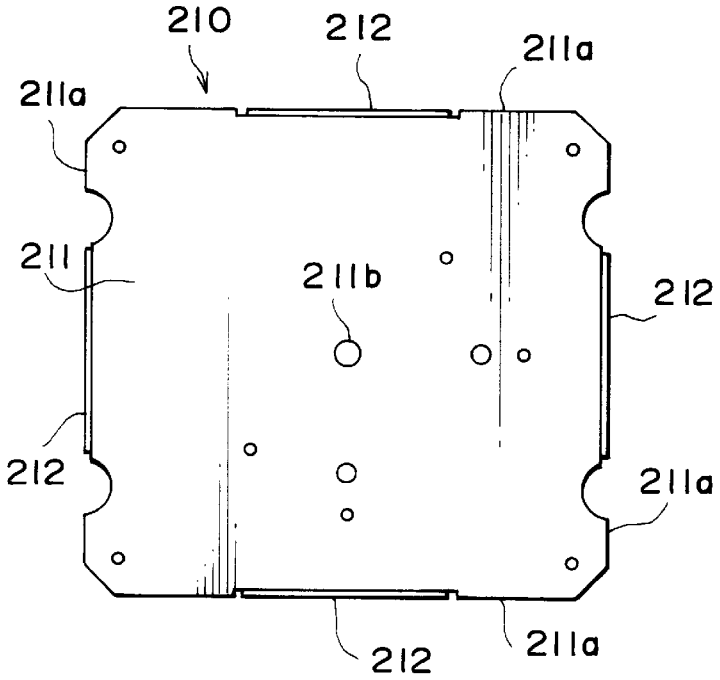
FIG. 42A is a plan view showing a ground plate for use in the antenna unit illustrated in FIG. 41.
Figure 42B:
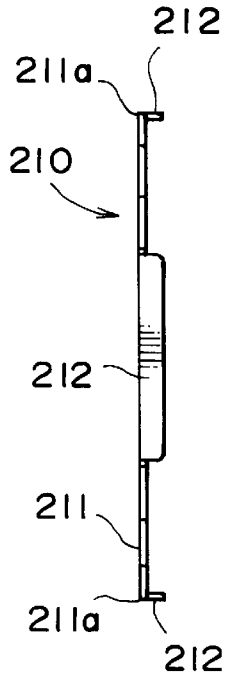
FIG. 42B is a left-hand side view showing a ground plate for use in the antenna unit illustrated in FIG. 41.
Figure 42C:
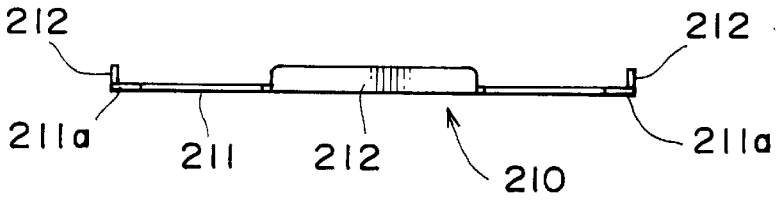
FIG. 42C is a front view showing a ground plate for use in the antenna unit illustrated in FIG. 41.

Referring to FIGS. 42A, 42B, and 42C in addition to FIG. 41, the description will proceed to the ground plate 210. FIG. 42A is a plan view of the ground plate 210. FIG. 42B is a left-hand side view of the ground plate 210. FIG. 42C is a front view of the ground plate 210. The ground plate 210 comprises a main plate part 211 having a main area which is wider the cross section of the cylindrical antenna 110. The main plate part 211 has a peripheral edge 211*a*. In the example being illustrated, the main plate part 211 substantially has a rectangular configuration as shown in FIG. 42A. The ground plate 210 further comprises four subsidiary plate parts 212 which project toward the cylindrical antenna 110 at the peripheral edge 211*a* of the main plate part 211.

In the example being illustrated, the ground plate 210 is made of a plate member into which the main plate part 211 and the four subsidiary plate parts 212 are integrated. Each subsidiary plate part 212 is formed by bending a peripheral edge of the plate member toward the cylindrical antenna 110. Although each subsidiary plate part 212 is perpendicularly bent for the main plate part 211 in this embodiment, each subsidiary plate part 212 may be obliquely bent for the main plate part 211.

The main plate part 211 has a plurality of holes 211*b* through which the ground plate 210 is fixed on the base 201 of the case 200 by means of screws (not shown).

With this structure, inasmuch as the ground plate 300 comprises the subsidiary plate parts 212, electric waves arrived from periphery of the main plate part 211*a* re grounded by means of the subsidiary plate parts 212 of the ground plate 210. Accordingly, the antenna unit 100F has a large front-to-back ratio and then it is possible to decrease ground noises and to improve an antenna sensitivity of the antenna unit 100F.

Figure 43A:
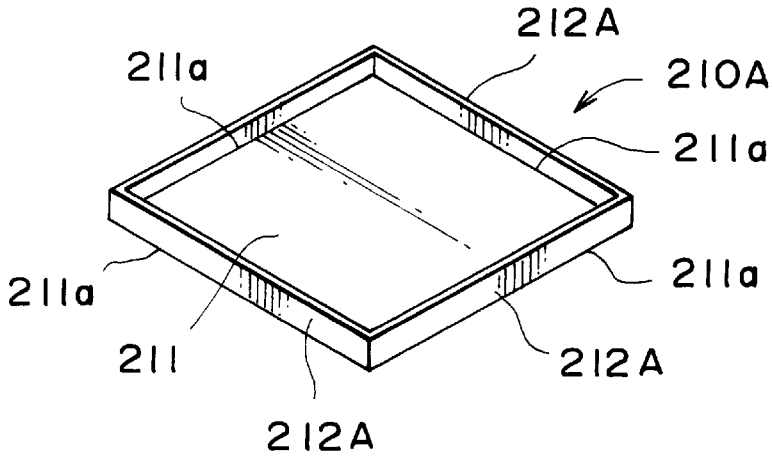
FIG. 43A is a perspective view showing another ground plate for use in the antenna unit illustrated in FIG. 41.
Figure 43B:
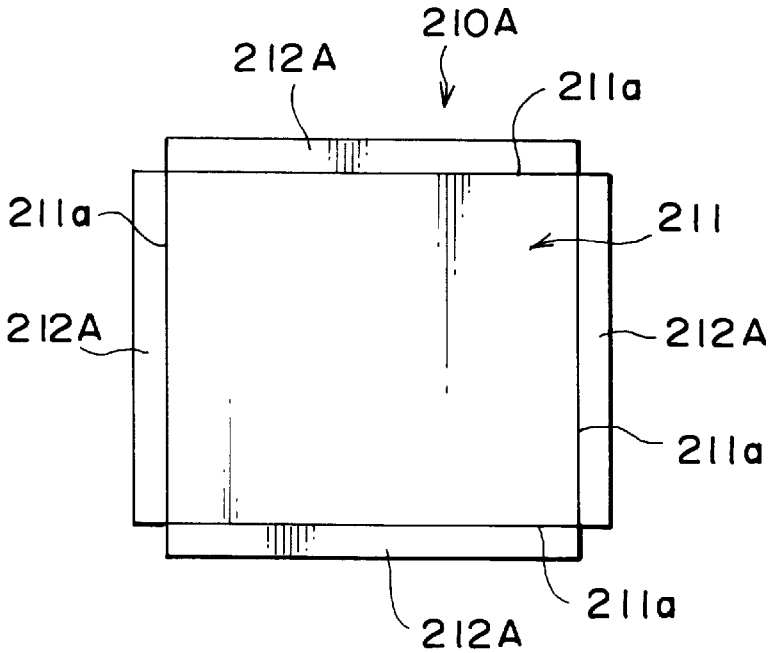
FIG. 43B is a development of the ground plate illustrated in FIG. 43A.

Referring to FIGS. 43A and 43B, the description will proceed to another ground plate 300A for use in the antenna unit 100F illustrated in FIG. 41. FIG. 43A is a perspective view of the ground plate 210A while FIG. 43B is a development of the ground plate 210A. The ground plate 210A comprises the main plate part 211 and four subsidiary plate parts 212A. The ground plate 210A is made of a plate member into which the main plate part 211 and the four subsidiary plate parts 212A. The main plate part 211 has a regular square shape. The main plate part 211 has the peripheral edge 211*a* which consists of four sides. Each subsidiary plate part 212A has a length which is equal to that of each side of the main plate part 211. The four subsidiary plate parts 212A are perpendicularly bent for the main plate part 211 so as to form a side wall having a ring configuration as shown in FIG. 43A. In other words, the four subsidiary plate parts 212A project toward the cylindrical antenna 110 (FIG. 41) at the peripheral edge 211*a* of the main plate part 211.

Although the main plate part 211 has the rectangular or the regular square shape in this embodiment, the main plate part 211 may have other shapes, such as a polygonal shape, a circular shape, or an oval shape.

Figure 44:
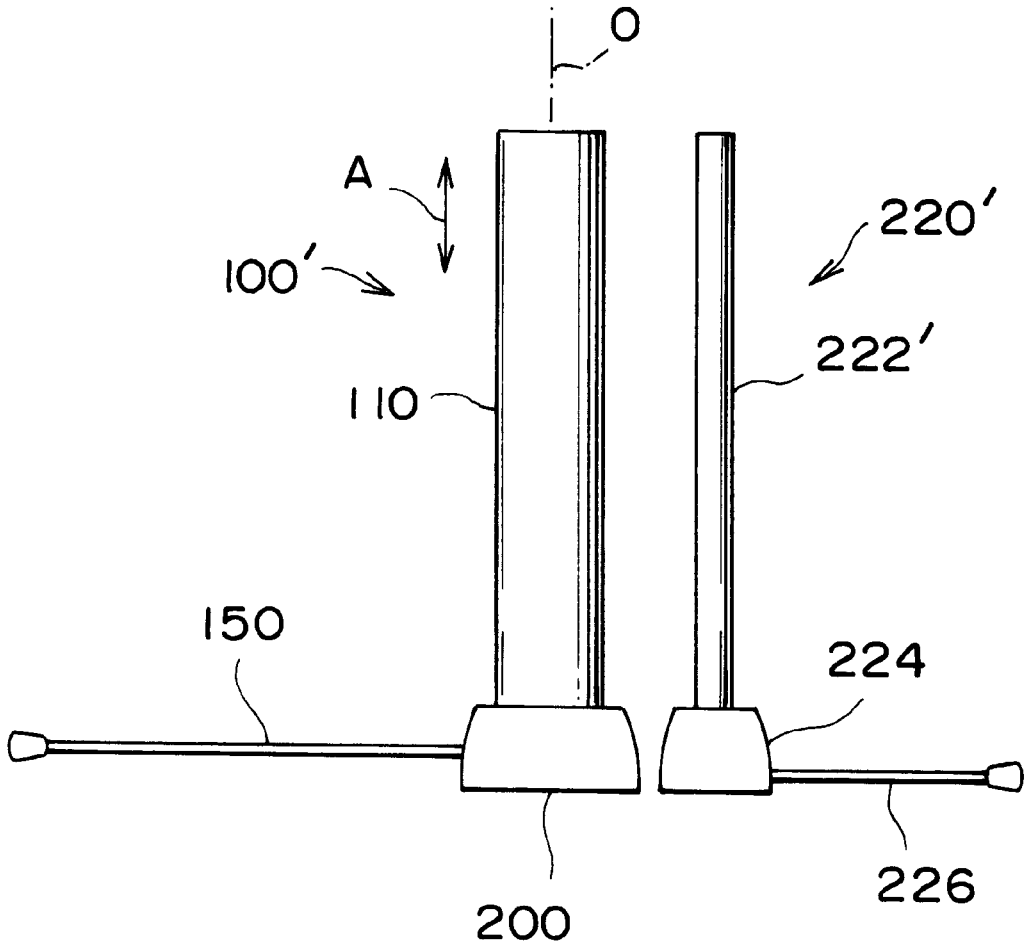
FIG. 44 PRIOR ART
FIG. 44 is a front view showing a conventional composite antenna unit.

Referring to FIG. 44, a conventional composite antenna unit will be described in order to facilitate an understanding of the present invention. The composite antenna unit comprises first and second antenna unit 100' and 220'. The first antenna unit 100' is for receiving the above-mentioned satellite wave while the second antenna unit 220' is for receiving the above-mentioned ground wave.

The first antenna unit 100' is similar in structure to the antenna unit 100' illustrated in FIG. 39. That is, the first antenna unit 100' comprises the cylindrical antenna or the helical antenna 110, the case 200 for supporting the helical antenna 110, and the output cable 150 connected to the case.

The second antenna unit 220' comprises a second or rod antenna 222', a second case 224 for supporting the rod antenna 222', and a second output cable 226 connected to the second case 224.

In the manner which is described above, the conventional composite antenna unit comprises the first and the second antenna unit 100' and 220' which are independently separated from each other. In other words, it is necessary for the conventional composite antenna unit to provide with two antennas 110 and 222' and two cases 200 and 224. As a result, the conventional composite antenna unit is disadvantageous in that it takes a long time on manufacturing and on assembling and it becomes large in size of the overall unit, as also mentioned in the preamble of the instant specification.

Figure 45:
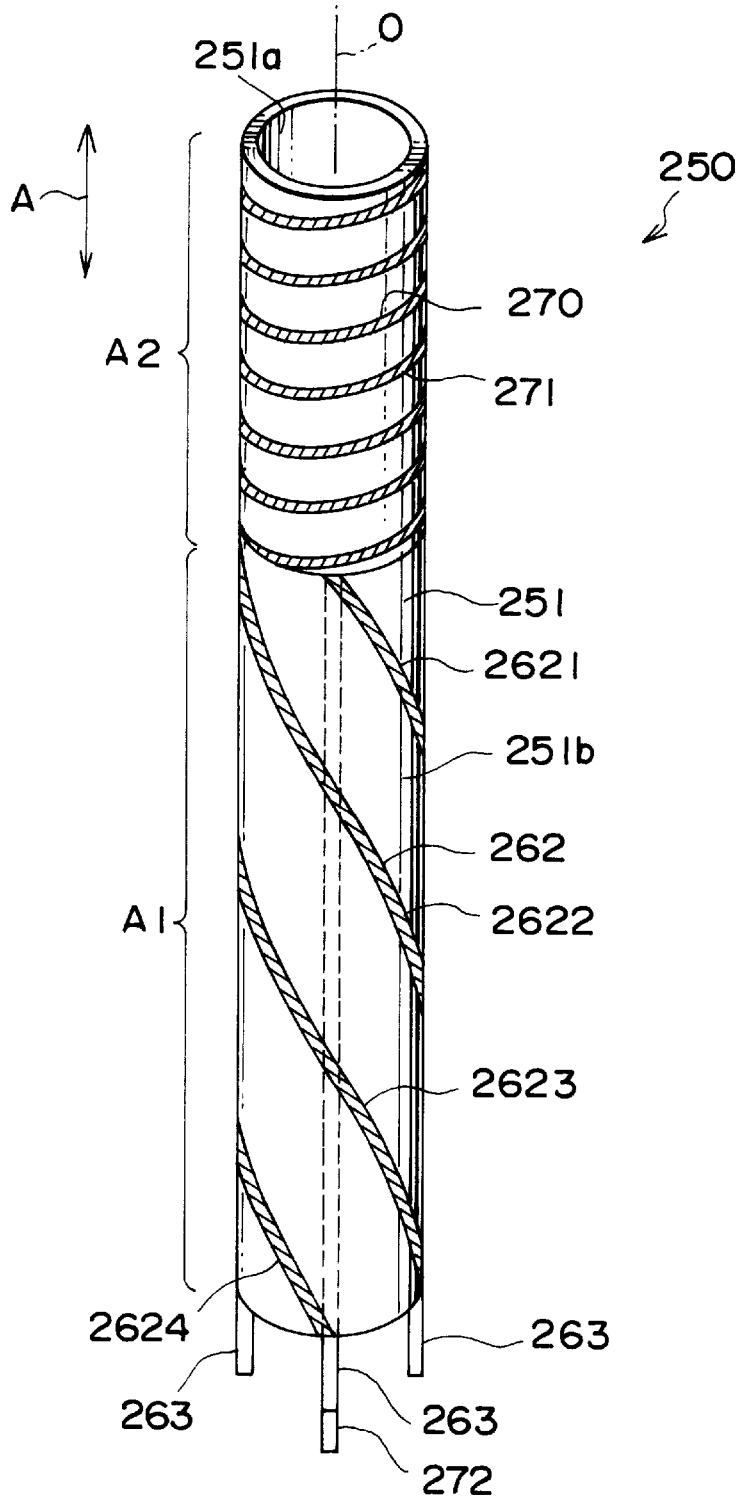
FIG. 45 is a perspective view showing a composite antenna according to a first embodiment of this invention.

Referring to FIG. 45, the description will proceed to a composite antenna 250 according a first embodiment of this invention. The composite antenna 250 comprises a hollow cylindrical member 251 made of insulator. The hollow cylindrical member 251 has a center axis O extending a longitudinal direction A. The hollow cylindrical member 251 has an inner peripheral surface 251*a* and an outer peripheral surface 251*b*. The outer peripheral surface 251*b* is divided into first and second area A1 and A2 in the longitudinal direction A as shown in FIG. 45.

The composite antenna 250 further comprises first and second conductive patterns 262 and 270. The first conductive pattern 262 is wound around the first area A1 in the outer peripheral surface 251*b* of the hollow cylindrical member 251 while the second conductive pattern 270 is wound around the second area A2 in the outer peripheral surface 251*b* of the hollow cylindrical member 251. The first conductive pattern 262 is for receiving the above-mentioned satellite wave while the second conductive pattern 270 is for receiving the above-mentioned ground wave. In the example being illustrated, the first conductive pattern 262 has first through fourth antenna lead members 2621, 2622, 2623, and 2624 which are wound around the first area A1 in the outer peripheral surface 251*b* of the hollow cylindrical member 251 in a helix fashion as shown in FIG. 45. The second conductive pattern 270 consists of one antenna lead member 271 which is wound around the second area A2 in the outer peripheral surface 251*b* of the hollow cylindrical member 251 in a helix fashion as shown in FIG. 45.

Each of the first through the fourth antenna lead members 2621 to 2624 has a lower end connected to a primary output terminal portion 263. The antenna lead member 271 has a lower end which extends toward a lower end of the hollow cylindrical member 251 to connect with a secondary output terminal portion 272.

Inasmuch as both of the satellite wave and the ground wave are received by the composite antenna 250 comprising only one hollow cylindrical member 251, it is possible to reduce the number of parts, to decrease a manufacturing cost, and to miniaturize the composite antenna 250.

Although the first through fourth antenna lead members 2621 to 2624 are wound around the first area A1 in the outer peripheral surface 251*b* of the hollow cylindrical member 251 in the helix fashion, an antenna pattern film as illustrated in FIG. 3 may be wound around the first area A1 in the outer peripheral surface 251*b* of the hollow cylindrical member 251.

Figure 46:
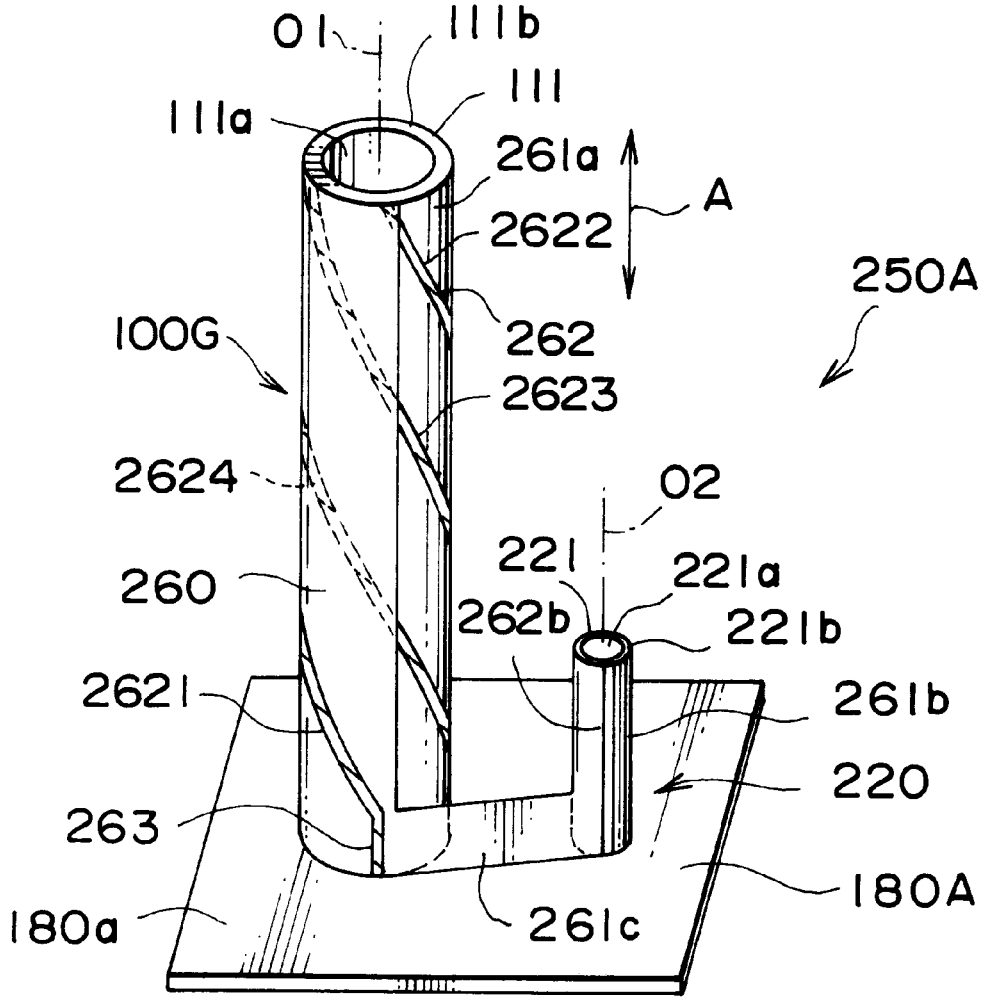
FIG. 46 is a perspective view showing a composite antenna according to a second embodiment of this invention.

Referring to FIG. 46, the description will proceed to a composite antenna 250A according to a second embodiment of this invention. The composite antenna 250A comprises a circuit board 180A having a principal surface 180*a*, a first antenna portion 100G for receiving a circular polarization or the above-mentioned satellite wave, and a second antenna portion 220 for receiving a linear polarization or the above-mentioned ground wave.

The first antenna portion 100G comprises a first hollow cylindrical member 111 which stands on the principal surface 180*a* of the circuit board 180A. The first hollow cylindrical member 111 is made of insulator. The first hollow cylindrical member 111 has a first center axis O1 extending in a longitudinal direction A which is perpendicular to the principal surface 180*a* of the circuit board 180A. The first hollow cylindrical member 111 has a first inner peripheral surface 111*a* and a first outer peripheral surface 111*b*.

The second antenna portion 220 comprises a second hollow cylindrical member 221 which stands on the principal surface 180*a* of the circuit board 180A with apart from the first cylindrical member 111 with a space. The second hollow cylindrical member 221 is made of insulator. The second hollow cylindrical member 221 has a second center axis O2 extending in the longitudinal direction. The second hollow cylindrical member 221 has a second inner peripheral surface 221*a* and a second outer peripheral surface 221*b*.

Figure 47A:
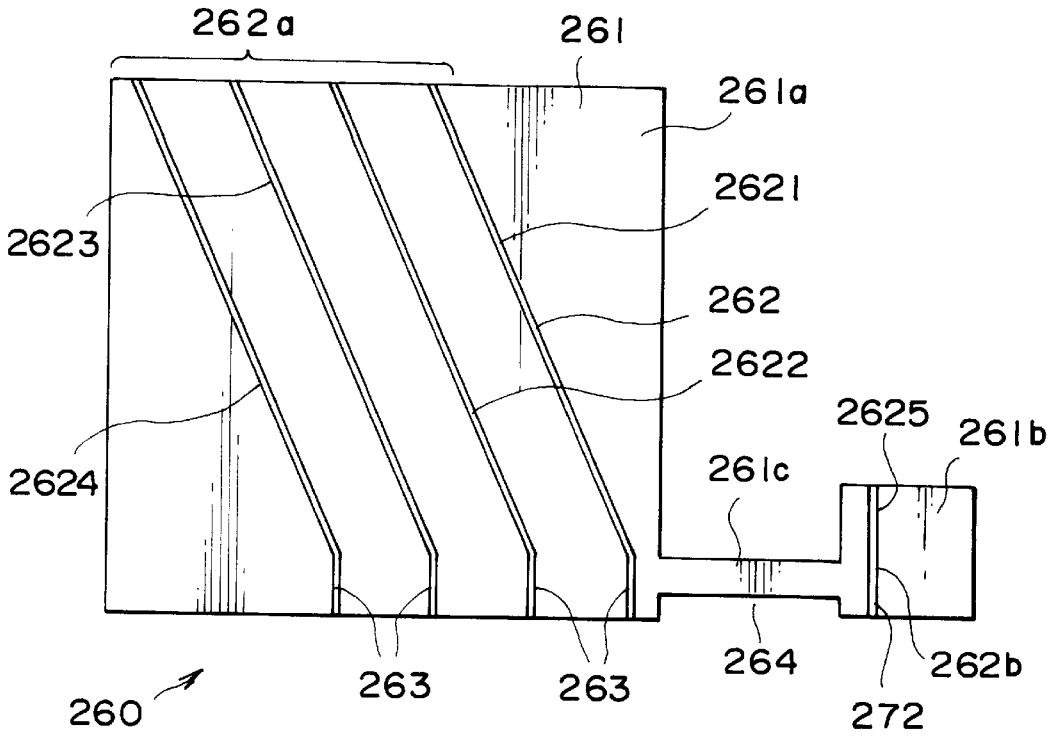
FIG. 47A is a plan view showing an antenna pattern film for use in the composite antenna illustrated in FIG. 46.
Figure 47B:
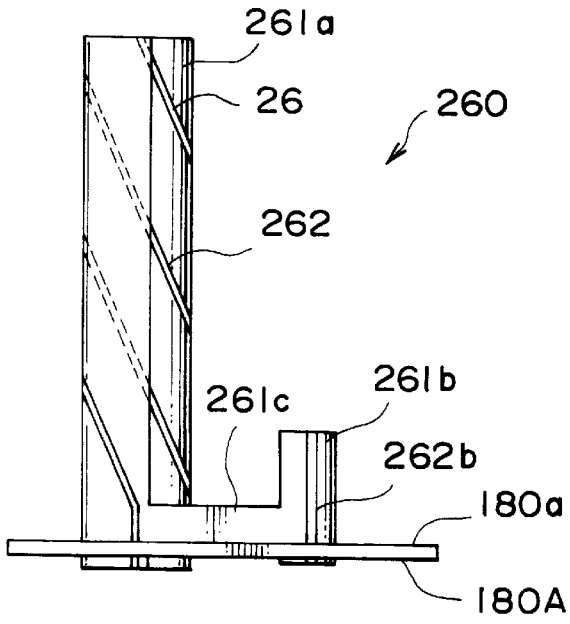
FIG. 47B is a front view showing the composite antenna illustrated in FIG. 46.

Referring to FIGS. 47A and 47B in addition to FIG. 46, the composite antenna 250A further comprises an antenna pattern film 260. The antenna pattern film 260 comprises a flexible insulating film 261 and a conductive pattern 262 printed or formed on the flexible insulating film 261. The flexible insulating film 261 comprises a first film portion 261*a*, a second film portion 261*b*, and a connection film 261*c* for connecting between the first and the second film portions 261*a* and 261*b*.

As shown in FIG. 46, the first film portion 261*a* is wound around the first outer peripheral surface 111*b* of the first hollow cylindrical member 111 while the second film portion 261*b* is wound around the second outer peripheral surface 221*b* of the second hollow cylindrical member 221. As shown in FIG. 47A, the conductive pattern 262 first and second conductive pattern portions 262*a* and 262*b* which are printed or formed on the first and the second film portions 261*a* and 261*b*, respectively. The first conductive pattern portion 262*a* has first through fourth antenna lead members 2621, 2622, 2623, and 2624 which are wound around the first outer peripheral surface 111*b* of the first hollow cylindrical member 111 in a helix fashion. The second conductive pattern portion 262*b* has only one antenna lead member 2625 extending in the longitudinal direction A.

A combination of the first hollow cylindrical member 111 and the first film portion 261 serves as the first antenna portion 100G while a combination of the second hollow cylindrical member 221 and the second film portion 262 acts as the second antenna portion 220.

Each of the first through the fourth antenna lead members 2621 to 2624 has a lower end connected to the primary output terminal portion 263 which extends in the longitudinal direction A. The antenna lead member 2625 has a lower end connected to the secondary output terminal portion 272. The connection film portion 261*c* of the antenna pattern film 260 has a cut portion 264.

Figure 48:
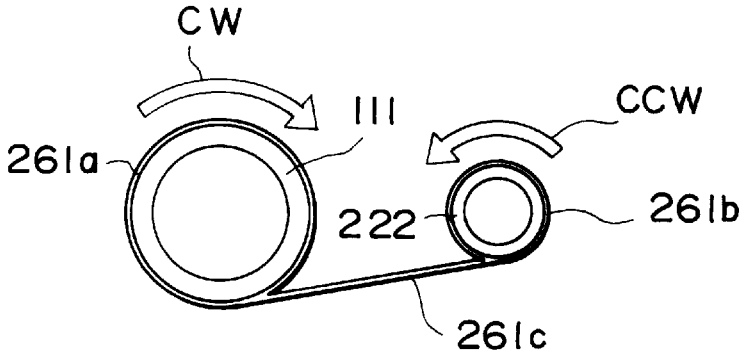
FIG. 48 is a plan view for use in describing a method of winding the antenna pattern film illustrated in FIG. 47A.

Turning to FIG. 48, the first film portion 261*a* is wound around the first outer peripheral surface 111*b* of the first hollow cylindrical member 111 in a clockwise direction CW while the second film portion 261*b* is wound around the second outer peripheral surface 221*b* of the second hollow cylindrical member 221 in a counterclockwise direction CCW.

Figure 49:
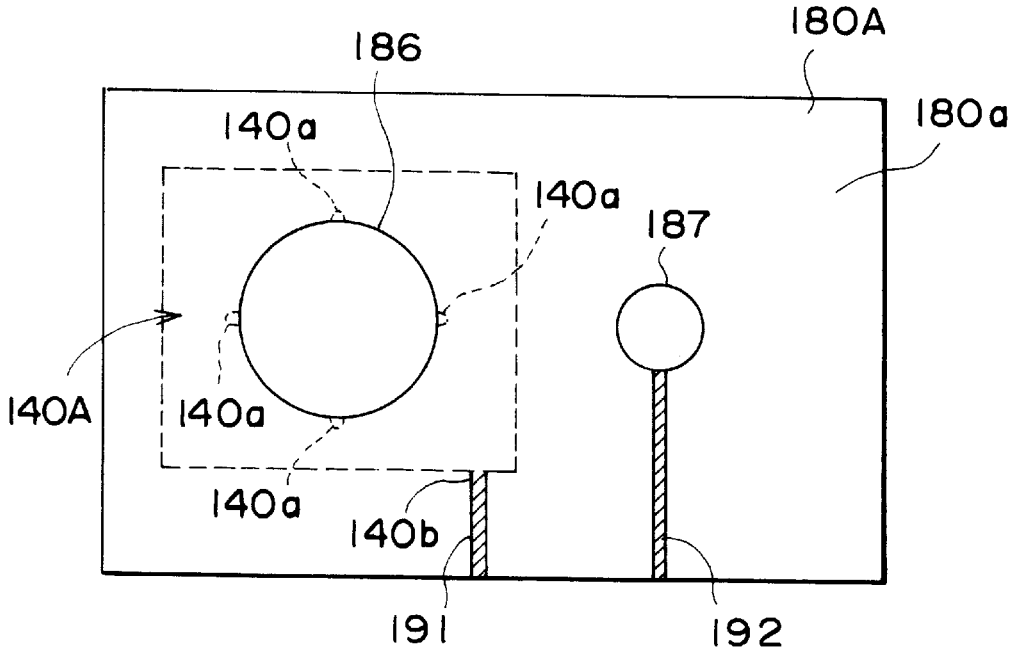
FIG. 49 is a plan view showing a circuit board for use in the composite antenna illustrated in FIG. 46.

Turning to FIG. 49, the circuit board 180A has a first circular slit 186 for mounting the first hollow cylindrical member 111 or the first antenna portion 100G (FIG. 46) thereon and a second circular slit 187 for mounting the second hollow cylindrical member 221 or the second antenna portion 220 thereon. The phase shifter 140A is mounted on a back surface of the circuit board 180A. The phase shifter 140A has the shifter input terminals 140*a* connected to the primary output terminal portions 263 (FIG. 47A) for the first through the fourth antenna lead members 2621 to 2624. The phase shifter 140A has the shifter output terminal 140*b* connected to a first output lead line 191 formed on the circuit board 180A. The secondary output terminal portion 272 (FIG. 47A) for the antenna lead member 2625 is connected to a second output lead line 192 formed on the circuit board 180A.

Inasmuch as the antenna pattern film 260 comprises the first and the second film portions 261*a* and 261*b* which are wound around the first and the second outer peripheral surfaces 111*b* and 221*b* of the first and the second hollow cylindrical members 111 and 221, it is possible to reduce processes for manufacturing the antenna pattern film 260 and for winding the antenna pattern film 260 around the first and the second hollow cylindrical members 111 and 221. As a result, it is possible to reduce a production cost and the number of parts.

Although the composite antenna 250A is provided with the second hollow cylindrical member 221 in the above-mentioned embodiment, the second hollow cylindrical member 221 may be removed from the composite antenna 260A. Although the first conductive pattern portion 262*a* has four antenna lead members 2621 to 2624 in the above-mentioned embodiment, the first conductive pattern portion 262*a* may have only one lead member. In this event, the phase shifter 140A is not necessary.

What is claimed is:

1. An antenna unit comprising a helical antenna including a plurality of antenna lead members, a phase shifter having a plurality of shifter input terminals connected to ends of the antenna lead members of said helical antenna and a shifter output terminal, and a low-noise amplifier having an amplifier input terminal connected to the shifter output terminal, wherein said antenna unit further comprises:

a circuit board having a principal surface on which said phase shifter and said low-noise amplifier are mounted, said circuit board including first and second conductive connection strips formed on the principal surface, said first and said second conductive connection strips having one ends connected to the shifter output terminal and the amplifier input terminal, respectively, said first and said second conductive connection strips having other ends which are opposed to each other with a predetermined space; and a conducting member for electrically connecting between the other ends of said first and said second conductive connection strips.

2. The antenna unit as claimed in claim 1, wherein said conducting member is solder.

3. The antenna unit as claimed in claim 1, wherein said first and said second conductive connection strips further have first and second contact parts for a test probe.

4. The antenna unit as claimed in claim 3, wherein each of said first and said second contact parts is a through hole.

5. A method of manufacturing an antenna unit comprising a helical antenna including a plurality of antenna lead members, a phase shifter having a plurality of shifter input terminals connected to ends of the antenna lead members of said helical antenna and a shifter output terminal, and a low-noise amplifier having an amplifier input terminal connected to the shifter output terminal, said method comprising the steps of:

preparing a circuit board having a principal surface for mounting said phase shifter and said low-noise amplifier;

forming, on the principal surface of said circuit board, said phase shifter with the shifter output terminal and said low-noise amplifier with the amplifier input terminal;

forming, on the principal surface of said circuit board, first and second conductive connection strips having one ends connected to the shifter output terminal and the amplifier input terminal, respectively, said first and said second conductive connection strips having other ends which are opposed to each other with a predetermined space; and electrically connecting between the other ends of said first and said second conductive connection strips using a conducting member.

6. The method as claimed in claim 5, wherein said conducting member is solder.

7. The method of measuring characteristics in an antenna unit as claimed in claim 5, wherein before electrically connecting between the other ends of said first and said second conductive connection strips using said conducting member, the method further comprises the steps of:

measuring characteristics of said phase shifter by using said test probe which is in contact with the first contact part of said first conductive connection strip; and measuring characteristics of said low-noise amplifier by using said test probe which is in contact with the second contact part of said second conductive connection strip.

* * * * *